United States Patent [19]

Hirano et al.

[11] Patent Number: 5,055,386

[45] Date of Patent: Oct. 8, 1991

[54] SILVER HALIDE COLOR PHOTOGRAPHIC MATERIALS WITH POLYMER PARTICLES

[75] Inventors: Tsumoru Hirano; Haruyoshi Gotou; Osamu Takahashi, all of Kanagawa, Japan

[73] Assignee: Fuji Photo Film Co., Ltd., Kanagawa, Japan

[21] Appl. No.: 296,166

[22] Filed: Jan. 12, 1989

[30] Foreign Application Priority Data

Jan. 12, 1988 [JP] Japan ..... 63-3170

[51] Int. Cl.[5] ..... G03C 7/32

[52] U.S. Cl. ..... 430/545; 430/546; 430/628

[58] Field of Search ..... 430/546, 628, 545

[56] References Cited

U.S. PATENT DOCUMENTS

| | | | |
|---|---|---|---|
| 3,619,195 | 11/1971 | Van Campen | 430/546 |
| 4,201,589 | 5/1980 | Sakaguchi et al. | 430/627 |
| 4,358,533 | 11/1982 | Tokitou et al. | 430/546 |
| 4,368,258 | 1/1983 | Fujiwhara et al. | 430/546 |
| 4,388,403 | 6/1983 | Helling et al. | 430/546 |
| 4,716,099 | 12/1987 | Simons | 430/546 |
| 4,857,449 | 8/1989 | Ogawa et al. | 430/550 |
| 4,946,770 | 8/1990 | Takahashi et al. | 430/546 |

*Primary Examiner*—Richard L. Schilling

*Attorney, Agent, or Firm*—Sughrue, Mion, Zinn Macpeak & Seas

[57] ABSTRACT

A silver halide color photographic material is disclosed, which material comprises a support and at least one silver halide photographic emulsion layer which contains a dispersion of fine lipophilic particles which particles are comprised of at least one type of oil solution non-color forming polymer and an oil soluble coupler which has been rendered fast to diffusion and which can form a dye by coupling with the oxidized form of a primary aromatic amine developing agent, wherein at least 20% by weight of said oil soluble non-color forming polymer has a molecular weight not more than 40,000.

19 Claims, No Drawings

SILVER HALIDE COLOR PHOTOGRAPHIC MATERIALS WITH POLYMER PARTICLES

FIELD OF THE INVENTION

This invention concerns silver halide color photographic materials which contain silver halide photographic emulsion layers of which the emulsion has excellent stability, and with which dye images which have excellent image storage properties can be formed.

BACKGROUND OF THE INVENTION

The dye images of silver halide color photographic materials are known to fade markedly, depending on the storage conditions, when they are stored for a long period of time in light, and also when they are exposed to light for short periods of time and stored for long periods of time in the dark. In general, the color fading in the former case is called light fading and that in the latter cases is called dark fading, and when color photographic materials are stored semi-permanently as records it is desirable that the extents of light fading and dark fading should be reduced to a minimum and that the overall tri-color balance of the yellow, magenta and cyan dye images should be maintained in the initial state even after fading. However, the extents of light and dark fading differ for each of the yellow, magenta and cyan dye images, and after long term storage the aforementioned overall faded color balance is inevitably destroyed and the picture quality of the dye image inevitably deteriorates.

The extents of light fading and dark fading differ according to the couplers which are used and other factors but, in many cases, the dark fading arises most readily in the case of the cyan dye image, followed in order by the yellow dye image and the magenta dye image, and the extent of the dark fading of the cyan dye image is greater than that of the other dye images. Furthermore, in the case of light fading, the cyan dye image tends to fade most readily, followed in order by the yellow dye image and the magenta dye image, especially in the case of a light source which is rich in ultraviolet rays.

Thus, in order to maintain a good faded color balance between the yellow, magenta and cyan dye images over a long period of time it is necessary to reduce to a minimum the light and dark fading of the cyan dye image, and various attempts have been made in the past with a view to improving light and dark fading properties for this purpose. These past attempts can be broadly classified into two groups, namely those in which novel couplers which can form dye images which have a smaller tendency to fading have been developed and those in which novel additives which prevent fading have been developed.

Many phenolic cyan couplers were known in the past for forming cyan dyes. For example, the 2-[α-2,4-di-tert-amylophenoxybutanamido]-4,6-dichloro-5-methylphenol disclosed in U.S. Pat. No. 2,801,171 is such that the colored dye formed from it has good resistance to light, but it has the disadvantage of having poor heat resistance.

Moreover, cyan couplers in which the 3-position or the 5-position of the phenol has been substituted with an alkyl group which has 2 or more carbon atoms have been disclosed, for example, in JP-B-49-11572 (U.S. Pat. No. 3,772,002) and in JP-A-60-209735 and JP-A-60-205447, etc. (the terms "JP-A" and "JP-B" used herein signifies a published unexamined Japanese patent application and examined Japanese patent publication, respectively). The heat stability of the cyan image formed from these couplers is somewhat better, but it is still inadequate.

Furthermore, 2,5-diacylaminophenol based cyan couplers which have an acylamino group in the 2-position and in the 5-position of the phenol have been disclosed, for example, in U.S. Pat. Nos. 2,369,929, 2,772,162 and 2,895,826, and in JP-A-50-112038, JP-A-53-109630 and JP-A-55-163537.

These 2,5-diacylaminophenol based couplers are such that the cyan dye image which is formed has good heat resistance, but there are problems with the coloring properties of the coupler, with the light fading properties of the cyan image which is produced, and with yellowing of the unreacted cyan coupler which is caused by light. Furthermore, even better heat resistance is required.

The 1-hydroxy-2-naphthamide cyan couplers are generally inadequate in respect of both light fading and dark fading properties.

Furthermore, the 1-hydroxy-2-acylaminocarbostyryl cyan couplers disclosed in JP-A-56-104333 have good fastness to both light and heat, but the spectral absorption characteristics of the colored image which is formed are undesirable for color reproduction in a color photograph, and there is a further problem in that pink staining is produced by irradiation with light.

Furthermore, the cyan polymer couplers disclosed in U.S. Pat. No. 3,767,412 and in JP-A-59-65844 and JP-A-61-39044, etc. certainly have excellent heat resistance under dry conditions but their heat resistance is poor under conditions of high humidity and they have a further disadvantage in that their coloring properties are inadequate.

Furthermore, methods in which hydrophobic substance soluble couplers such as oil soluble couplers are dissolved in water miscible organic solvents and the solutions are mixed with loadable polymer latexes and the said hydrophobic substances are loaded onto the polymers have been disclosed in U.S. Pat. No. 4,203,716, etc. However, there is a problem with methods of this type in which loadable polymer latexes are used in that the light fastness of the cyan image in particular is worse than that obtained when a high boiling point coupler solvent which is immiscible with water is used. Moreover, there is a further disadvantage in that large amounts of polymer must be used in order to carry enough coupler to obtain the maximum color density.

Photosensitive materials which contain a coupler dispersion (particle size of the dispersed particles from about 0.5 μm to 5 μm) in which an organic solvent soluble homopolymer of a hydrophobic monomer of a specified structure is used instead of a high boiling point coupler solvent and are better in terms of film properties, color reproduction failure and light fading, and in terms of their storage properties prior to processing, etc., have been disclosed in JP-B-48-30494. However, when the homopolymers of hydrophobic monomers disclosed in the aforementioned JP-B-48-30494 are used in place of a coupler solvent there are problems in that the coloring properties are poor (this is particularly marked in development baths which are essentially free of color forming accelerators such as benzyl alcohol, etc. which were added to the development baths in the illustrative examples described in the aforementioned patent) and in that the stability of the emulsion is poor.

On the other hand, copolymers with hydrophilic monomers such as acrylic acid etc. are inadequate, even though they do provide some improvement in the stability of the emulsified dispersion and the color forming properties, as there is a problem in that color fading (especially heat fading under conditions of high humidity) is adversely affected as the amount of hydrophilic monomer in the copolymer is increased in order to improve the color forming properties. Furthermore, with all of these polymers the ability to prevent crystallization of the coupler is insufficient and adverse effects also arise as a result of the formation of coupler crystals during storage of the emulsified dispersions.

Furthermore, in the case of JP-B-48-30494 (U.S. Pat. No. 3,619,195), and especially in the case of the cyan couplers, there is a major problem in that light fading is much worse (by a factor of 1.5 to 3 times) than that obtained on dispersion in a conventional high boiling point solvent (a so-called oil dispersion).

Furthermore, the hue of the cyan dye which is formed in the case of JP-B-48-30494 (U.S. Pat. No. 3,619,195) is on the long wavelength side immediately after development processing, but there is a problem in that it is liable to shift to the short wavelength side, especially on storage under high temperature conditions, which is to say that there is a problem in that the hue changes with the passage of time.

On the other hand, in cases when a polymer is emulsified and dispersed together with a coupler, the time taken to dissolve the material in an auxiliary solvent increases as the molecular weight of the polymer increases and the viscosity of the resulting solution is also raised, and so emulsification and dispersion become more difficult, coarser particles are formed and this has the effect of worsening the color forming properties, and other problems, such as a worsening of state of the coated surface, are liable to occur. Reduction of the viscosity of the solution using a large amount of auxiliary solvent in order to overcome these problems give rise to problems with the need to develop new process for treating or coating such solutions.

Improved dark fading couplers obtained in the past by changing the structure of the couplers have been opposed by inadequacies in respect of hue, color forming properties, staining or light resistance, and a new technique is clearly required. Furthermore, there are no known methods which are effective, without having an adverse effect, for improving dark fading by means of additives or by means of so-called methods of use, such as dispersion methods, etc.

On the other hand, the use of various developing agent penetrants during the color development of silver halide color photosensitive materials in which lipophilic non-diffusible (oil protected) type couplers are used has been investigated in the past with a view to increasing coloring properties and shortening processing times. Benzyl alcohol, especially when added to the color development bath, has a marked color formation accelerating effect and it is widely used at the present time with color papers, color reversal papers and color positive films which are used for display purposes, etc.

However, benzyl alcohol has a low water solubility and so a solvent such as diethyleneglycol, triethyleneglycol or an alkanolamine etc. is required to facilitate its dissolution. These compounds, including benzyl alcohol, have a high BOD biological oxygen demand) and a high COD (chemical oxygen demand), these being indicators of pollution loading, and the elimination of these compounds is desirable from the environmental protection viewpoint.

Moreover, time is required for dissolution in cases where benzyl alcohol is used, even when the above mentioned solvents are also being used, and so it is also preferable that benzyl alcohol should not be used from the viewpoint of facilitating bath preparation.

Furthermore, in cases where benzyl alcohol is carried over to a bleach bath or bleach-fix bath downstream of the development bath it can result in the formation of a leuco form of the cyan dye and this results in a reduction of the color density. Moreover, the wash-out rate of the development bath components is lowered and there are some cases where this has an adverse effect on the image storage properties of the processed photosensitive material. Hence, the use of benzyl alcohol is also undesirable from this point of view.

Thus, the development of coupler dispersions which provide improved image storage properties and which also have excellent coloring properties even when benzyl alcohol is not used is clearly desirable

SUMMARY OF THE INVENTION

Thus, the first aim of the invention is to provide silver halide photographic materials which can form dye images of which the light and dark fading balance is improved and which, in particular, exhibit excellent image storage properties even under conditions of high temperature and high humidity.

The second aim of the invention is to provide silver halide photographic materials which have a good overall yellow, magenta and cyan image faded color balance, achieved by adjustment of the extents of fading, and which have, therefore, superior dye images even after long term storage.

The third aim of the invention is to provide silver halide photographic materials with which it is possible to form dye images which have improved image storage properties without have any adverse effect on the various characteristics of the photograph.

The fourth aim of the invention is to provide silver halide photographic materials which are superior in their image storage properties which consist of emulsified dispersions which have high emulsification and dispersion stability.

The fifth aim is to provide silver halide photographic materials which exhibit satisfactory coloring properties even when processed in a color development bath which is essentially free of benzyl alcohol, and which have excellent image storage properties, consisting of emulsified coupler dispersions which have excellent stability.

The sixth aim of the invention is to provide silver halide photosensitive materials which have improved dark fading properties without adversely affecting the light fading properties, especially in connection with the fastness of the cyan dye image.

As a result of various investigations, the inventors have realized the aforementioned aims by using a silver halide color photographic material which has, on a support, at least one silver halide photographic emulsion layer which contains a dispersion of fine lipophilic particles obtained by the emulsification and dispersion of a liquid mixture which contains at least one type of oil soluble non-color forming polymer and an oil soluble coupler which has been rendered fast to diffusion and which can form a dye by coupling with the oxidized form of a primary aromatic amine developing agent, and wherein at least 20 weight percent of said oil soluble non-color forming polymer has a molecular weight of not more than 40,000.

DETAILED DESCRIPTION OF THE INVENTION

The oil soluble couplers which have been rendered fast to diffusion and which can form dyes by coupling with the oxidized form of a primary aromatic amine developing agent which can be used in the invention are described in detail below.

There are various ways of rendering a coupler fast to diffusion, but the two most important methods are indicated below.

(1) The methods in which at least one so-called "non-diffusible group" which contains in part of its structure an aliphatic group, aromatic group or heterocyclic group which has a molecular weight above a certain value is introduced into the coupler molecule. The total number of carbon atoms in the non-diffusible group differs according to the other structural parts of the coupler, but is normally at least 6 and preferably 12 or more.

(2) The methods in which the coupler is rendered fast to diffusion by increasing the molecular weight of each molecule by forming oligomers (so-called polymeric couplers).

The molecular weight of the couplers described under (1) above is from 250 to 1,200, and preferably from 300 to 800.

The couplers described in (2) above are preferably trimers or larger units.

Oil protected type naphthol based and phenol based couplers can be used as cyan couplers in this invention, and typical examples include the naphthol based couplers disclosed in U.S. Pat. No. 2,474,293, and the preferred two equivalent naphthol based couplers of the oxygen atom elimination type disclosed in U.S. Pat. Nos. 4,052,212, 4,146,396, 4,228,233 and 4,296,200. Actual examples of phenol based couplers have been disclosed in U.S. Pat. Nos. 2,369,929, 2,801,171, 2,772,162, 2,895,826, etc. Furthermore, the use of the phenol based cyan couplers which have an alkyl group consisting of an ethyl or larger group in the meta position of the phenol ring disclosed in U.S. Pat. No. 3,772,002, the 2,5-diacylamino substituted phenol based couplers disclosed in U.S. Pat. Nos. 2,772,162, 3,758,308, 4,126,396, 4,334,011 and 4,327,173, in West German Patent Laid Open (OLS) No. 3,329,729, and in JP-A-59-166956, and the phenol based couplers which have a phenylureido group in the 2-position and an acylamino group in the 5-position disclosed in U.S. Pat. Nos. 3,446,622, 4,333,999, 4,451,559 and 4,427,767 etc. are preferred in this invention.

The preferred phenol based cyan couplers for use in this invention are those which can be represented by the general formula (Cp-I).

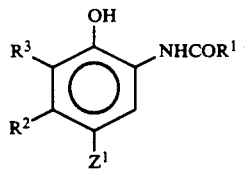

(Cp-I)

The substituent groups in general formula (Cp-I) are described in detail below.

Thus, in general formula (Cp-I), $R^1$ represents an alkyl group, aryl group or heterocyclic group, and actual examples include alkyl groups which have from 1 to 32 carbon atoms, for example, methyl, butyl, tridecyl, cyclohexyl, allyl, etc., aryl groups such as phenyl, naphthyl, etc., and heterocyclic groups such as 2-pyridyl, 2-furyl, etc.

The aforementioned groups represented by $R^1$ may be further substituted with groups selected from among the alkyol groups, aryl groups, alkyloxy or aryloxy groups (for example, methoxy, dodecyloxy, methoxyethoxy, phenyloxy, 2,4-di-tert amylphenoxy, 3-tert-butyl-4-hydroxyphenyloxy, naphthyloxy), carboxyl groups, alkylcarbonyl or arylcarbonyl groups (for example, acetyl, tetradecanoyl, benzoyl group), alkyloxycarbonyl or aryloxycarbonyl groups (for example, methoxycarbonyl, phenoxycarbonyl), acyloxy groups (for example, acetoxy, benzoyloxy), sulfamoyl groups (for example, N-ethylsulfamoyl, N-octadecylsulfamoyl), carbamoyl groups (for example, N-ethylcarbamoyl, N-methyl-dodecylcarbamoyl), sulfonamido groups (for example, methanesulfonamido, benzenesulfonamido), acylamino groups (for example, acetylamino, benzamido, ethoxycarbonylamino, phenylaminocarboxylamino), imido groups (for example, succinimido, hydantoinyl), sulfonyl groups (for example, methanesulfonyl), hydroxyl groups, a cyano group, nitro groups and a halogen atom.

Moreover, $Z^1$ in general formula (Cp-I) represents a hydrogen atom or a coupling leaving group, and examples include halogen atoms (for example, a fluorine, chlorine, or bromine atom), alkoxy groups (for example, dodecylmethoxy, methoxycarbamoylmethoxy, carboxypropyloxy, methylsulfonylethoxy), aryloxy groups (for example, 4-chlorophenoxy, 4-methoxyphenoxy), acyloxy groups (for example, acetoxy, tetradecanoyloxy, benzoyloxy), sulfonyloxy groups (for example, methanesulfonyloxy, toluenesulfonyloxy), amido groups (for example, dichloroacetylamino, methanesulfonylamino, toluenesulfonylamino), alkoxycarbonyloxy groups (for example, ethoxycarbonyloxy, benzyloxycarbonyloxy), aryloxycarbonyloxy groups (for example, phenoxycarbonyloxy), aliphatic or aromatic thio groups (for example, phenylthio, 2-butoxy-5-t-octylphenylthio, tetrazolylthio), imido groups (for example, succinimido, hydantoinyl), N-heterocyclic groups (for example, 1-pyrazolyl, 1-benzotriazolyl) and aromatic azo groups (for example, phenylazo), etc.

$R^2$ in general formula (Cp-I) represents an acylamino group or an alkyl group, and preferably the acylamino group may be, for example, an acetylamino group, a benzamido group, a 2,4-di-tert-amylphenoxyacetamido group, an α-(2,4-di-tert-amylphenoxy)butyl)amido group, an α-(2,4-di-tert-amylphenoxy)-β-methybutylamido group, an α-(2-chloro-4-tert-amylphenoxy)octanamido group, an α-(2-chlorophenoxy)-tetradecanamido group, an α-(3-pentadecylphenoxy)-butylamido group, etc., and the alkyl groups represented by $R^2$ are preferably those alkyl groups which have 2 or more carbon atoms, for example, an ethyl group, a propyl group, a t-butyl group, a pentadecyl group, and a benzyl group.

$R^3$ in general formula (Cp-I) represents a hydrogen atom, a halogen atom (for example, fluorine, chlorine, or bromine), an alkyl group (for example, methyl, ethyl, n-butyl, tert-butyl, n-octyl, n-tetradecyl) or an alkoxy group (for example, methoxy, 2-ethylhexyloxy, n-octyloxy, n-dodecyloxy group). Furthermore, $R^3$ and $R^2$ may join to form a condensed carbocyclic or heterocyclic ring (preferably a five to seven membered nitrogen containing heterocyclic ring).

Dimers or larger oligomers may be formed via the groups $R^1$ or $R^2$ of general formula (Cp-I).

Oil protected type, indazolone based or cyanoacetyl based couplers, and preferably 5-pyrazolone based and pyrazoloazole, such as the pyrazolotriazoles, based couplers can be used as the magenta couplers which are used in the invention. The use of the 5-pyrazolone based couplers which are substituted with an alkylamino group or an acylamino group in the 5-position are preferred from the point of view of the hue of the colored dye and the color density, and typical examples have been disclosed in U.S. Pat. Nos. 2,311,082, 2,343,703, 2,600,788, 2,908,573, 3.062,653, 3,152,896 and 3,936,015, etc. The nitrogen atom leaving groups disclosed in U.S. Pat. No. 4,310,619, or the arylthio groups disclosed in U.S. Pat. No. 4,351,897, are preferred as the leaving group of a two equivalent 5-pyrazolone based coupler. Furthermore, high color densities can be obtained with the 5-pyrazolone based couplers which have ballast groups disclosed in European Patent 73,636.

The pyrazolobenzimidazoles disclosed in U.S. Pat. No. 3,369,879, and preferably the pyrazolo(5,1-c)(1,2,4)-triazoles disclosed in U.S. Pat. No. 3,725,067, the pyrazolotetrazoles disclosed in *Research Disclosure* 24220 (June 1984) and the pyrazolopyrazoles disclosed in *Research Disclosure* 24230 (June 1984) can be used as pyrazoloazole based couplers The imidazo(1,2-b) pyrazoles disclosed in European Patent 119,741 are preferred in view of the small absorption by the colored dye on the yellow side and its light fastness, and in view of the fact that they are very effective for realizing the effect of the invention, and the pyrazolo(1,5-b)(1,2,4)triazoles disclosed in European Patent No. 119,860 are especially desirable.

The most desirable magenta couplers for use in this invention are those which can be represented by the general formula (Cp-II) and/or (Cp-III).

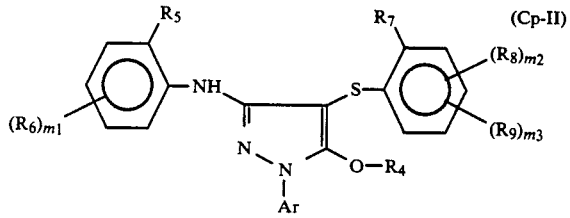

wherein $m_1$, $m_2$, $m_3$ each represents 0, 1 or 2.

The substituent groups in general formula (Cp-II) are described in detail below.

Thus, Ar represents an aryl group (for example, phenyl, 2,4,6-trichlorophenyl, 2,5-dichlorophenyl, 2,6-dichlorophenyl, 2,4-dimethyl-6-methoxyphenyl, 2,6-dichloro-4-ethoxycarbonylphenyl, 2,6-dichloro-4-cyanophenyl), $R_4$ represents a hydrogen atom, an acyl group (for example, acetyl, benzoyl, propanoyl, butanoyl, monochloroacetyl), or an aliphatic or aromatic sulfonyl group (for example, methanesulfonyl, butanesulfonyl, benzenesulfonyl, toluenesulfonyl, 3-hydroxypropanesulfonyl), $R_5$ represents a halogen atom (for example, chlorine, bromine, fluorine) or an alkoxy group (for example, methoxy, butoxy, benzyloxy, 2-methoxyethoxy), and $R_6$ represents an alkyl group (for example, methyl, butyl, tert-butyl, tert-octyl, dodecyl, 2,4-di-tertpentylphenoxymethyl, hexadecyl), an aryl group (for example, phenyl, 2,4-dichlorophenyl), a halogen atom (for example, chlorine, fluorine, bromine), an alkoxy group (for example, methoxy, dodecyloxy, benzyloxy, hexadecyloxy), an aryloxy group (for example, phenoxy, 4-dodecylphenoxy), an acylamino group (for example, acetylamino, tetradecanamido, an α-(2,4-di-tert-pentylphenoxy)butylamido group, an α-(4-hydroxy-3-tert-butylphenoxy)tetradecanamido group, α-[4-(4-hydroxyphenylsulfonyl) phenoxy]-dodecanamido group), an imido group (for example, N-succinimido, N-maleimido, 1-N-benzyl-5,5-dimethylhydantoin-3-yl, 3-hexadecenyl-1-succinimido), a sulfonamido group (for example, methanesulfonamido, benzenesulfonamido, tetradecanesulfonamido, 4-dodecyloxybenzenesulfonamido, 2-octadecyloxy-5-tert-octylbenzenesulfonamido), an alkoxycarbonyl group (for example, ethoxycarbonyl, dodecyloxycarbonyl, hexadecyloxycarbonyl), a carbamoyl group (for example, N-phenylcarbamoyl, N-ethylcarbamoyl, N-dodecylcarbamoyl, N-(2-dodecyloxyethyl)carbamoyl, N-[3-(2,4-di-tert-pentylphenoxy)propl]carbamoyl), a sulfamoyl group (for example, N,N-diethylsulfamoyl, N-ethyl-N-(2-dodecyloxyethyl)sulfamoyl, N-[3-(2,4-di-tert-pentylphenoxy)propyl]sulfamoyl), an alkylthio group (for example, ethylthio, dodecylthio, octadecylthio, 3-(2,4-di-tert-phenoxy)propylthio) or a sulfonyl group (for example, methanesulfonyl, tetradecanesulfonyl, iso-octadecanesulfonyl, benzenesulfonyl).

$R_7$ represents an alkyl group, an alkoxy group, or an aryloxy group. When described in more detail, $R_7$ represents an alkyl group which preferably has from 1 to 22 carbon atoms (for example, methyl, ethyl, n-hexyl, n-dodecyl, tert-butyl, 1,1,3,3-tetramethylbutyl, 2-(2,4-di-tert-amylphenoxy)ethyl), an alkoxy group which preferably has form 1 to 22 carbon atoms (for example, methoxy, ethoxy, n-butoxy, n-octyloxy, 2-ethylhexyloxy, 2-ethoxyethoxy, 2-dodecyloxyethoxy, 2-methanesulfonylethoxy, 2-methanesulfonamidoethyl, 3-(N-2-hydroxyethylsulfamoyl)propoxy, 2-(N-methoxyethylcarbonyl)propoxy), preferably, an aryloxy group which has from 6 to 32 carbon atoms (for example, phenoxy, 4-chlorophenoxy, 2,4-dichlorophenoxy, 4-methoxyphenoxy, 4-dodecyloxyphenoxy, 3,4-methylenedioxyphenoxy) or aliphatic (inclusive of alicyclic) or aromatic acylamino group (for example, pivaloylamino, benzoylamino group). $R_8$ represents a hydrogen atom, a halogen atom (for example, fluorine chlorine, bromine), a hydroxyl group, an alkyl group, an alkoxy group or an aryl group, and the alkyl group or alkoxy group is preferably an alkoxy group or an alkyl group which has from 1 to 22 carbon atoms, the same as described in connection with $R_7$. $R_8$ preferably represents an aryl group which preferably has from 6 to 32 carbon atoms (for example, phenyl, 2,4-dichlorophenyl, 4-methoxyphenyl, 4-dodecyloxyphenyl, 2,4-di-tert-amylphenyl group, 4-tert-octylphenyl group, 4-(2-ethylhexaneamido)phenyl group).

When described in more detail, $R_9$ represents an amino group (this being an unsubstituted or substituted amino group, namely an N-alkylamino, N,N-dialkylamino, N-anilino, N-alkyl-N-arylamino, or heterocyclic amino group, (for example, N-butylamino, N,N-diethylamino, N-[2-(2,4-di-tert-amylphenoxy)ethyl]amino, N,N-dibutylamino, N-piperidino, N,N-bis-(2-dodecyloxyethyl)amino, N-cyclohexylamino, N,N-dihexylamino, N-phenylamino, 2,4-di-tert-amylphenylamino, N-(2-chloro-5-tetradecanamidophenyl-)amino, N-methyl-N-phenylamino, N-(2-pyridyl-)amino), an acylamino group (for example, acetamido, benzamido, tetradecanamido, (2,4-di-tert-amylphenoxy)acetadmido, 2-chlorobenzamido, 3-pentadecylbenzamido, 2-(2-methanesulfonamidophenoxy)-dodecanamido, 2-(2-chlorophenoxy)tetradecanamido), a ureido group (for example, methylureido, phenylureido, 4-cyanophenylureido), an alkoxycarbonylamino group (for example, methoxycarbonylamino, dodecyloxycarbonylamino, 2-ethylhexyloxycarbonylamino), an imido group (for example, N-succinimido, N-phthalimido, N-hydantoinyl, 5,5-dimethyl-2,4-dioxo-oxazol-3-yl, N-(3-octadecenyl)succinimido) a sulfonamido group (for example, methanesulfonamido, octanesulfonamido, benzenesulfonamido, 4-chlorobenzenesulfonamido, 4-dodecylbenzenesulfonamido, N-methyl-N-benzenesulfonamido, 4-dodecyloxybenzenesulfonamido, hexadecanesulfonamido), a sulfamoylamino group (for example, N-octylsulfamoylamino, N,N-dipropylsulfamoylamino, N-ethyl-N-phenyl-sulfamoylamino, N-(4-butyloxy)sulfamoylamino), an alkoxycarbonyl group (for example, methoxycarbonyl, butoxycarbonyl, dodecyloxycarbonyl, benzyloxycarbonyl), a carbamoyl group (for example, N-octylcarbamoyl, N,N-dibutylcarbamoyl, N-phenylcarbamoyl, N-[3-(2,4-di-tert-amylphenoxy)-propyl]-carbamoyl, an acyl group (for example, acetyl, benzoyl, hexanoyl, 2-ethylhexanoyl, 2-chlorobenzoyl), a cyano group, or an alkylthio group (for example, dodecylthio, 2-ethylhexylthio, benzylthio, 2-oxocyclohexylthio, 2-(ethyltetradecanoato)thio, 2-(dodecylhexanoato)thio, 3-phenyloxypropylthio, 2-dodecanesulfonylethylthio).

Those of the compounds represented by the general formula (Cp-II) in which $R_4$ represents a hydrogen atom, $R_5$ represents a halogen atom, $R_7$ represents an alkoxy group which has from 1 to 22 carbon atoms, $m_1$ and $m_2$ represent 1 and $m_3$ represents 0 are especially desirable compounds.

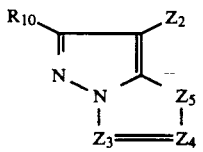

(Cp-III)

The substituent groups in the general formula (Cp-III) are described in detail below.

$R_{10}$ represents a hydrogen atom, a halogen atom, an alkyl group, an aryl group, a heterocyclic group, a cyano group, an alkoxy group, an aryloxy group, a heterocyclic group containing an oxygen atom in the ring, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group or an aryloxycarbonyl group.

These substituent groups are described in more detail below. Thus $R_{10}$ represents a hydrogen atom, a halogen atom (for example, chlorine, bormine), an alkyl group (for example, methyl, propyl, iso-propyl, t-butyl, trifluoromethyl, tridecyl, 3-(2,4-di-tert-amylphenoxy)propyl, allyl, 2-dodecyloxyethyl, 3-phenoxypropyl, 2-hexylsulfonylethyl, 3-(2-butoxy-5-tert-hexylphenylsulfonyl)propyl, cyclopentyl, benzyl), an aryl group (for example, phenyl, 4-tert-butylphenyl, 2,4-di-tert-amylphenyl, 4-tetradecanamidophenyl), a heterocyclic group (for example, 2-furyl, 2-thienyl, 2-pyrimidinyl, 2-benzothiazolyl), a cyano group, an alkoxy group (for example, methoxy, ethoxy, 2-methoxyethoxy, 2-dodecyloxyethoxy, 2-phenoxyethoxy, 2-methanesulfonylethoxy), an aryloxy group (for example, phenoxy, 2-methophenoxy, 2-methoxyphenoxy, 4-tert-butylphenoxy), a heterocyclic oxy group (for example, 2-benzimidazolyloxy), an acyloxy group (for example, acetoxy, hexadecanoyloxy), a carbamoyloxy group (for example, N-phenylcarbamoyloxy, N-ethylcarbamoyloxy), a silyloxy group (for example, trimethylsilyloxy), a sulfonyloxy group (for example, dodecylsulfonyloxy), an acylamino group (for example, acetamido, benzamido, tetradecanamido, α-(2,4-di-tertamylphenoxy)-butylamido, γ-(3-tert-butyl-4-hydroxyphenoxy)-butylamido, α-[4-(4-hydroxyphenylsulfonyl)phenoxy]-decanamido), an anilino group (for example, phenylamino, 2-chloroanilino, 2-chloro-5-tetradecanamidoanilino, 2-chloro-5-dodecyloxycarbonylanilino, N-acetylanilino, 2-chloro-5-[α-(3-tert-butyl-4-hydroxyphenoxy) dodecanamido]anilino), a ureido group (for example, phenylureido, methylureido, N,N-dibutylureido), an imido group (for example, N-succinimido, 3-benzylhydantoinyl, 4-(2-ethylhexanoylamino)phthalimido), a sulfamoylamino group (for example, N,N-dipropylsulfamoylamino, N-methyl-N-decylsulfamoylamino), an alkylthio group (for example, methylthio, octylthio, tetradecylthio, 2-phenoxyethylthio, 3-phenoxypropylthio, 3-(4-tert-butylphenoxy)propylthio), an arylthio group (for example, phenylthio, 2-butoxy-5-tert-oxtylphenylthio, 3-pentadecylphenylthio, 2-carboxyphenylthio, 4-tetradecanamidophenylthio), a heterocyclic thio group (for example, 2-benzothiazolyl), an alkoxycarbonylamino group (for example, methoxycarbonylamino, tetradecyloxycarbonylamino), an aryloxycarbonylamino group (for example, phenoxycarbonylamino, 2,4-di-tert-butylphenoxycarbonylamino), a sulfonamido group (for example, methanesulfonamido, hexadecanesulfonamido, benzenesulfonamido, p-toluenesulfonamido, octadecanesulfonamido, 2-methyloxy-5-tert-butylbenzenesulfonamido), a carbamoyl group (for example, N-ethylcarbamoyl, N,N-dibutylcarbamoyl, N-(2-dodecyloxyethyl)carbamoyl, N-methyl-N-dodecylcarbamoyl, N-[3-(2,4-di-tert-amylphenoxy) propyl]carbamoyl), an acyl group (for example, acetyl, (2,4-di-tert-amylphenoxy)acetyl, benzoyl), a sulfamoyl group (for example, N-ethylsulfamoyl, N,N-dipropylsulfamoyl, N-(2-dodecyloxyethyl)sulfamoyl, N-ethyl-N-dodecylsulfamoyl, N,N-diethylsulfamoyl), a sulfonyl group (for example, methanesulfonyl octanesulfonyl, benzenesulfonyl, toluenesulfonyl, 2-butoxy-5-tert-octylphenylsulfonyl), a sulfinyl group (for example, octanesulfinyl, dodecylsulfinyl, phenylsulfinyl), an alkoxycarbonyl group (for example, methoxycarbonyl, butyloxy carbonyl, dodecyloxycarbonyl, octadecyloxycarbonyl), or an aryloxycarbonyl group (for example, phenyloxycarbonyl, 3-pentadecyloxycarbonyl (sic)).

$Z_2$ in the formula (Cp-III) represents a hydrogen atom or a group which can be eliminated in a reaction with the oxidized form of a primary aromatic amine color developing agent. Groups which can be eliminated are described in more detail below as $Z_6$. Thus, $Z_2$ may be a halogen atom (for example, fluorine, chlorine, bromine, etc), an alkoxy group (for example, dodecyloxy, dodecyloxycarbonylmethoxy, methoxycarbamoylmethoxy, carboxypropyloxy, methanesulfonylethoxy, etc.), an aryloxy group (for example, 4-methoxyphenoxy, 4-tert-butylphenoxy, 4-methoxyphenoxy, 4-methanesulfonylphenoxy, 4-(4-benzyloxyphenylsulfonyl)phenoxy, etc.) an acyloxy group (for example, acetoxy, tetradecanoyloxy, benzoyloxy), a sulfonyloxy group (for example, methanesulfonyloxy, toluenesulfonyloxy, etc.), an amido group (for example, dichloroacetylamino, methanesulfonylamino, etc.), an alkoxycarbonyloxy group (for example, ethoxycarbonyloxy, benzyloxycarbonyloxy), an aryloxycarbonyloxy group (for example, phenoxycarbonyloxy), an aliphatic or aromatic thio group (for example, phenylthio, dodecylthio, benzylthio, 2-butoxy-5-tert-octylphenylthio, 2,5-di-octyloxyphenylthio, 2-(2-ethoxyethoxy)-5-tert-octylphenylthio, tetrazolylthio), an imido group (for example, succinimido, hydantoinyl, 2,4-dioxo-oxazolidin-3-yl, 3-benzyl-4-ethoxyhydantoin-1-yl), an N-heterocyclic group (for example, 1-pyrazolyl, 1-benzotriazolyl, 5-chloro-1,2,4-triazol-1-yl) or an aromatic azo group (for example, phenylazo) etc. These leaving groups may contain photographically useful groups.

$Z_3$, $Z_4$ and $Z_5$ each represents a methine group, a substituted methine group, an imino group or a substituted imino group. The groups and atoms listed for $R_{10}$ can be used as the substituent groups in this case.

Dimers or larger oligomers can be formed via $R_{10}$, $Z_3$, $Z_4$ or $Z_5$ in general formula (Cp-III).

Those of the compounds which can be represented by the general formula (Cp-III) which can also be represented by the general formula (Cp-IV) or (Cp-V) are especially desirable.

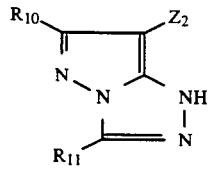

(Cp-IV)

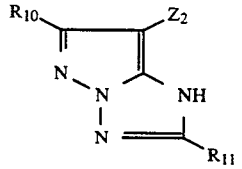

(Cp-V)

(In these formulae, $R_{10}$ and $Z_2$ have the same significance and $R_{11}$ has the same significance as $R_{10}$. The groups $R_{10}$ and $R_{11}$ may be the same or different.) Of the general formulae (Cp-IV) and (Cp-V), general formula (Cp-V) is the more desirable. The oil protected type acrylacetamide based couplers are typical of the yellow couplers which can be used in the invention. Actual examples have been disclosed in U.S. Pat. Nos. 2,407,210, 2,875,057 and 3,265,506, etc. The use of two-equivalent yellow couplers is preferred in this invention, and typical examples include the yellow couplers of the oxygen atom elimination type disclosed, for example, in U.S. Pat. Nos. 3,408,194, 3,447,928, 3,933,501 and 4,022,620, etc. and the nitrogen atom elimination type yellow couplers disclosed in JP-B-58-10739 in U.S. Pat. No. 4,401,752 and 4,326,024, in *Research Disclosure* 18053 (April 1979), in British Patent 1,425,020, and in West German Patent Application Laid Open (OLS) Nos. 2,219,917, 2,261,361, 2,329,587 and 2,433,812, etc. and, of these, the use of the latter type is preferred. The α-pivaloylacetanilide based couplers are excellent in terms of fastness, especially light fastness, of the colored dye, while the α-benzoylacetanilide based couplers provide high color densities.

The most desirable yellow couplers for use in the invention are those which can be represented by the general formula (Cp-VI) indicated below.

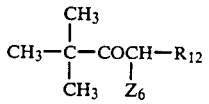

(CP-VI)

In this formula, $R_{12}$ represents a substituted or unsubstituted N-phenylcarbamoyl group and $Z_6$ represents a group which can be eliminated in a reaction with the oxidized form of a primary aromatic amine developing agent.

The substituent groups on the phenyl group of the N-phenylcarbamoyl group of $R_{12}$ in the general formula (Cp-VI) are aliphatic groups (for example, methyl, allyl, cyclopentyl), heterocyclic groups (for example, 2-pyridyl, 2-imidazolyl, 2-furyl, 6-quinolyl), aliphatic oxy groups (for example, methoxy, 2-methoxyethoxy, 2-propenyloxy), aromatic oxy groups (for example, 2,4-di-tert-amylphenoxy, 4-cyanophenoxy, 2-chlorophenoxy), acyl groups (for example, acetyl, benzoyl), ester groups (for example, butoxycarbonyl, hexadecyloxycarbonyl, phenoxycarbonyl, dodecyloxycarbonyl, methoxycarbonyl, acetoxy, benzoyloxy, tetradecyloxysulfonyl, hexadecanesulfonyloxy, etc.), amido groups (for example, acetylamido, dodecanesulfonamido, α-(2,4-di-tert-pentylphenoxy)butanamido, γ-(2,4-di-tert-pentylphenoxy)butanamido, N-tetradecylcarbamoyl, N,N-dihexylcarbamoyl, N-butanesulfamoyl, N-methyl-N-tetradecanesulfamoyl), imido groups (for example, succinimido, N-hydantoinyl, 3-hexadecenylsuccinimido), ureido groups (for example, phenylureido, N,N-dimethylureido, N-(3-(2,4-di-tert-pentylphenoxy)propyl-)ureido, aliphatic or aromatic sulfonyl groups (for example, methanesulfonyl, phenylsulfonyl, dodecanesulfonyl, 2-butoxy-5-tert-octylbenzenesulfonyl), aliphatic or aromatic thio groups (for example, phenylthio, ethylthio, hexadecylthio, 4-(2,4-di-tert-phenoxyacetamido) benzylthio), a hydroxyl group, a sulfonic acid group, or halogen atoms (for example, fluorine, chlorine, bromine), and in cases where there are two or more substituent groups then these may be the same or different groups.

$Z_6$ in general formula (Cp-VI) represents a coupling leaving group, and examples of such groups include halogen atoms (for example, fluorine, chlorine bromine, etc.), alkoxy groups (for example, dodecyloxy, dodecyloxycarbonylmethoxy, methoxycarbamoylmethoxy, carboxypropyloxy, methanesulfonylethoxy), aryloxy groups (for example, 4-methylphenoxy, 4-tert-butylphenoxy, 4-methoxyphenoxy, 4-methanesulfonylphenoxy, 4-(4-benzyl-oxyphenylsulfonyl)phenoxy, 4-(4-hydroxyphenylsulfonyl)phenoxy, 4-(4-hydroxyphenylsulfonyl)phenoxy, 4-methoxycarbonylphenoxy)

acyloxy groups (for example, acetoxy, tetradecanoyloxy, benzoyloxy), sulfonyloxy groups (for example, methanesulfonyloxy, toluenesulfonyloxy, etc.), amido groups (for example, dichloroacetylamino, methanesulfonylamino), alkoxycarbonyloxy groups (for example, ethoxycarbonyloxy, benzyloxycarbonyloxy), aryloxycarbonyloxy groups (for example, phenoxycarbonyloxy), aliphatic or aromatic thio groups (for example, phenylthio, dodecylthio, benzylthio, 2-butoxy-5-tert-octylphenylthio, 2,5-di-octyloxyphenylthio, 2-(2-ethoxy-ethoxy) -5-tert-octylphenylthio, tetraazolylthio), imido groups (for example, succinimido, hydantoinyl, 2,4-dioxo-oxazolidin-3-yl, 3-benzyl-4-ethoxyhydantoin-1-yl, 3-benzylhydantoin-1-yl, 1-benzyl-2-phenyl-3,5-dioxo-1,2,4-triazolidin-4-yl, 3-benzyl-4-ethoxyhydantoin-1yl), nitrogen atom containing heterocyclic groups (for example, 1-pyrazolyl, 1-benzotriazolyl, 5-chloro-1,2,4-triazol-1-yl) and aromatic azo groups (for example, phenylazo), etc. These leaving groups may contain photographically useful groups.

Dimers or larger oligomers can be formed via $R_{12}$, $Z_6$ in general formula (Cp-VI).

The above mentioned couplers used in the invention are normally included at a rate of from 0.01 to 2 mol, and preferably at a rate of from 0.1 to 1.0 mol, per mol of silver halide in the silver halide emulsion layer.

Preferred examples of the cyan couplers of this invention are indicated below, but the invention is not limited to these examples.

(C-1)

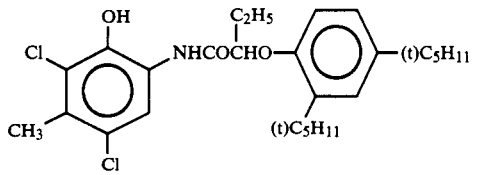

(C-2)

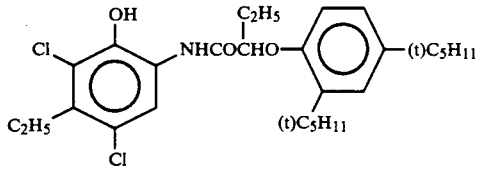

(C-3)

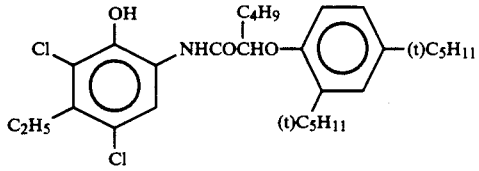

(C-4)

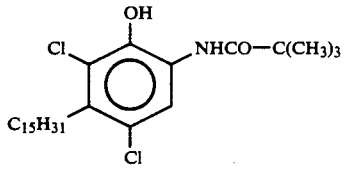

(C-5)

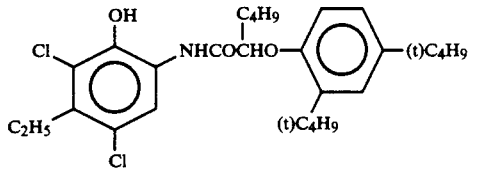

(C-6)

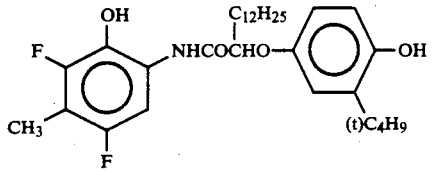

(C-7)

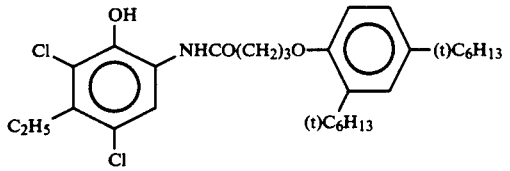

-continued
(C-8)
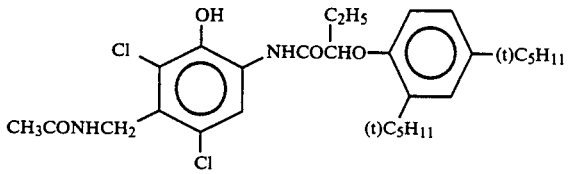
(C-9)
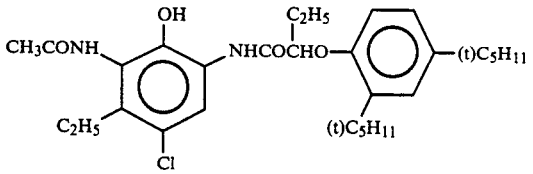
(C-10)
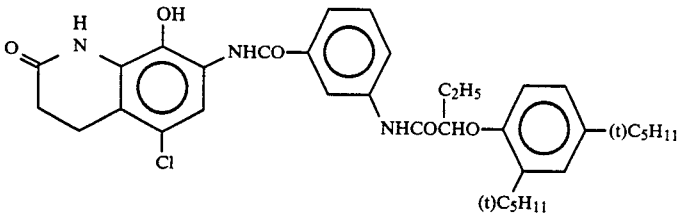
(C-11)
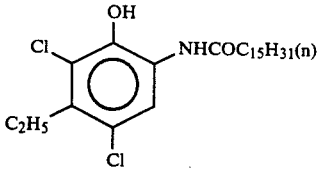
(C-12)
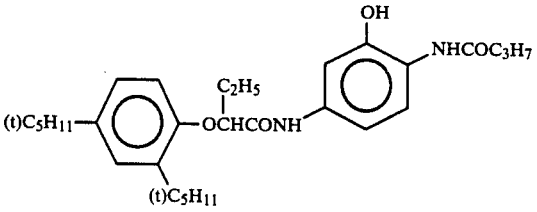
(C-13)
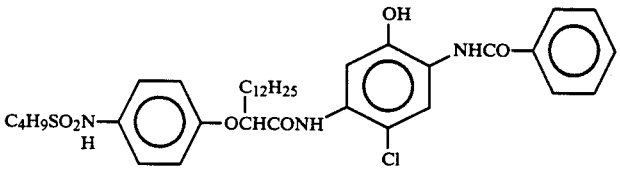
(C-14)
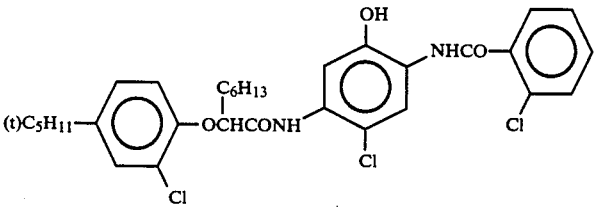
(C-15)
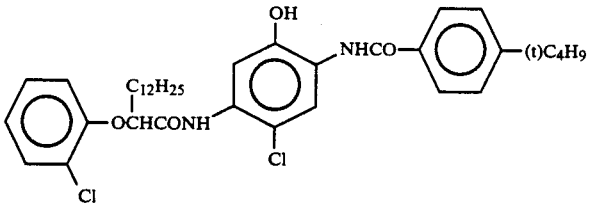

-continued
(C-16)
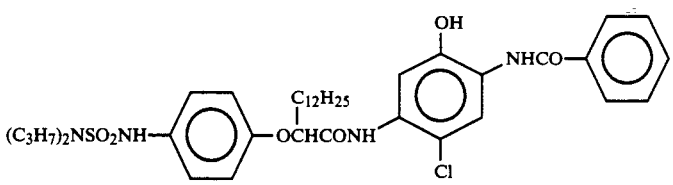
(C-17)
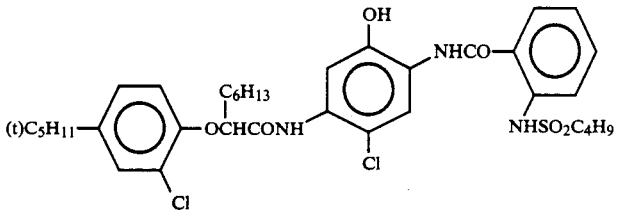
(C-18)
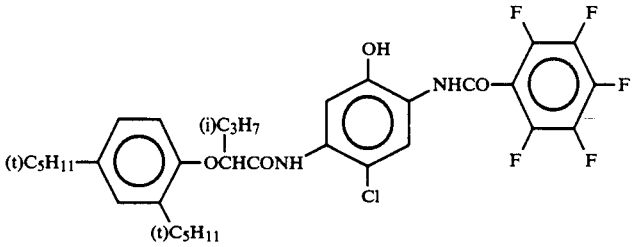
(C-19)
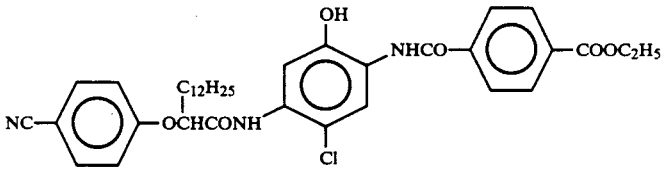
(C-20)
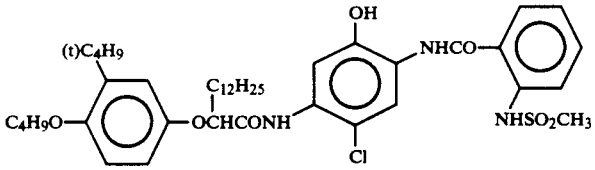
(C-21)
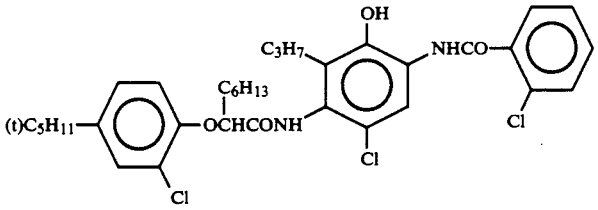
(C-22)
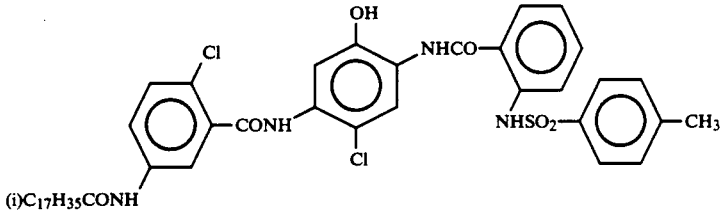

-continued
(C-23)
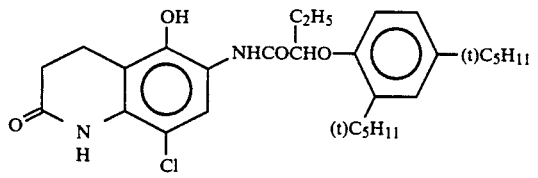
(C-24)
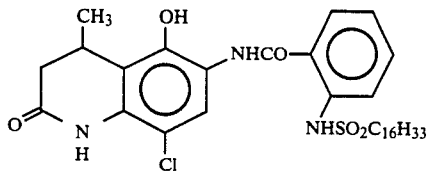
(C-25)
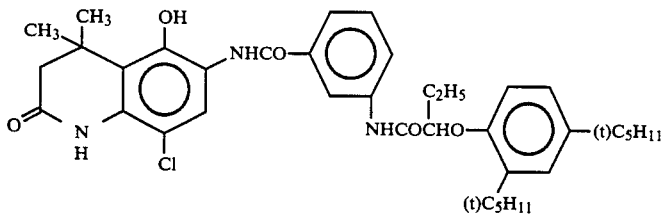
(C-26)
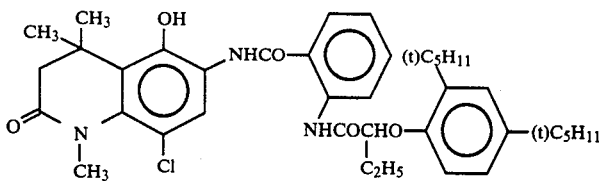
(C-27)
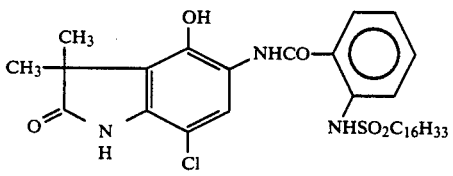
(C-28)
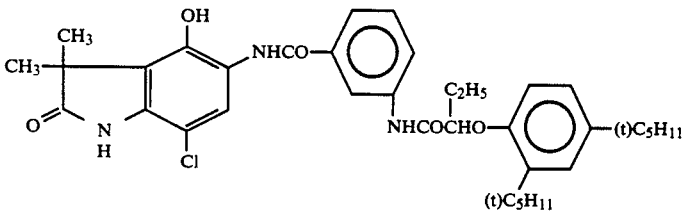
(C-29)
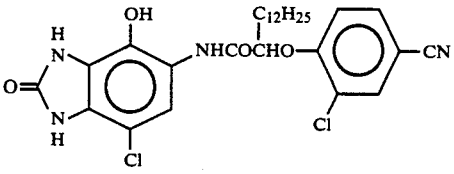
(C-30)
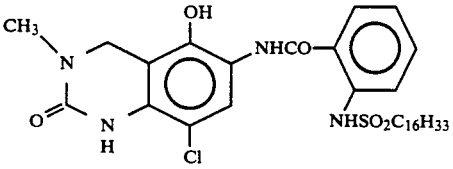

-continued
(C-31)
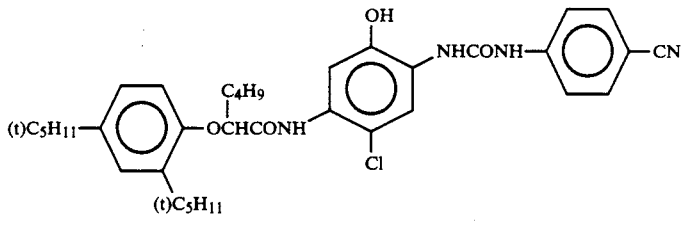
(C-32)
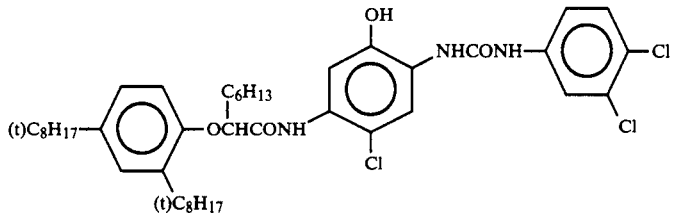
(C-33)
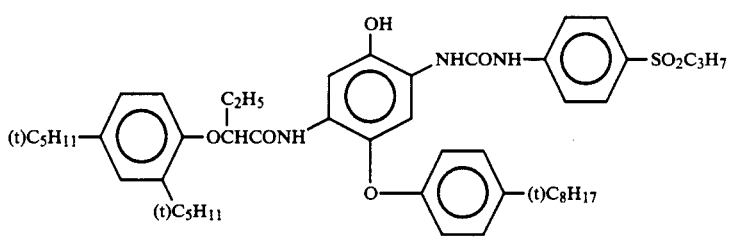
The ratios of x, y, and z indicated below are ratios by weight. Unless otherwise indicated, all ratios, parts, etc. are by weight.
(C-34)
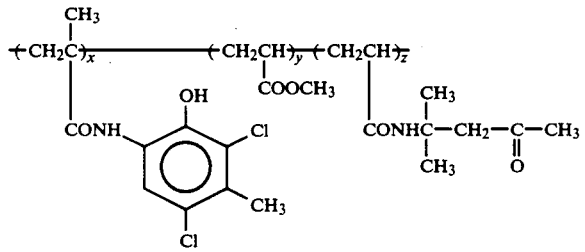
x/y/z = 50/20/30
(C-35)
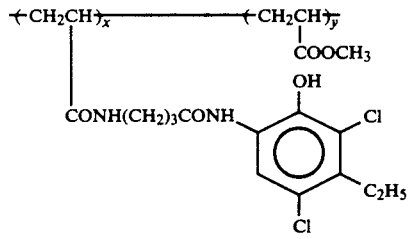
x/y = 55/45
(C-36)
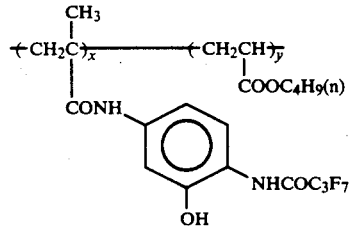
x/y = 60/40

-continued
(C-37)
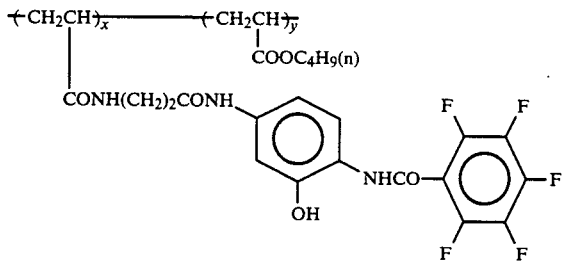
x/y = 50/50
(C-38)
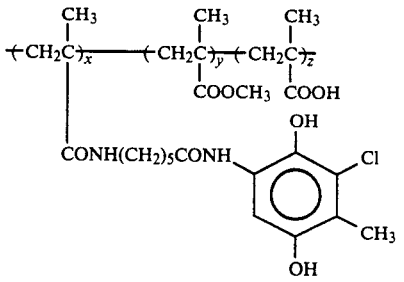
x/y/z = 55/40/5
(C-39)
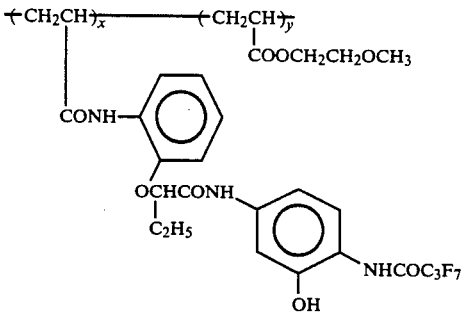
x/y = 60/40
(C-40)
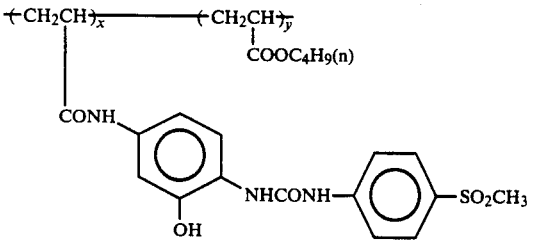
x/y = 50/50
(C-41)
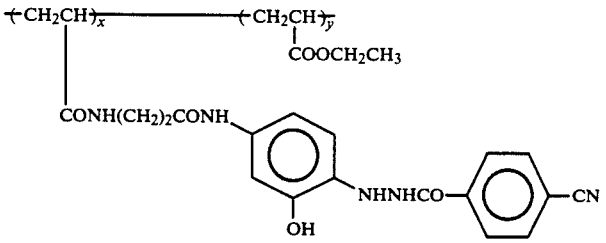
x/y = 45/55

-continued
(C-42)
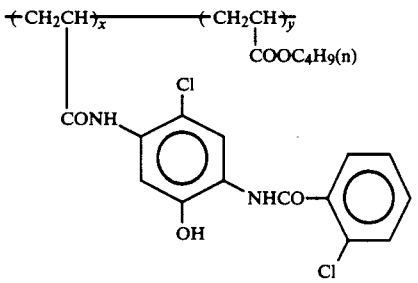
x/y = 50/50
(C-43)
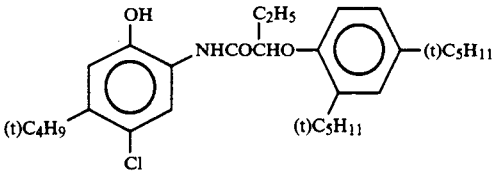
(C-44)
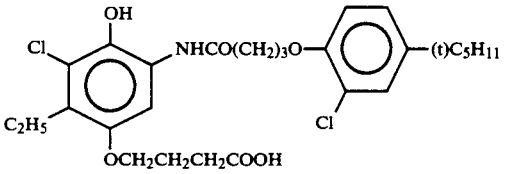
(C-45)
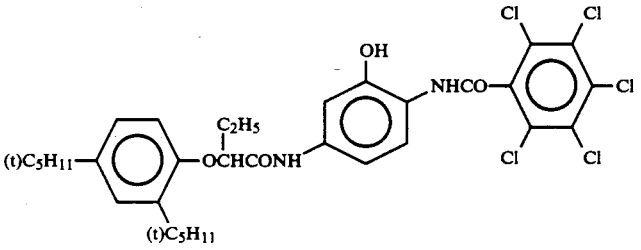
(C-46)
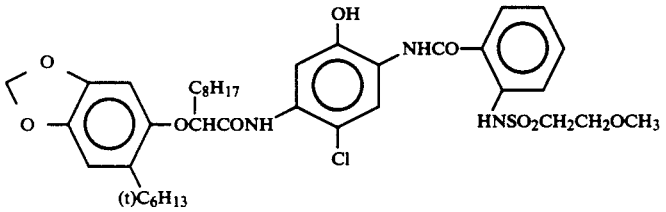
(C-47)
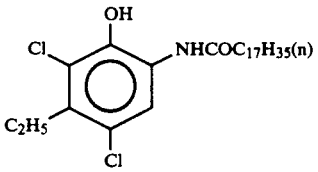
(C-48)
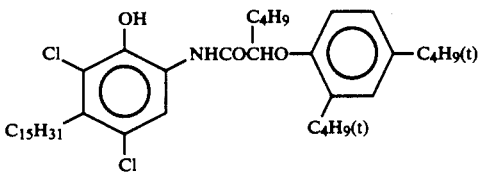

-continued
(C-49)
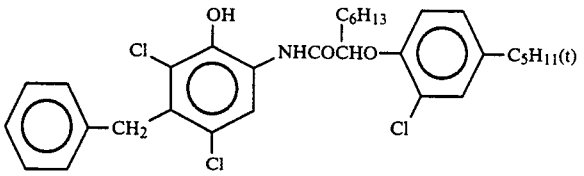
(C-50)
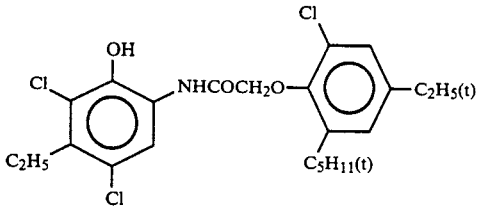
(C-51)
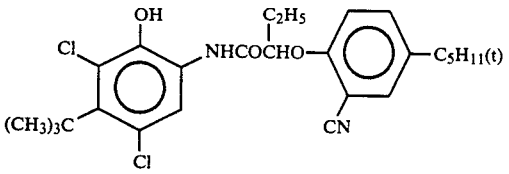
(C-52)
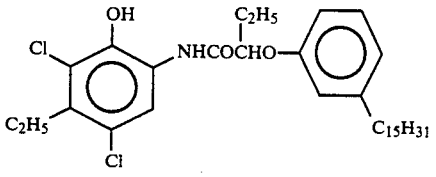
(C-53)
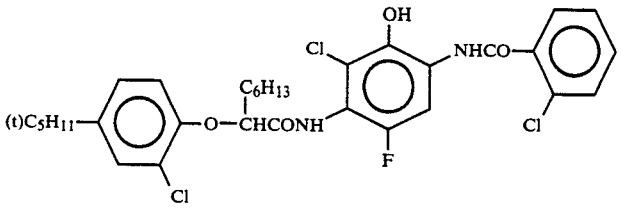
(C-54)
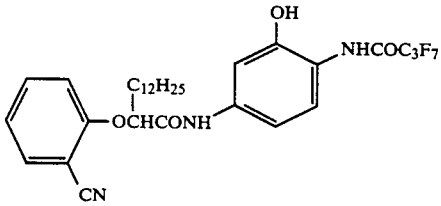
(C-55)
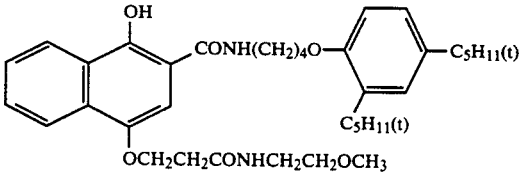
(C-56)
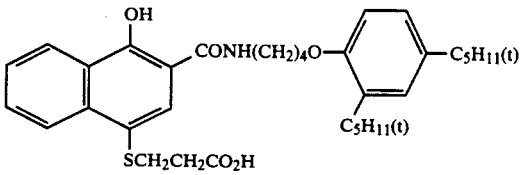

-continued
(C-57)
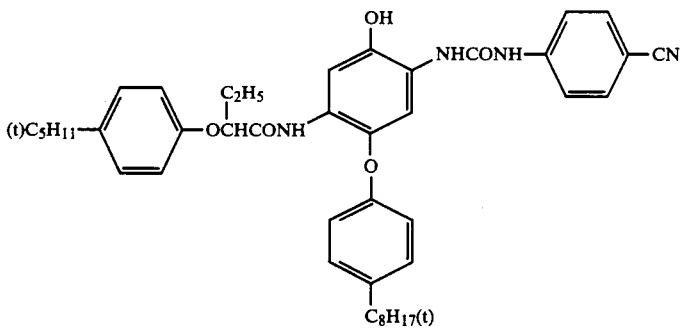
(C-58)
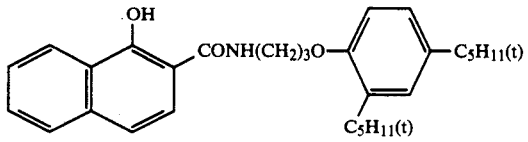
(C-59)
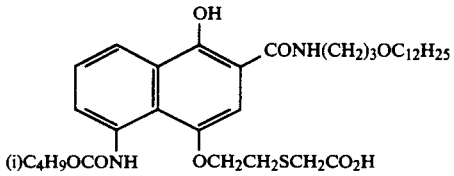
(C-60)
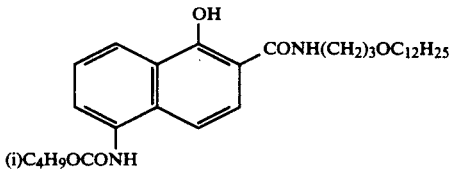
(C-61)
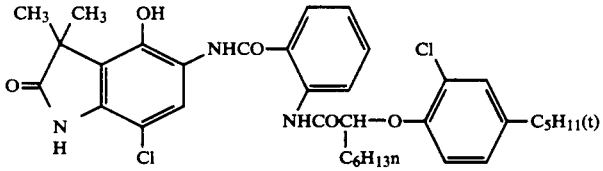
(C-62)
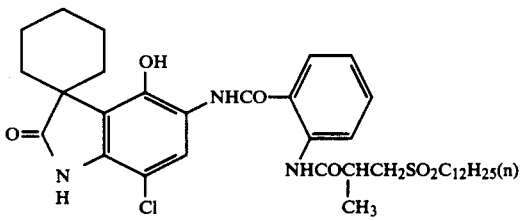
(C-63)
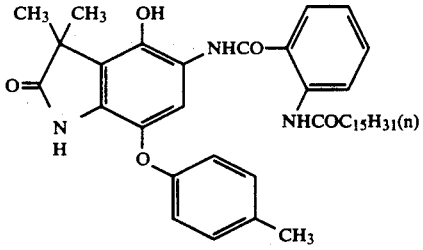

-continued
(C-64)
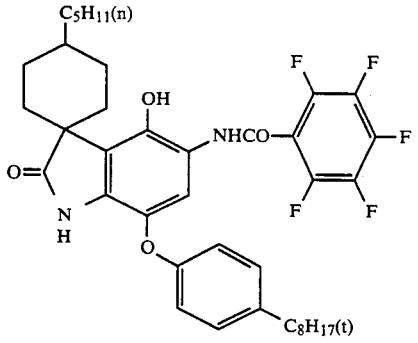
(C-65)
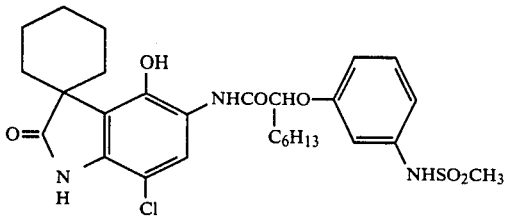
(C-66)
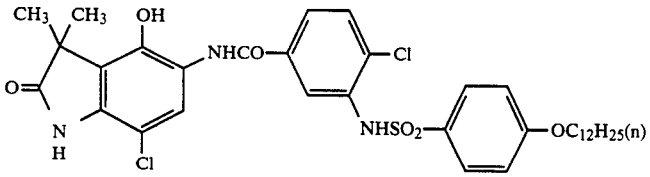
Furthermore, oil soluble magenta and yellow couplers which can be used in the invention are indicated below, but it is understood that the invention is not limited to just these examples.
(M-1)
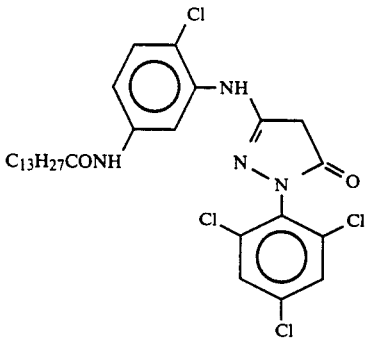
(M-2)
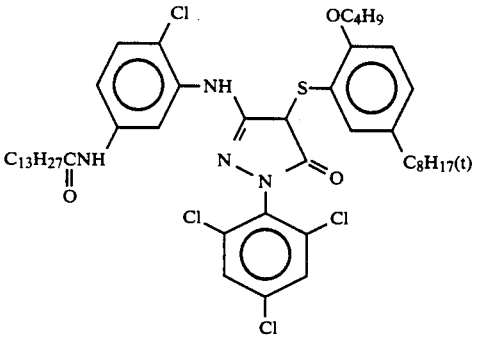

-continued
(M-3)
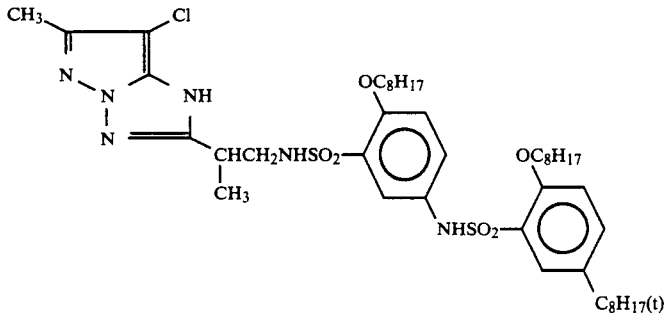
(M-4)
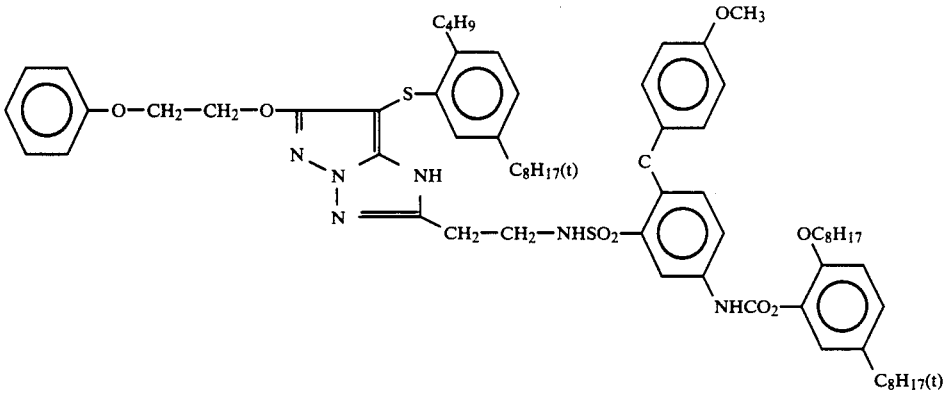
(M-5)
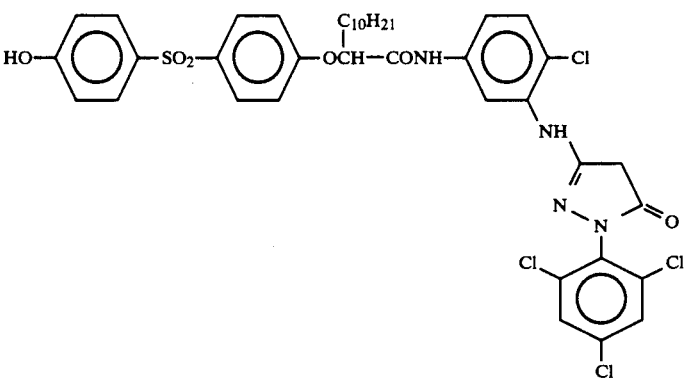
(M-6)
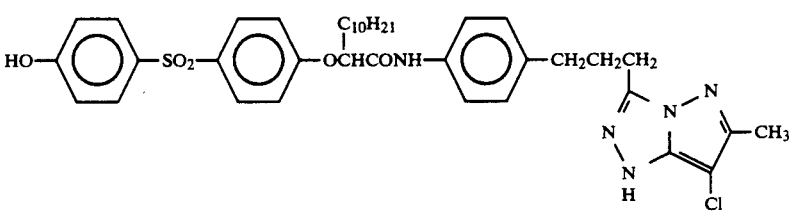
(M-7)
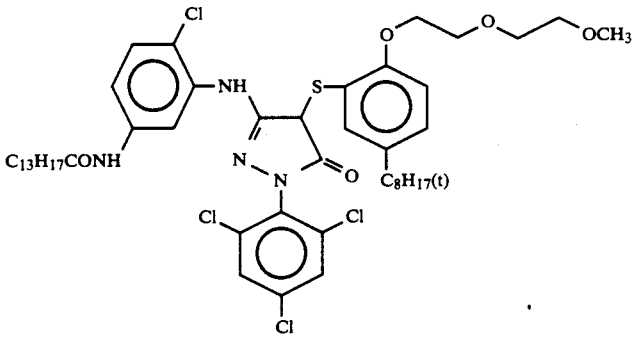

-continued
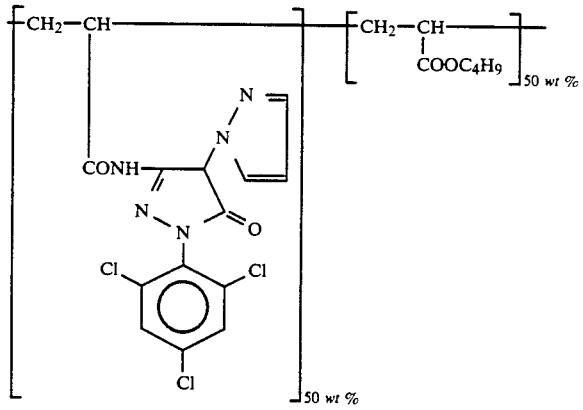
(M-8)
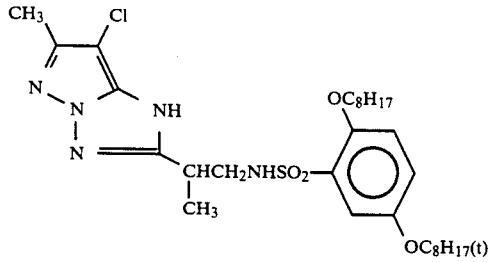
(M-9)
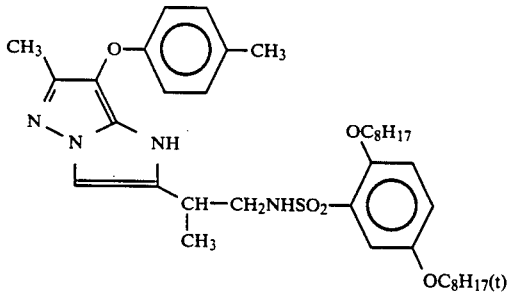
(M-10)
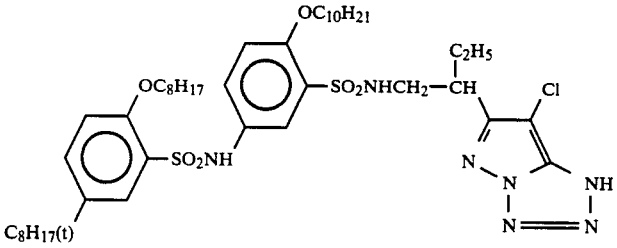
(M-11)
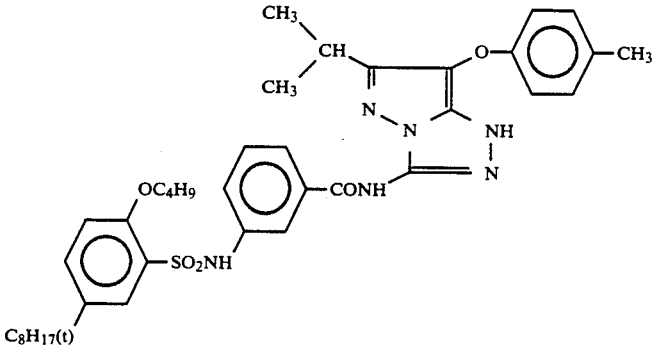
(M-12)

-continued
(M-13)
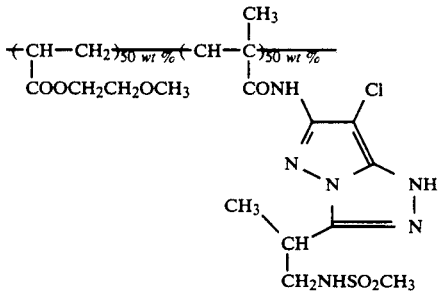
(M-14)
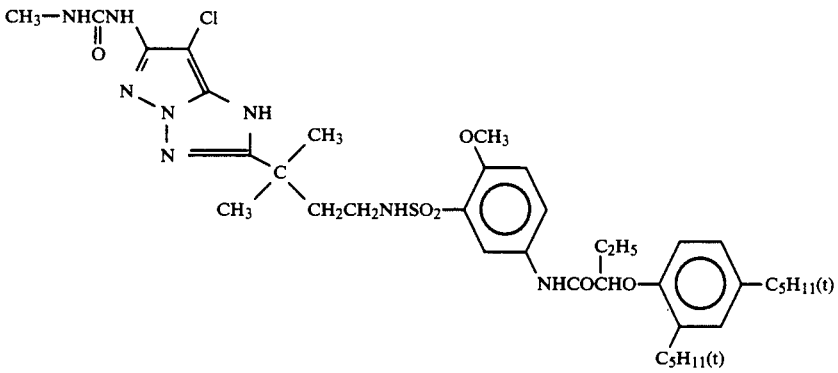
(M-15)
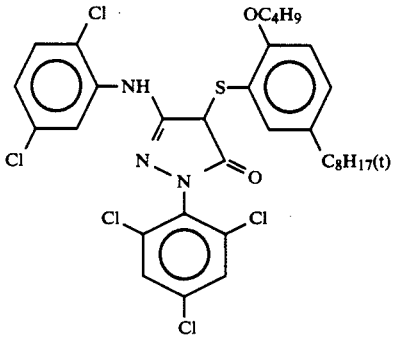
(M-16)
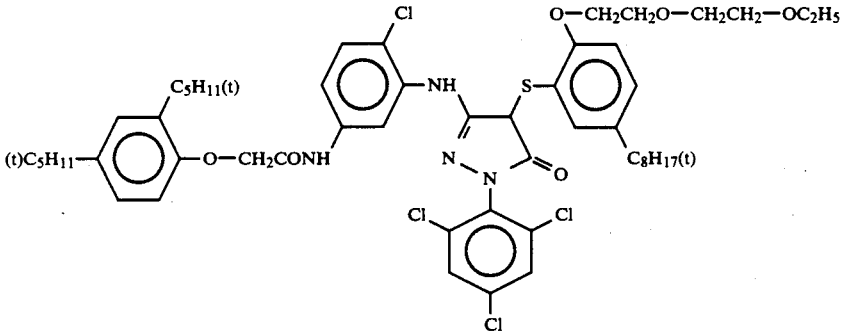

-continued
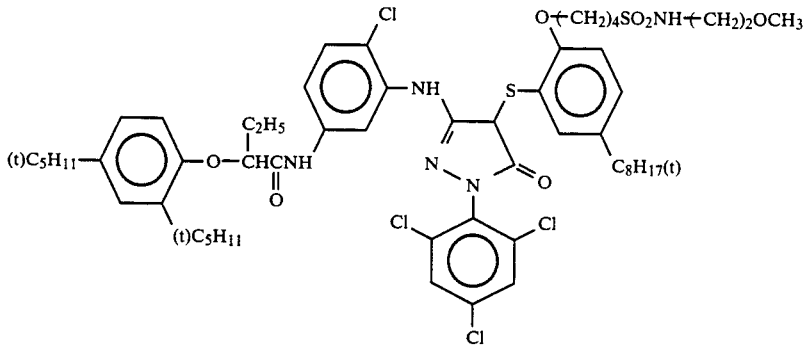
(M-17)
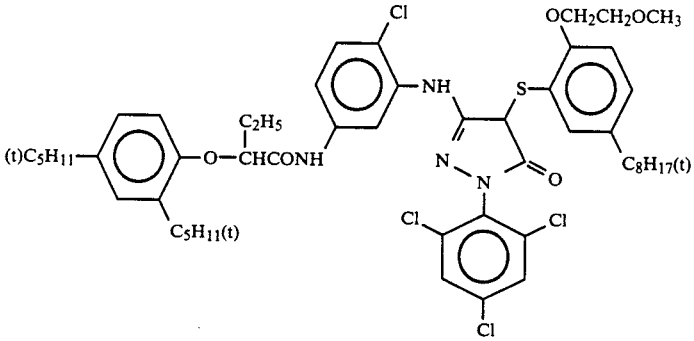
(M-18)
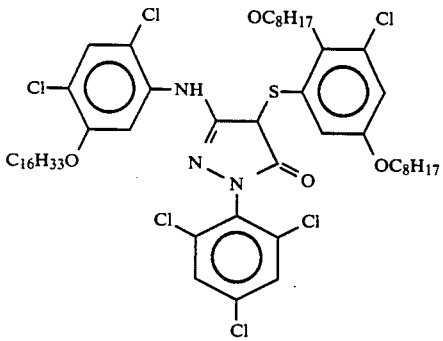
(M-19)
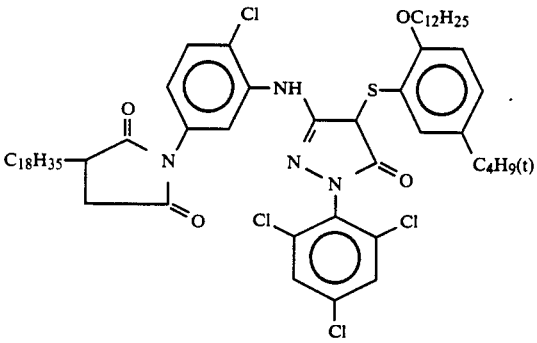
(M-20)

-continued
(M-21)
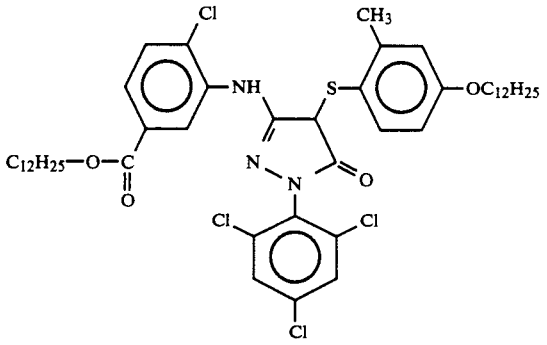
(M-22)
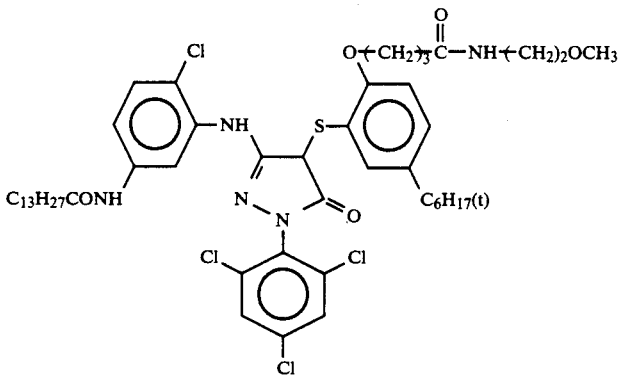
(M-23)
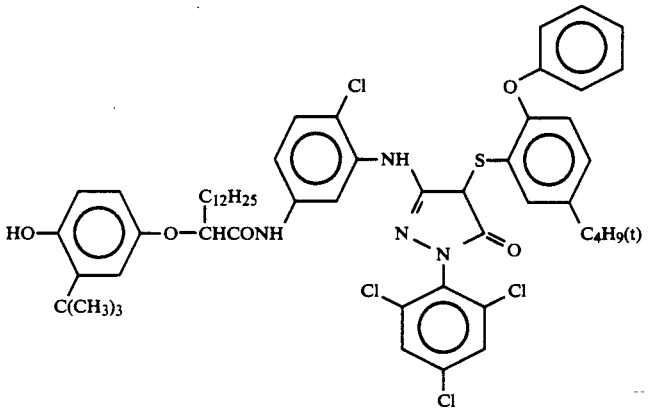
(M-24)
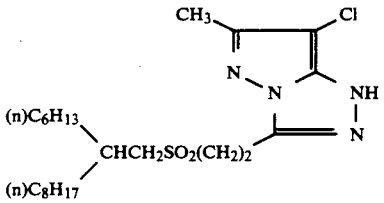
(M-25)
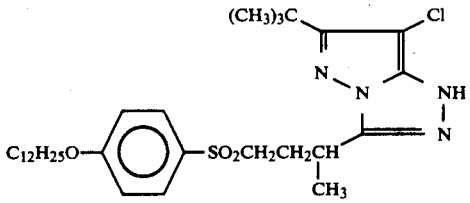

-continued
(M-26)
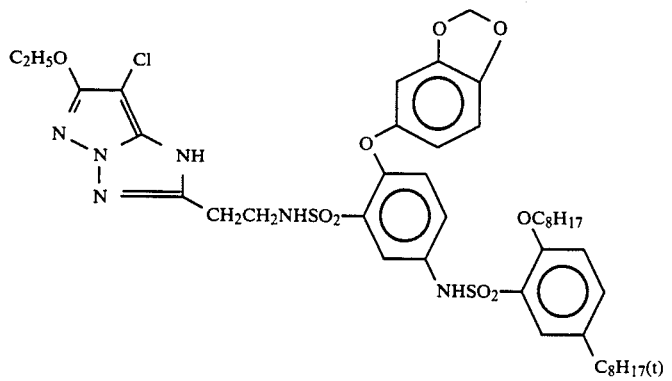
(M-27)
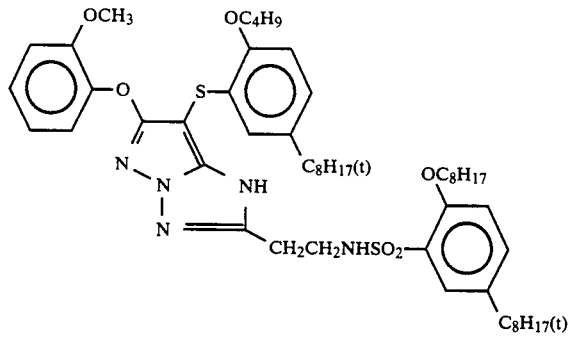
(M-28)
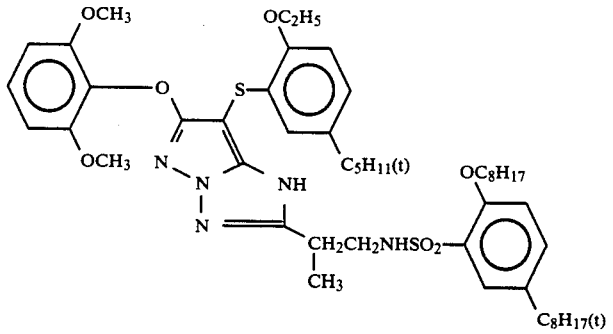
(M-29)
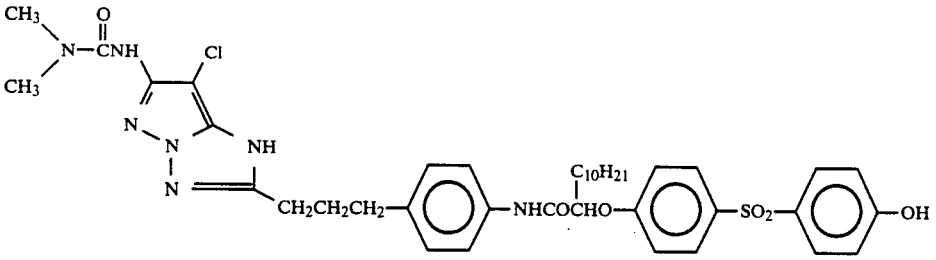
(M-30)
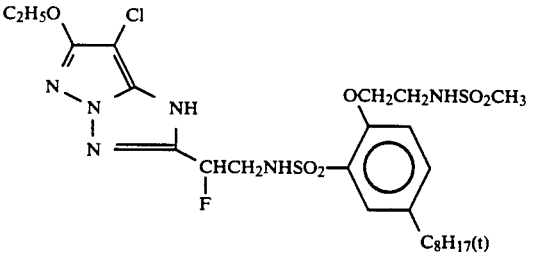

-continued
(M-31)
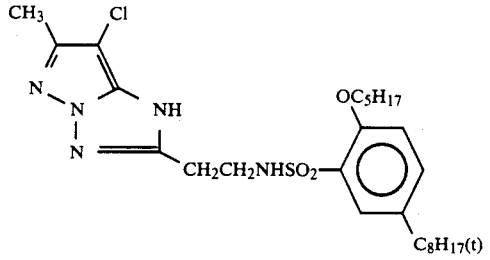
(M-32)
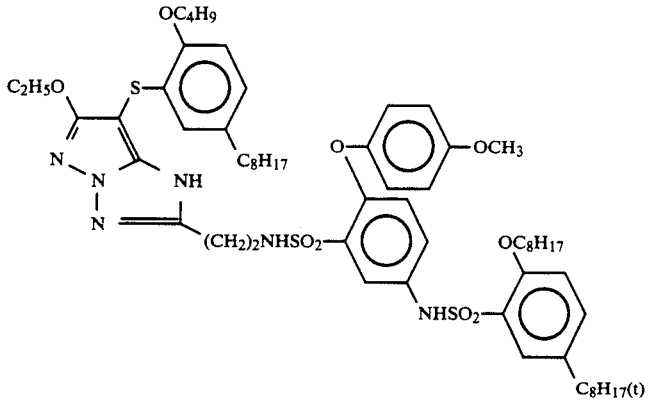
(M-33)
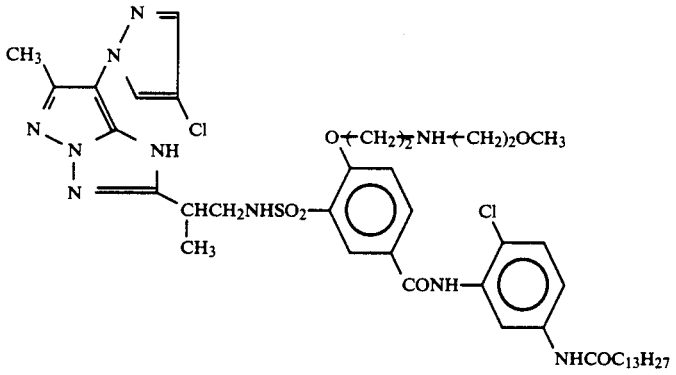
(M-34)
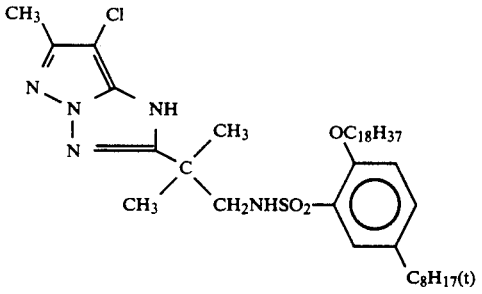
(M-35)
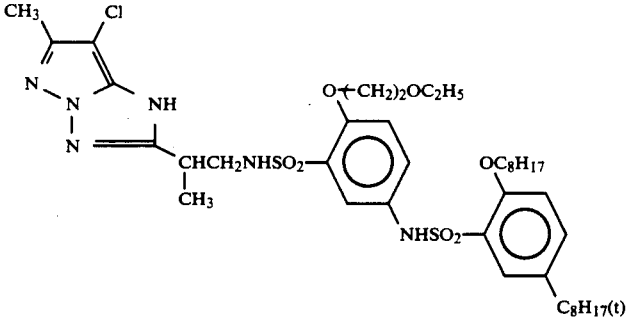

-continued
(M-36)
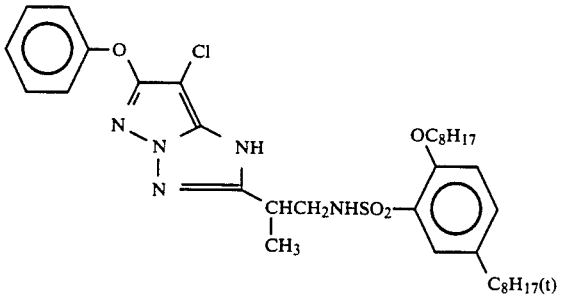
(M-37)
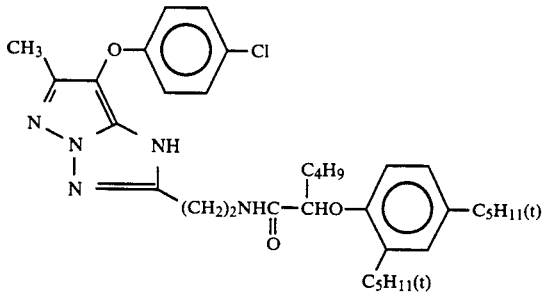
(M-38)
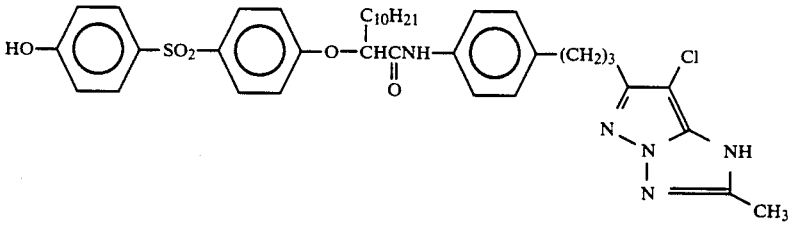
(M-39)
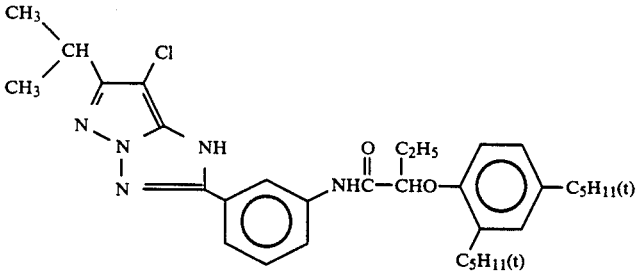
(M-40)
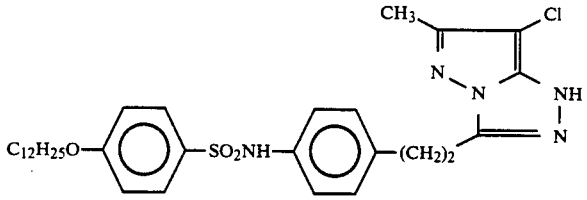
(M-41)
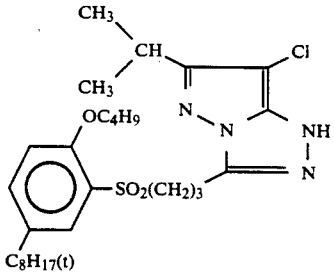

-continued
(M-42)
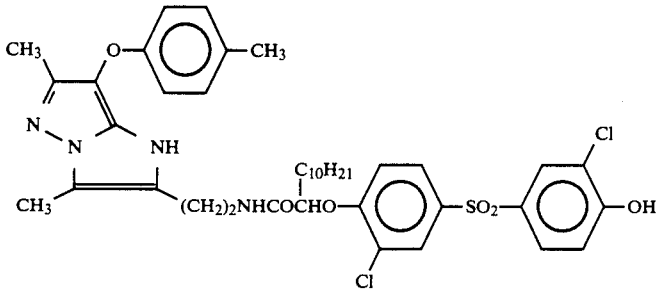
(M-43)
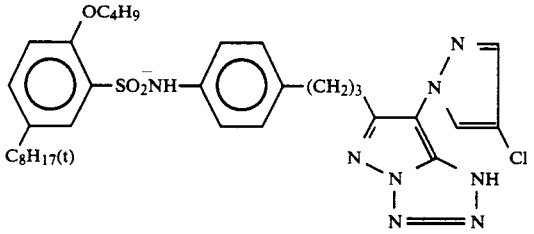
(M-44)
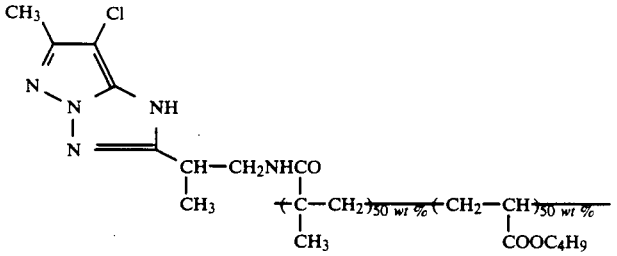
(M-45)
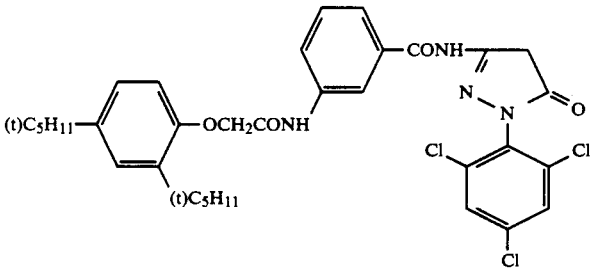
(M-46)
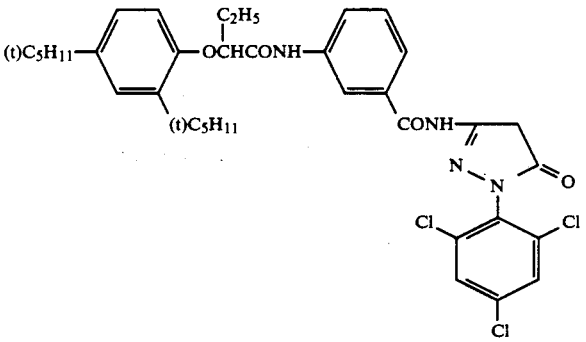

-continued
(M-47)
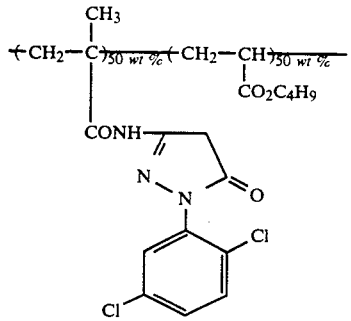
(M-47A)
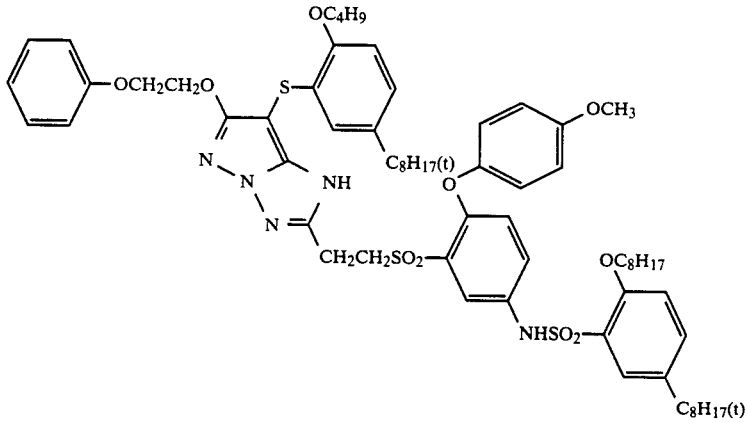
(M-48)
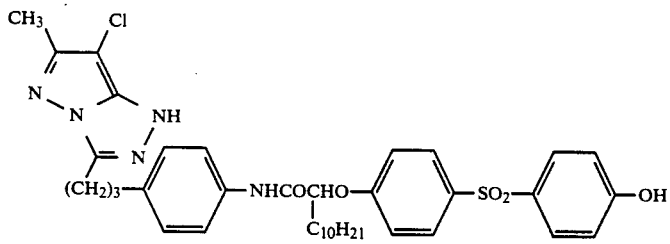
(M-49)
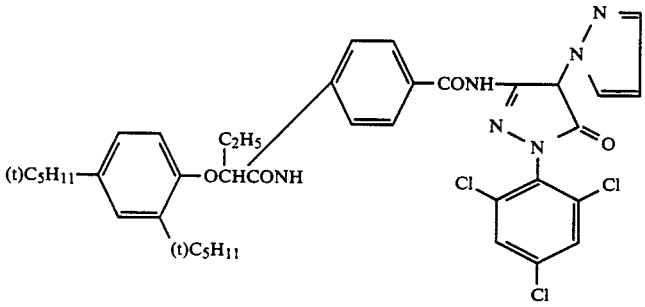
(M-50)
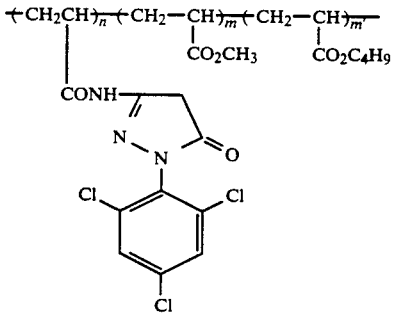
n:m:m' = 2:1:1 (by weight)
Molecular weight about 40,000

-continued
(M-51)
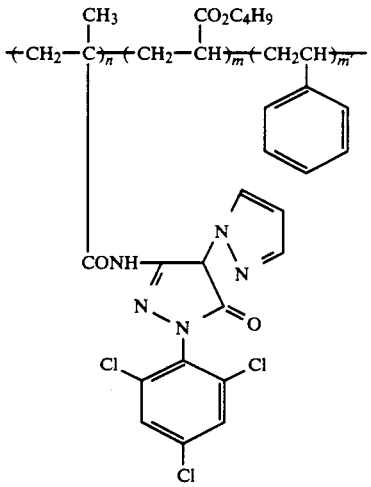
n/m/m' = 50/25/25 (wt. %)
Molecular weight about 30,000
(M-52)
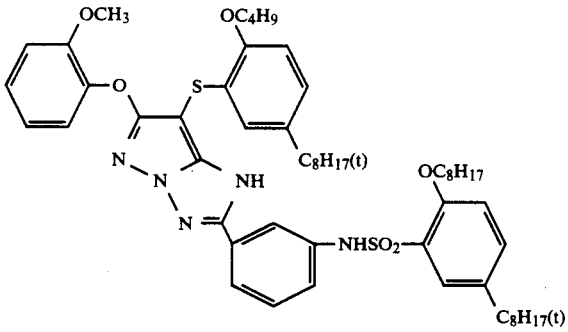
(M-53)
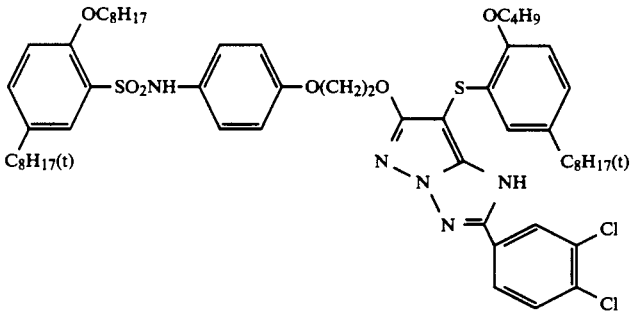
(M-54)
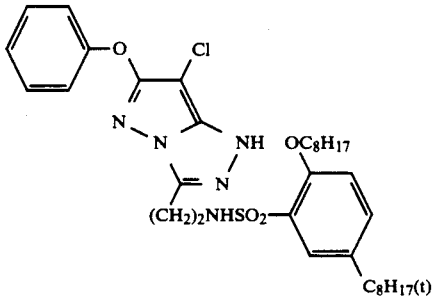

-continued
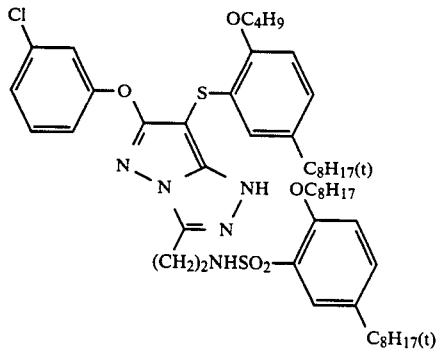
(M-55)
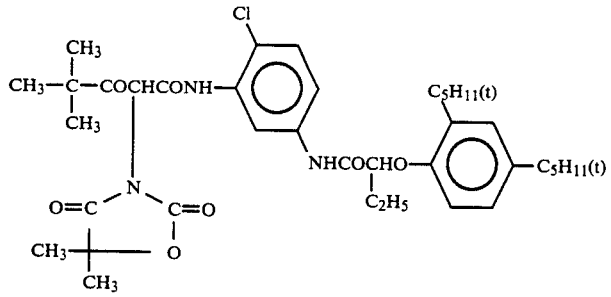
(Y-1)
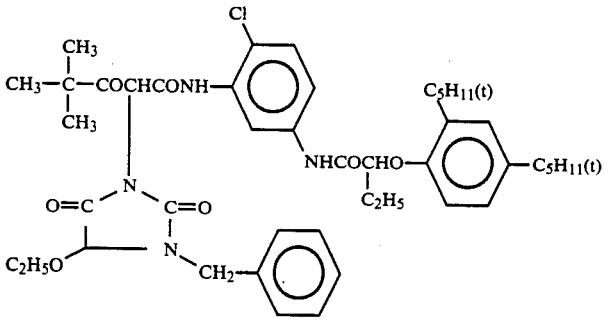
(Y-2)
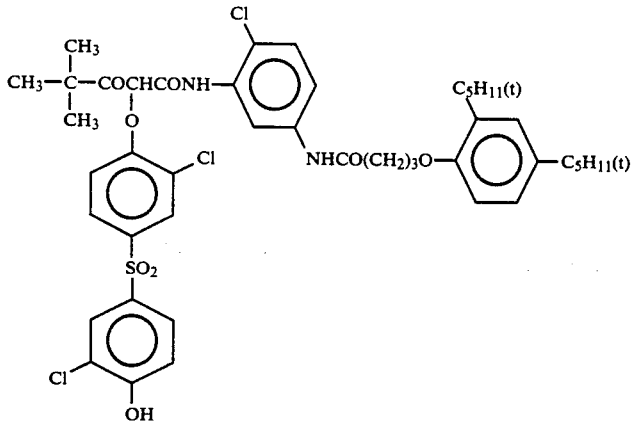
(Y-3)

-continued
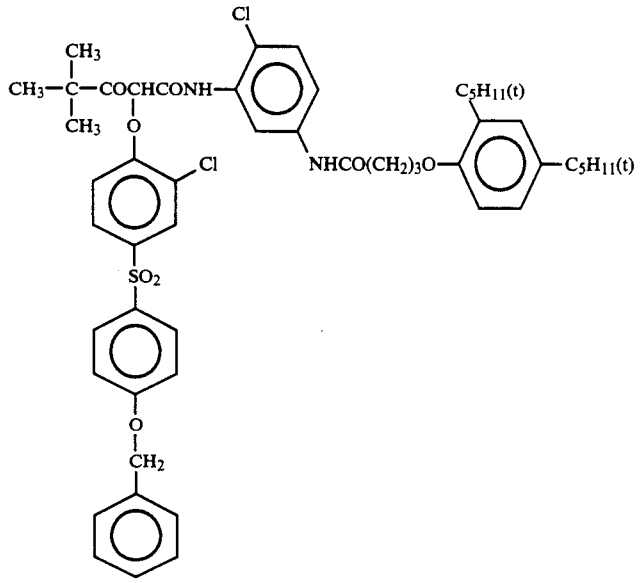
(Y-4)
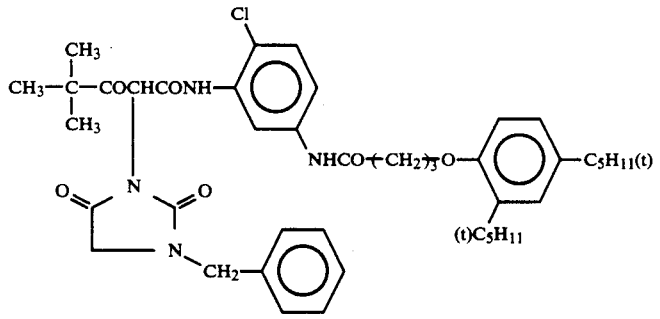
(Y-5)
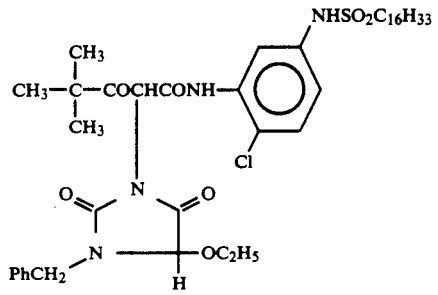
(Y-6)

-continued
(Y-7)
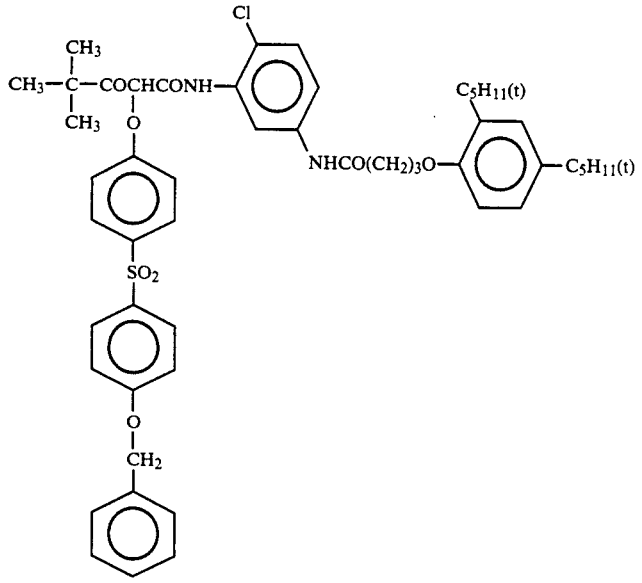
(Y-8)
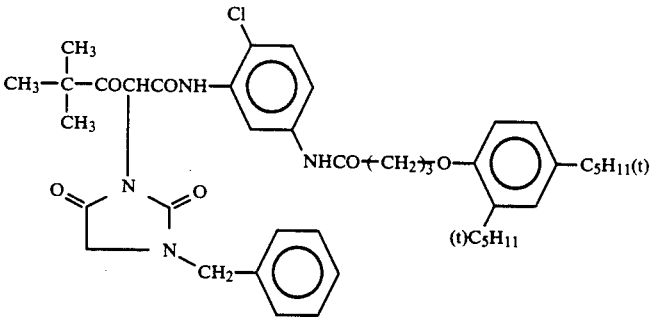
(Y-9)
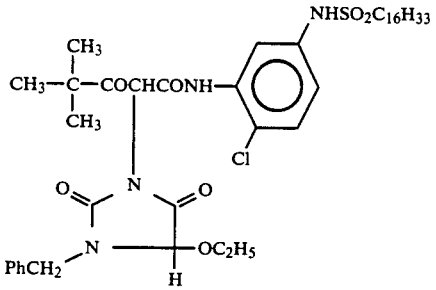
(Y-10)
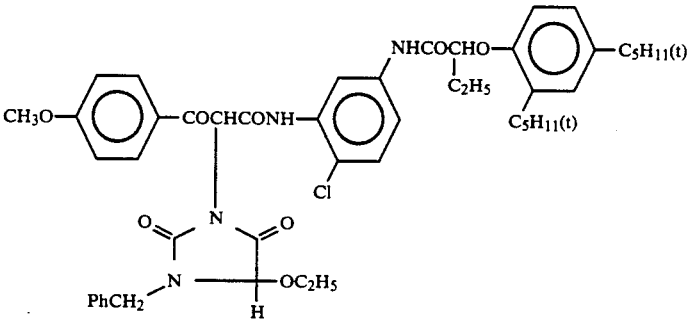

-continued
(Y-11)
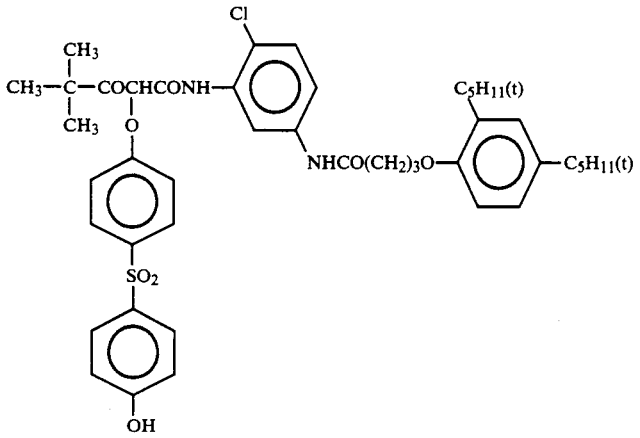
(Y-12)
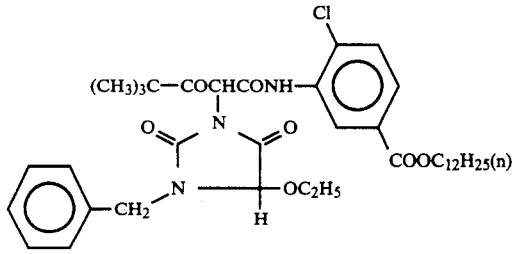
(Y-13)
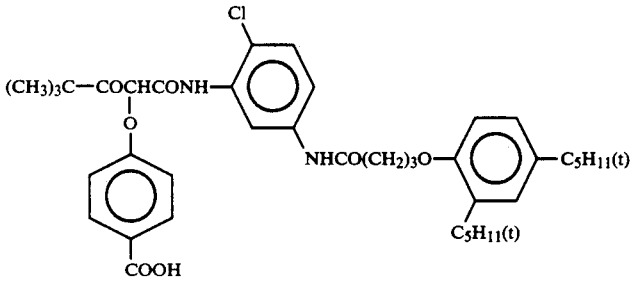
(Y-14)
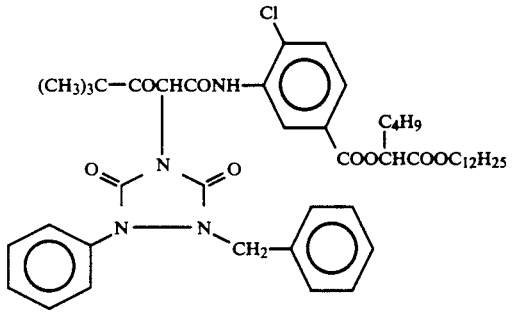
(Y-15)
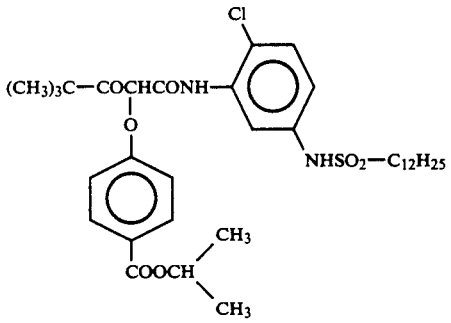

-continued
(Y-16)
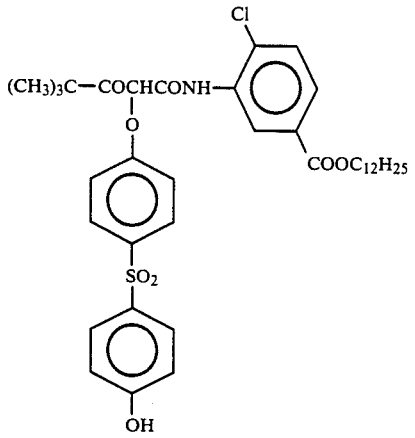
(Y-17)
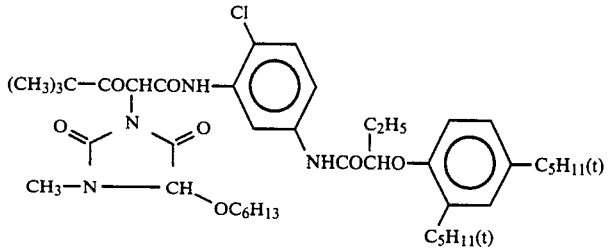
(Y-18)
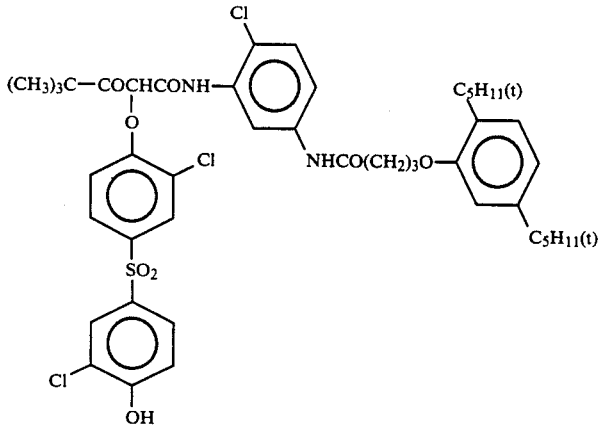
(Y-19)
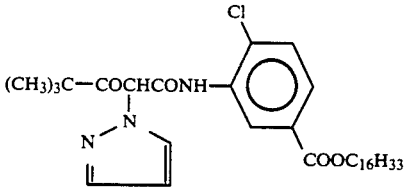
(Y-20)
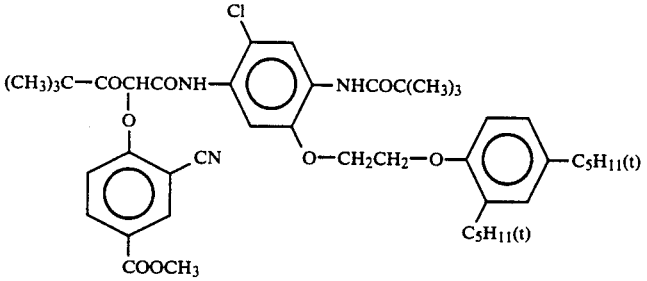

-continued (Y-21)

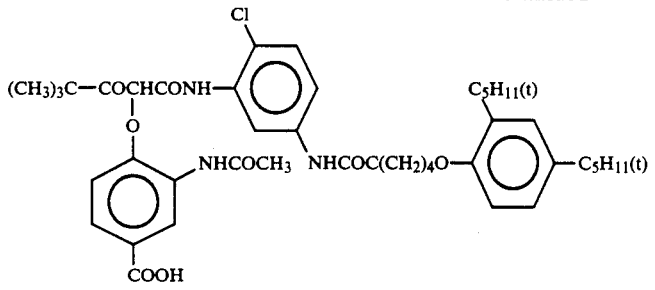

(Y-22)

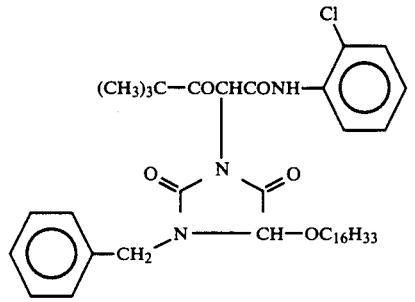

(Y-23)

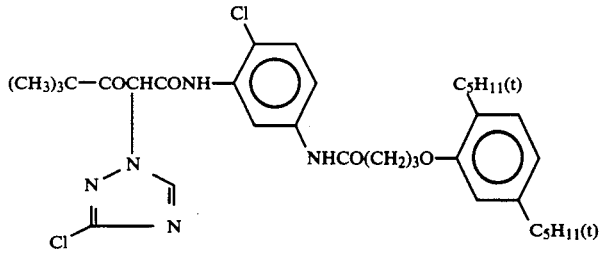

The preferred oil soluble non-color forming polymers for use in this invention are substantially insoluble in water and soluble in organic solvents and they have a glass transition temperature of at least 60°C., and most desirably they have a glass transition temperature of at least 90° C.

The preferred structures are indicated below.

1) Water insoluble, organic solvent soluble homopolymers or copolymers in which the repeating unit from which the polymer is formed has a

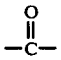

group in the main chain or in a side chain.

More desirably:

2) Water insoluble, organic solvent soluble homopolymers or copolymers in which the repeating unit from which the polymer is formed has a

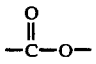

group in the main chain or in a side chain.

3) Water insoluble, organic solvent soluble homopolymers or copolymers in which the repeating unit from which the polymer is made has a

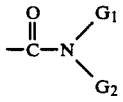

group in the main chain or in a side chain, where $G_1$ and $G_2$ each represent a hydrogen atom, or a substituted or unsubstituted alkyl or aryl group, but both $G_1$ and $G_2$ cannot be hydrogen atom at the same time.

Most desirably, they are polymers in which, in the polymers described in (3) above, one of $G_1$ and $G_2$ is a hydrogen atom and the other is a substituted or unsubstituted alkyl or aryl group which has from 3 to 12 carbon atoms.

Actual examples polymers which can be used in the invention are described below, but the invention is not limited to these examples.

(A) Vinyl Polymers

Monomers which can be used to form vinyl polymers of this invention include acrylic acid esters, of which actual example include methyl acrylate, ethyl acrylate, n-propyl acrylate, iso-propyl acrylate, n-butyl acrylate, iso-butyl acrylate, sec-butyl acrylate, tert-butyl acrylate, amyl acrylate, hexyl acrylate, 2-ethylhexyl acrylate, octyl acrylate, tert-octyl acrylate, -2 chloroethyl acrylate, 2-bromoethyl acrylate, 4-chlorobutyl acrylate, cyanoethyl acrylate, 2-acetoxyethyl acrylate, dimethylaminoethyl acrylate, benzyl acrylate, methoxybenzylacrylate, 2-chlorocyclohexyl acrylate, cyclohexyl acrylate, furfuryl acrylate, tetrahydrofurfuryl acrylate, phenyl acrylate, 5-hydroxypentyl acrylate, 2,2-dimethyl-3-hydroxypropyl acrylate, 2-methoxyethyl acrylate, 3-methoxybutyl acrylate, 2-ethoxyethyl acrylate, 2-iso-propoxyethyl acrylate, 2-butoxyethyl acrylate, 2-(2-methoxyethoxy)ethylacrylate, 2-(2-butoxyethoxy)ethyl acrylate, ω-methoxypolyethyleneglycol acrylate (number of mols added n=9), 1-bromo-2-methoxyethyl acrylate, 1,1-dichloro-2-ethoxyethyl acrylate, etc.

Moreover, the monomers etc. indicated below can also be used.

Methacrylic acid esters: Actual example include methyl methacrylate, ethyl methacrylate, n-propyl methacrylate, iso-propyl methacrylate, n-butyl methacrylate, iso-butyl methacrylate, sec-butyl methacrylate, tert-butyl methacrylate, amyl methacrylate, hexyl methacrylate, cyclohexyl methacrylate, benzyl methacrylate, chlorobenzyl methacrylate, octyl methacrylate, stearyl methacrylate, sulfopropyl methacrylate, N-ethyl-N-phenylaminoethyl methacrylate, 2-(3-phenylpropyloxy)ethyl methacrylate, dimethylaminophenoxyethyl methacrylate, furfuryl methacrylate, tetrahydrofurfuryl methacrylate, phenyl methacrylate, cresyl methacrylate, naphthyl methacrylate, 2-hydroxyethyl methacrylate, 4-hydroxybutyl methacrylate, triethylenegrlycol monomethacrylate, dipropyleneglycol monomethacrylate, 2-methoxyethyl methacrylate, 3-methoxybutyl methacrylate, 2-acetoxyethyl methacrylate, 2-acetoacetoxyethyl methacrylate, 2-ethoxyethyl methacrylate, 2-iso-propoxyethyl methacrylate, 2-butoxyethyl methacrylate, 2-(2-methoxyethoxy)ethyl methacrylate, 2-(2-ethoxyethoxy)ethyl methacrylate, 2-(2-butoxyethoxy)ethyl methacrylate, ω-methoxypolyethyleneglycol methacrylate (number of mols added n=6), allyl methacrylate, methacrylic acid dimethylaminoethylmethyl chloride, etc.

Vinyl esters: Actual examples include vinyl acetate, vinyl propionate, vinyl butyrate, vinyl isobutyrate, vinyl caproate, vinyl chloroacetate, vinyl methoxyacetate, vinyl phenylacetate, vinyl benzoate, vinyl salicylate, etc.

Acrylamides: For example, acrylamide, methylacrylamide, ethylacrylamide, propylacrylamide, butylacrylamide, tert-butylacrylamide, cyclohexylacrylamide, benzylacrylamide, hydroxymethylacrylamide, methoxyethyl acrylamide, dimethylaminoethylacrylamide, phenylacryl amide, dimethylacrylamide, diethylacrylamide, β-cyanoethylacrylamide, N-(2-acetoacetoxyethyl)acrylamide, diacetoneacrylamide, tert-octylacrylamide, etc.

Methacrylamides: For example, methacrylamide, methylmethacrylamide, ethylmethacrylamide, propylmethacrylamide, butylmethacrylamide, tert-butylmethacrylamide, cyclohexylmethacrylamide, benzylmethacrylamide, hydroxymethylmethacrylamide, methoxyethylmethacrylamide, dimethylaminoethylmethacrylamide, phenylmethacrylmide, dimethylmethacrylamide, diethylmethacrylamide, β-cyanoethylmethacrylamide, N-(2-acetoacetoxyethyl)methacrylamide, etc.

Olefins: For example, dicyclopentadiene, ethylene, propylene, 1-butene, 1-pentene, vinyl chloride,vinylidene chloride, isoprene, chloroprene, butadiene, 2,3-dimethylbutadiene, etc.; styrenes, for example, styrene, methylstyrene, dimethylstyrene, trimethylstyrene, ethylstyrene, iso-propylstyrene, chloromethylstyrene, methoxystyrene, acetoxystyrene, chlorostyrene, dichlorostyrene, bromostyrene, methyl vinylbenzoate, etc.

Vinyl ethers: For example, methyl vinyl ether, butyl vinyl ether, hexyl vinyl ether, methoxyethyl vinyl ether, dimethylaminoethyl vinyl ether, etc.

Other compounds, for example, butyl crotonate, hexyl crotonate, dimethyl itaconate, dibutyl itaconate, diethyl maleate, dimethyl maleate, dibutyl maleate, diethyl fumarate, dimethyl fumarate, dibutyl fumarate, methyl vinyl ketone, phenyl vinyl ketone, methoxyethyl vinyl ketone, glycidyl acrylate, glycidyl methacrylate, N-vinyloxazolidone, N-vinylpyrrolidone, acrylonitrile, methacrylonitrile, methylenemalonitrile, vinylidene, etc.

Two or more of the monomers (for example, the above mentioned monomers) which can be used in polymers of this invention can be used as co-monomers for various purposes (for example for improving solubility). Furthermore, monomers which have acid groups such as those indicated below can also be used as co-monomers for the adjustment of coloring properties and solubility provided that the copolymer remains substantially insoluble in water.

Acrylic acid; methacrylic acid; itaconic acid; maleic acid; monoalkyl itaconate, for example, monomethyl itaconate, monoethyl itaconate, monobutyl itaconate, etc.; monoalkyl maleates, for example, monomethyl maleate, monoethyl maleate, monobutyl maleate, etc.; citraconic acid; styrenesulfonic acid; vinylbenzenesulfonic acid; vinylsulfonic acid, acryloyloxyalkylsulfonic acids, for example, acryloyloxymethylsulfonic acid, acryloyloxyethylsulfonic acid, acryloyloxypropylsulfonic acid, etc.; methacryloyloxyalkylsulfonic acids, for example, methacryloyloxymethylsulfonic acid, methacryloyloxyethylsulfonic acid, methacryloyloxypropylsulfonic acid, etc.; acrylamidoalkylsulfonic acids, for example, 2-acrylamido-2-methylethanesulfonic acid, 2-acrylamido-2-methylpropanesulfonic acid, 2-acrylamido-2-methylbutanesulfonic acid, etc.; methacrylamidoalkylsulfonic acids, for example, 2-methacrylamido-2-methylethanesulfonic acid, 2-methacrylamido-2-methylpropanesulfon,ic acid, 2-methacrylamido-2-methylbutanesulfonic acid, etc.; and the alkali metal (for example, sodium, potassium, etc.) or ammonium ion salts of these acids.

In cases where a hydrophilic monomer (here, this signifies a monomer which forms a water soluble homopolymer) is used as a co-monomer with the vinyl monomers indicated here or other vinyl monomers which can be used in the invention, no particular limitation is imposed on the proportion of hydrophilic monomer in the copolymer provided that the copolymer does not become water soluble, but normally such monomers are used in an amount not exceeding 40 mol %, preferably not exceeding 20 mol% and, most desirably, in an amount not exceeding 10 mol %. Furthermore, in cases where the hydrophilic co-monomer copolymerized with a monomer of this invention has acid groups the proportion in the copolymer of the co-monomer which has acid groups is normally not more than 20 mol %, and preferably not more than 10 mol %, from the point of view of the image storage properties as mentioned earlier and the absence of copolymers of this type is most desirable. The monomers in the polymers in this invention are preferably methacrylate based, acrylate based or methacrylamide based monomers. The acrylate and methacrylate based monomers are especially desirable.

(B) Polymers Formed by Condensation and Polyaddition Reactions

Polyeaters formed from polyhydric alcohols and polybasic acids and polyamides formed from diamines and dibasic acids, and from ω-amino-ω'-carboxylic acids, are generally known as condensation polymers and polymers such as the polyurethanes which are formed from diisocyanates and dihydric alcohols are known as polymers which have been formed by means of a polyaddition reaction.

Glycols which have an OH-$R_1$-OH structure (where $R_1$ is a hydrocarbon chain, especially an aliphatic hydrocarbon chain, which has from 2 to about 12 carbon atoms), and polyalkyleneglycols are effective as polyhydric alcohols, and acids which have an HOOC-$R_2$-COOH structure (where $R_2$ represents a single bond or a hydrocarbon chain which has from 1 to about 12 carbon atoms) are effective as polybasic acids.

Actual examples of polyhydric alcohols include ethyleneglycol, diethyleneglycol, triethyleneglycol, 1,2-propyleneglycol, 1,3-propylene glycol, trimethylolpropane, 1,4 butanediol, isobutylenediol, 1,5-pentanediol, neopentylglycol, 1,6-hexanediol, 1.7-heptanediol, 1,8-octanediol, 1,9-nonanediol, 1,10-decanediol, 1,11-undecanediol, 1,12-dodecanediol, 1,13-tridecanediol, glycerine, diglycerine, triglycerine, 1-methylglycerine, erythritol, mannitol, sorbitol, etc.

Actual examples of polybasic acids include oxalic acid, succinic acid, glutaric acid, adipic acid, pimelic acid, suberic acid, azelaic acid, sebacic acid, nonanedicarboxylic acid, decanedicarboxylic acid, undecanedicarboxylic acid, dodecanedicarboxylic acid, fumaric acid, maleic acid, itaconic acid, citraconic acid, phthalic acid, isophthalic acid, terephthalic acid, tetrachlorophthalic acid, metaconic acid isohymelic acid, cyclopendadiene - maleic anhydride adduct, rosin - maleic anhydride adduct, etc.

Examples of diamines include hydrazine, methylenediamine, ethylenediamine, trimethylenediamine, tetramethylenediamine, hexamethylenediamine, dodecamethylenediamine, 1,4-diaminocyclohexane, 1,4-diaminomethylcyclohexane, o-aminoaniline, p-aminoaniline, 1,4-diaminomethylbenzene, di(4-aminophenyl)ether, etc.

Examples of ω-amino-ω-carboxylic acids include glycine, β-alanine, 3-aminopropanoic acid, 4-aminobutanoic acid, 5-aminopentanoic acid, 11-aminododecanoic acid, 4-aminobenzoic acid, 4-(2-aminoethyl)benzoic acid and 4-(4-aminophenyl)-butanoic acid, etc.

Examples of diisocyanates include ethylenediisocyanate, hexamethylenediisocyanate, m-phenylenediisocyanate, p-phenylenediisocyanate, p-xylenediisocyanate and 1,5-naphthyldiisocyanate, etc.

(C) Others

For example, polyesters and polyamides can be obtained by ring opening polymerization:

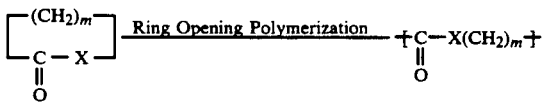

X in this equation represents an —O— group or an —NH— group and m represents an integer of value 4 to 7. The —$CH_2$ groups may be branched.

Monomers of this type include β-propiolactone, ε-caprolactone, dimethylpropiolactone, α-pyrrolidone, α-piperidone, ε-caprolactam, α-methyl-ε-caprolactam, etc.

Two or more of any of the types of polymer of this invention disclosed above can be used conjointly.

The component of the polymer which component has a molecular weight is not more than 40,000 is preferably included in an amount of from 30 to 70% by weight based on the total oil soluble non-color forming polymers which are used in the invention. The molecular weight distribution of the polymer in this invention is obtained from measurements made using gel permeation chromatography. (GPC).

The conditions used for measurements using the GPC method are indicated below.

| | |
|---|---|
| Column: TSKgel (made by Toyo Soda) | |
| G1000HXL | 1 column |
| (Exclusion Limit molecular weight 1000 | |
| Column Dimensions 7.8 ID × 300 mm) | |
| G2000HHL | 2 columns |
| (Exclusion Limit molecular weight 10000 | |
| Column Dimensions 7.8 ID × 300 mm) | |
| G4000 HXL | 1 column |
| (Exclusion Limit molecular weight 400000 | |
| Column Dimensions 7.8 ID × 300 mm) | |

Solvent: THF (Tetrahydrofran)
Flow Rate: 1 ml/min.
Column Temperature: 40° C.
Detector: RI (incorporating HLC-8020 made by Toyo Soda)

Calibration curve prepared using TSK standard polystyrene (made by Toyo Soda).

The molecular weight distribution was obtained using a CP-8000 data processor (made by Toyo Soda).

The mixing ratio (by weight) of the oil soluble coupler which has been rendered fast to diffusion and the oil soluble non-color forming polymer in this invention is from 1:5 to 10:1, and preferably from 1:2 to 4:1.

Some actual examples of polymers which can be used in the invention are described below, but the invention is not limited to these examples.

| Example | Type of Polyme | Percentage of Component of Molecular Weight Less Than 40,000 |
|---|---|---|
| P-1) | Poly(vinyl acetate) | 32 |
| P-2) | Poly(vinyl propionate) | 35 |
| P-3) | Poly(methyl methacrylate) | 53 |
| P-4) | Poly(ethyl methacrylate) | 25 |
| P-5) | Poly(ethyl acrylate) | 38 |
| P-6) | Vinyl acetate/vinyl alcohol copolymer (95:5) | 34 |
| P-7) | Poly(n-butyl acrylate) | 58 |
| P-8) | Poly(n-butyl methacrylate) | 27 |
| P-9) | Poly(iso-butyl methacrylate) | 43 |
| P-10) | Poly(iso-propyl methacrylate) | 36 |
| P-11) | Poly(decyl methacrylate) | 32 |
| P-12) | n-Butyl acrylate/acrylamide copolymer (95:5) | 45 |
| P-13) | Poly(methyl chloroacrylate) | 26 |
| P-14) | 1-4-Butanediol/adipic acid polyester | 83 |
| P-15) | Ethyleneglycol/sebacic acid polyester | 76 |

-continued

| Example | Type of Polyme | Percentage of Component of Molecular Weight Less Than 40,000 |
|---|---|---|
| P-16) | Polycaprolactam | 83 |
| P-17) | Poly(2-tert-butylphenyl acrylate) | 25 |
| P-18) | Poly(4-tert-butylphenyl acrylate) | 28 |
| P-19) | n-Butyl methacrylate/N-vinyl-2-pyrrolidone copolymer (90:10) | 32 |
| P-20) | Methyl methacrylate/vinyl chloride copolymer (70:30) | 36 |
| P-21) | Methyl methacrylate/styrene copolymer (90:10) | 37 |
| P-22) | Methyl methacrylate/ethyl acrylate copolymer (50:50) | 26 |
| P-23) | n-Butyl methacrylate/methyl methacrylate/styrene copolymer (50:30:20) | 33 |
| P-24) | Vinyl acetate/acrylamide copolymer (85:15) | 46 |
| P-25) | Vinyl chloride/vinyl acetate copolymer (65:35) | 52 |
| P-26) | Methyl methacrylate/acrylonitrile copolymer (65:35) | 38 |
| P-27) | Diacetoneacrylamide/methyl methacrylate copolymer (50:50) | 44 |
| P-28) | Vinyl methyl ketone/isobutyl methacrylate copolymer (55:45) | 29 |
| P-29) | Ethyl methacrylate/n-butyl acrylate copolymer (70:30) | 30 |
| P-30) | Diacetoneacrylamide/n-butyl acrylate copolymer (60:40) | 27 |
| P-31) | Methyl methacrylate/cyclohexyl methacrylate copolymer (50:50) | 38 |
| P-32) | n-butyl acrylate/styrene methacrylate diacetoneacrylamide copolymer (70:20:10)(sic) | 33 |
| P-33) | N-tert-Butylmethacrylamide/methyl methacrylate/acrylic acid copolymer (60:30:10) | 35 |
| P-34) | Methyl methacrylate/styrene/vinylsulfonamide copolymer (70:20:10) | 28 |
| P-35) | Methyl methacrylate/phenyl vinyl ketone copolymer (70:30) | 31 |
| P-36) | n-Butyl acrylate/methyl methacrylate/n-butyl methacrylate copolymer (35:35:30) | 27 |
| P-37) | n-Butyl methacrylate/pentyl methacrylate/N-vinyl-2-pyrrolidone copolymer (38:38:24) | 26 |
| P-38) | Methyl methacrylate/n-butyl methacrylate/isobutyl methacrylate/acrylic acid copolymer (37:29:25:9) | 25 |
| P-39) | n-Butyl methacrylate/acrylic acid copolymer (95:5) | 32 |
| P-40) | Methyl methacrylate/acrylic acid copolymer (95:5) | 30 |
| P-41) | Benzyl methacrylate/acrylic acid copolymer (90:10) | 29 |
| P-42) | n-Butyl methacrylate/methyl methacrylate/benzyl methacrylate/acrylic acid copolymer (35:35:25:5) | 36 |
| P-43) | n-Butyl methacrylate/methyl methacrylate/benzyl methacrylate copolymer (35:35:30) | 41 |
| P-44) | Poly(3-pentyl acrylate) | 58 |
| P-45) | Cyclohexyl methacrylate/methyl methacrylate/n-propyl methacrylate copolymer (37:29:34) | 62 |
| P-46) | Poly(pentyl methacrylate) | 51 |
| P-47) | Methyl methacrylate/n-butyl methacrylate copolymer (65:35) | 43 |
| P-48) | Vinyl acetate/vinyl propionate copolymer (75:25) | 27 |
| P-49) | n-Butyl methacrylate/3-acryloxybutane-1-sulfonic acid, sodium salt, copolymer (97:3) | 35 |
| P-50) | n-Butyl methacrylate/methyl methacrylate/acrylamide copolymer (35:35:30) | 33 |
| P-51) | n-Butyl methacrylate/methyl acrylate/vinyl chloride copolymer (37:36:27) | 38 |
| P-52) | n-Butyl methacrylate/styrene copolymer (90:10) | 46 |
| P-53) | Methyl methacrylate/N-vinyl-2-pyrrolidone copolymer (90:10) | 62 |
| P-54) | n-Butyl methacrylate/vinyl chloride copolymer (90:10) | 51 |
| P-55) | n-Butyl methacrylate/styrene copolymer (70:30) | 48 |
| P-56) | Poly(N-sec-butylacrylamide) | 43 |
| P-57) | Poly(N-tert-butylacrylamide) | 36 |
| P-58) | Diacetoneacrylamide/methyl methacrylate copolymer (62:38) | 42 |
| P-59) | Poly(cyclohexyl methacrylate/methyl methacrylate copolymer (60:40) | 51 |
| P-60) | N-tert-Butylacrylamide/methyl methacrylate copolymer (40:60) | 61 |
| P-61) | Poly(N-n-Butylacrylamide) | 32 |
| P-62) | Poly(tert-butyl methacrylate)/N-tert-butyl acrylamide copolymer (50:50) | 38 |
| P-63) | tert-Butyl methacrylate/methyl methacrylate copolymer (70:30) | 35 |
| P-64) | Poly(N-tert-butylacrylamide) | 39 |
| P-65) | N-tert-Butylacrylamide/methyl methacrylate copolymer (60:40) | 40 |
| P-66) | Methyl methacrylate/acrylonitrile copolymer (70:30) | 41 |
| P-67) | Methyl methcrylate/vinyl methyl ketone copolymer (38:62) | 52 |
| P-68) | Methyl methacrylate/styrene copolymer (75:25) | 36 |
| P-69) | Methyl methacrylate/hexyl methacrylate copolymer (70:30) | 36 |
| P-70) | Poly(benzyl acrylate) | 31 |
| P-71) | Poly(4-biphenyl acrylate) | 38 |
| P-72) | Poly(4-butoxycarbonylphenyl acrylate) | 39 |
| P-73) | Poly(sec-butyl acrylate) | 35 |
| P-74) | Poly(tert-butyl acrylate) | 40 |
| P-75) | Poly[3-chloro-2,2-bis(chloromethyl)-propyl acrylate] | 43 |
| P-76) | Poly(2-chlorophenyl acrylate | 41 |
| P-77) | Poly(4-chlorophenyl acrylate) | 38 |
| P-78) | Poly(pentachlorophenyl acrylate) | 35 |
| P-79) | Poly(4-cyanobenzyl acrylate) | 27 |
| P-80) | Poly(cyanoethyl acrylate) | 28 |
| P-81) | Poly(4-cyanophenyl acrylate) | 36 |
| P-82) | Poly(4-cyano-3-thiabutyl acrylate) | 37 |
| P-83) | Poly(cyclohexyl acrylate) | 33 |
| P-84) | Poly(2-ethoxycarbonylphenyl acrylate) | 35 |
| P-85) | Poly(3-ethoxycarbonylphenyl acrylate) | 43 |
| P-86) | Poly(4-ethoxycarbonylphenyl acrylate) | 46 |
| P-87) | Poly(2-ethoxyethyl acrylate) | 39 |
| P-88) | Poly(3-ethoxypropyl acrylate) | 35 |
| P-89) | Poly(1H,1H,5H-octafluoropentyl acrylate) | 36 |
| P-90) | Poly(heptyl acrylate) | 40 |
| P-91) | Poly(hexadecyl acrylate) | 43 |
| P-92) | Poly(hexyl acrylate) | 48 |
| P-93) | Poly(isobutyl acrylate) | 37 |
| P-94) | Poly isopropyl acrylate) | 29 |
| P-95) | Poly(3-methoxybutyl acrylate) | 33 |
| P-96) | Poly(2-methoxycarbonylphenyl acrylate) | 38 |
| P-97) | Poly(3-methoxycarbonylphenyl acrylate) | 47 |
| P-98) | Poly(4-methoxycarbonylphenyl acrylate) | 26 |
| P-99) | Poly(2-methoxyethyl acrylate) | 39 |
| P-100) | Poly(4-methoxyphenyl acrylate) | 29 |
| P-101) | Poly(3-methoxypropyl acrylate) | 36 |
| P-102) | Poly(3,5-dimethyladamantyl acrylate) | 38 |
| P-103) | Poly(3-methoxyaminophenyl acrylate) | 29 |
| P-104) | Poly(vinyl tert-butyrate) | 30 |
| P-105) | Poly(2-methylbutyl acrylate) | 48 |
| P-106) | Poly(3-methylbutyl acrylate) | 53 |
| P-107) | Poly(1,3-dimethylbutyl acrylate) | 36 |

-continued

| Example | Type of Polyme | Percentage of Component of Molecular Weight Less Than 40,000 |
|---|---|---|
| P-108) | Poly(2-methylpentyl acrylate) | 29 |
| P-109) | Poly(2-naphthyl acrylate) | 33 |
| P-110) | Poly(phenyl methacrylate) | 38 |
| P-111) | Poly(propyl acrylate) | 35 |
| P-112) | Poly(m-tolyl acrylate) | 37 |
| P-113) | Poly(o-tolyl acrylate) | 33 |
| P-114) | Poly(p-tolyl acrylate) | 36 |
| P-115) | Poly(N,N-dibutylacrylamide) | 48 |
| P-116) | Poly(iso-hexylacrylamide) | 52 |
| P-117) | Poly(iso-octylacrylamide) | 26 |
| P-118) | Poly(N-methyl-N-phenylacrylamide) | 36 |
| P-119) | Poly(adamantyl methacrylate) | 34 |
| P-120) | Poly(benzyl methacrylate) | 38 |
| P-121) | Poly(2-bromoethyl methacrylate) | 39 |
| P-122) | Poly(2-N-tert-butylaminoethyl methacrylate) | 25 |
| P-123) | Poly(sec-butyl methacrylate) | 53 |
| P-124) | Poly(tert-butyl methacrylate) | 33 |
| P-125) | Poly(2-chloroethyl methacrylate) | 37 |
| P-126) | Poly(2-cyanoethyl methacrylate) | 29 |
| P-127) | Poly(2-cyanophenyl methacrylate) | 32 |
| P-128) | Poly(4-cyanophenyl methacrylate) | 30 |
| P-129) | Poly(cyclohexyl methacrylate) | 36 |
| P-130) | Poly(dodecyl methacrylate) | 48 |
| P-131) | Poly(diethylaminoethyl methacrylate) | 63 |
| P-132) | Poly(2-ethylsulfinylethyl methacrylate) | 29 |
| P-133) | Poly(hexadecyl methacrylate) | 63 |
| P-134) | Poly(hexyl methacrylate) | 26 |
| P-135) | Poly(2-hydroxypropyl methacrylate) | 29 |
| P-136) | Poly(4-methoxycarbonylphenyl methacrylate) | 33 |
| P-137) | Poly(3,5-dimethyladamantyl methacrylate) | 39 |
| P-138) | Poly(dimethylaminoethyl methacrylate) | 40 |
| P-139) | Poly(3,3-dimethylbutyl methacrylate) | 47 |
| P-140) | Poly(3,3-dimethyl-2-butyl methacrylate) | 44 |
| P-141) | Poly(3,5,5-trimethylhexyl methacrylate) | 34 |
| P-142) | Poly(octadecyl methacrylate) | 38 |
| P-143) | Poly(tetradecyl methacrylate) | 39 |
| P-144) | Poly(4-butoxycarbonylphenyl-methacrylamide) | 38 |
| P-145) | Poly(4-carboxyphenylmethacrylamide) | 38 |
| P-146) | Poly(4-ethoxycarbonylphenyl-methacrylamide) | 46 |
| P-147) | Poly(4-methoxycarbonylphenyl-methacrylamide) | 32 |
| P-148) | Poly(butyl botoxycarbonyl-methacrylate) | 36 |
| P-149) | Poly(butyl chloroacrylate) | 38 |
| P-150) | Poly(butyl cyanoacrylate) | 43 |
| P-151) | Poly(cyclohexyl chloroacrylate) | 29 |
| P-152) | Poly(ethyl chloroacrylate) | 35 |
| P-153) | Poly(ethyl ethoxycarbonyl-methacrylate) | 36 |
| P-154) | Poly(ethyl ethacrylate) | 25 |
| P-155) | Poly(ethyl fluoromethacrylate) | 22 |
| P-156) | Poly(hexyl hexyloxycarbonyl-methacrylate) | 52 |
| P-157) | Poly(iso-butyl chloroacrylate) | 32 |
| P-158) | Poly(iso-propyl chloroacrylate) | 43 |
| P-159) | Trimethylenediamine/glutaric acid polyamide | 62 |
| P-160) | Hexamethylenediamine/adipic acid polyamide | 32 |
| P-161) | Poly(α-pyrrolidone) | 36 |
| P-162) | Poly(ε-caprolactam) | 48 |
| P-163) | Hexamethylenediisocyanate/1,4-cetanediol polyurethane | 58 |
| P-164) | p-Phenylenediisocyante/ethylene glycol polyurethane | 46 |

Example of Synthesis

Preparation of Methyl Methacrylate Polymer (P-3)

Methyl methacrylate (50.0 grams), 0.5 grams of poly(sodium acrylate), 0.1 gram of dodecylmercaptan and 200 ml of distilled water were introduced into a 500 ml three necked flask and the mixture was heated to 80° C. with stirring under a blanket of nitrogen. Dimethyl azobisiso-butyrate (500 mg) was added as a polymerization initiator and polymerization started.

The reaction mixture was cooled after polymerizing for a period of 2 hours, and 48.7 grams of the polymer P-3 was obtained by recovering by filtration the polymer which had formed in the form of beads and washing with water. The size of the component of molecular weight not more than 40,000, according to molecular weight measurements with GPC, was 53%.

Example of Synthesis 2

Preparation of t-Butylacrylamide Polymer (P-57)

A mixture of 50.0 grams of t-butylacrylamide, 50 ml of isopropyl alcohol and 250 ml of toluene was introduced into a 500 ml three necked flask and heated to 80° C. with stirring under a blanket of nitrogen.

A toluene solution (10 ml) containing 500 mg of azobisisobutyronitrile was added as a polymerization initiator and polymerization started.

The reaction mixture was cooled after polymerizing for a period of 3 hours and 47.9 grams of the polymer P-57 was obtained on recovering by filtration of the solid which precipitated out on pouring the mixture into 1 liter of hexane, washing the solid with hexane, and drying the product by heating under reduced pressure. The size of the component of molecular weight not more than 40,000, according to molecular weight measurements with GPC, was 36%.

The dispersions of fine lipophilic particles which contain a polymer of this invention are preferably prepared in the way indicated below.

The (a) polymer of this invention which is a so-called linear polymer which is uncrosslinked and which has been prepared by solution polymerization, emulsion polymerization or suspension polymerization, the (b) high boiling point coupler solvent and the coupler are formed into a complete solution, together with an auxiliary solvent, after which the solution is dispersed, with the aid of a dispersing agent, with ultrasound or in a colloid mill, in water, preferably in an aqueous solution of a hydrophilic colloid, and most desirably in an aqueous gelatin solution, to form fine particles and this is included in the silver halide emulsion. Alternatively, water or an aqueous hydrophilic colloid solution such as a gelatin solution is added to an auxiliary organic solvent which contains a dispersion promotor such as a surfactant, the polymer of this invention, the high boiling point coupler solvent and the coupler, and an oil in water dispersion may be formed by phase reversal. The auxiliary organic solvent is then removed by volatalization, noodle washing or ultrafiltration, etc. from the dispersion which has been prepared in this way, after which the dispersion may be mixed with the photographic emulsion. The term "auxiliary organic solvent" as used herein signifies an organic solvent which is useful at the time of emulsification and dispersion, being a low boiling point organic solvent, or a solvent which has some solubility in water and which can be eliminated by washing with water, etc., which is essentially eliminated from the photosensitive material in practice during the course of drying at the time of coating or in the ways indicated above. The auxiliary solvent may be a lower alcohol acetate such as ethyl acetate or butyl acetate, ethyl propionate, sec-butyl alcohol, methyl ethyl ketone, methyl isobutyl ketone, β-ethoxyethyl acetate, methylcellosolve acetate, cyclohexanone, etc.

Moreover, some organic solvent which is completely miscible with water, for example, methyl alcohol, ethyl alcohol, acetone, tetrahydrofuran, etc., can be used conjointly, as desired.

Combinations of two or more of these organic solvents can be used.

The average particle size of the fine lipophilic particles obtained in this way is preferably within the range from 0.04 μm to 2 μm, and most desirably, the average particle size is within the range from 0.06 μm to 0.4 μm. The particle size of the fine lipophilic particles can be measured using a measuring device such as the "Nanosizer" made by the British Coal Tar Co.

The preferred high boiling point coupler solvents mentioned above are those which can be represented by the general formulae (I) to (VI) indicated below.

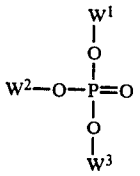
General Formula (I)

$W^1-COOW^2$ General Formula (II)

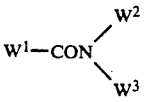
General Formula (III)

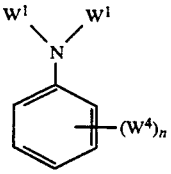
General Formula (IV)

$W^1-O-W^2$ General Formula (V)

$HO-W^6$ General Formula (VI)

In these formulae, $W^1$, $W^2$ and $W^3$ each represent a substituted or unsubstituted alkyl, cycloalkyl, alkenyl, aryl or heterocyclyl group, $W^4$ represents $W^1$, O-$W^1$ or S-$W^1$, n represents an integer of value from 1 to 5, and when n is 2 or more the groups represented by $W^4$ may be the same or different, and, in general formula (V), $W^1$ and $W^2$ can be linked together to form a condensed ring. $W^6$ represents a saturated or unsaturated alkyl or aryl group, and the number of carbon atoms in the structure of $W^6$ is at least 12.

Compounds which have a melting point below 100° C. a boiling point of at least 140° C. and which are immiscible with water as well as having the general formulae (I)-(VI) can be used as the high boiling point coupler solvents which can be used in the invention, provided that they are good solvents for the coupler. The melting point of the high boiling point coupler solvent is preferably below 80° C. The boiling point of the high boiling point coupler solvent is preferably at least 160° C., and most desirably at least 170° C.

Crystallization of the coupler is liable to occur in cases where the melting point of the coupler solvent exceeds 100° C., and this also tends to reduce the extent of the improving effect on the color forming properties.

A particle size of the emulsified dispersion may be optionally controlled to fall within a desired range by selecting a molecular weight of polymers, an amount of auxiliary solvents, a kind and/or an amount of surfactants or dispersing conditions such as type of dispersing machine, mixing rate, etc.

The use of at least one type of surfactant which can be represented by the general formulae (K-1) and/or (K-2) indicated below is desirable when carrying out the aforementioned emulsification and dispersion for obtaining an emulsified dispersion which has a smaller particle size, and for improving coating properties and color forming properties.

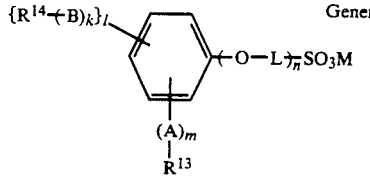
General Formula (K-1)

In this formula, $R_{13}$ and $R_{14}$ represent alkyl groups which have from 4 to 20 carbon atoms, L represents an alkylene group, A and B represent —COO— or —CONH— groups and M represents a hydrogen atom or an alkali metal atom. Moreover, k, l and m represent 0 or 1, and n represents an integer of value from 0 to 10.

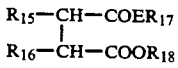
General Formula (K-2)

In this formula, one of $R_{15}$ and $R_{16}$ represents a hydrogen atom and the other represents an $-SO_3M$ group (where M has the same significance as in general formula (K-1), $R_{17}$ and $R_{18}$ each represent an alkyl group which has from 4 to 20 carbon atoms. E represents an oxygen atom or an $-NR^7-$ group (where $R^7$ represents an alkyl group which has from 1 to 8 carbon atoms).

Actual examples of compounds which can be represented by the general formulae (K-1), (K-2) are indicated below.

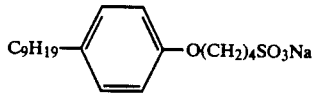
W-1

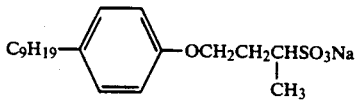
W-2

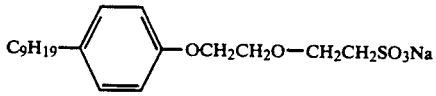
W-3

-continued

W-4

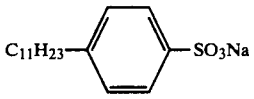

W-5

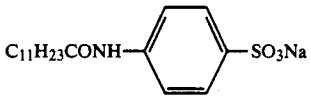

W-6

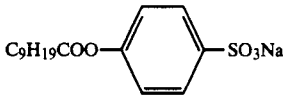

W-7

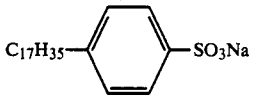

W-8

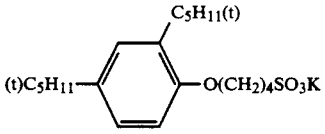

W-9

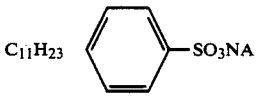

W-10

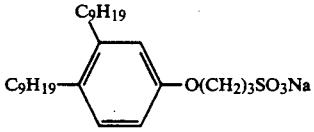

W-11

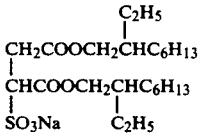

W12

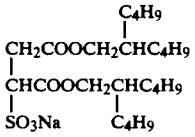

W13

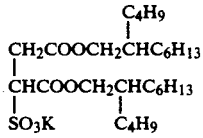

W14

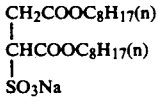

W15

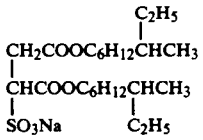

-continued

W16

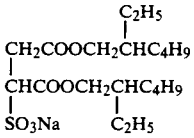

W17

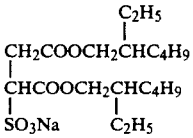

W18

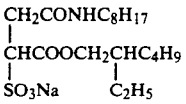

W-19

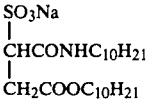

W-20

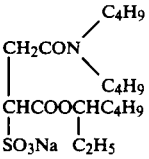

W-21

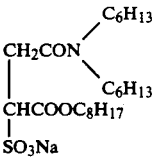

W-22

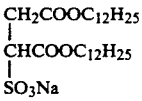

The surfactants represented by general formula (K-1) and (K-2) can be used conjointly with other surfactants in this invention, and the mixing ratio of the surfactant of this invention: other surfactant is normally within the range from 1:0 to 1:2, and preferably within the range from 1:0 to 1:1.

Silver bromide, silver iodobromide, silver iodochlorobromide, silver chlorobromide and silver chloride can all be used as the silver halide in this invention. The use of silver chlorobromides of which the silver chloride content is at least 90 mol % (and preferably at least 98 mol %) is especially desirable in cases where rapid processing is intended.

The silver chlorobromide may contain some silver iodide, but the absence of silver iodide is preferred.

The average grain size (the grain diameter in the case of spherical grains or grains which approach a spherical form or the length of an edge in the case of cubic grains is taken for the grain size, the average being expressed on the basis of the projected areas) of the silver halide grains in the photographic emulsion is of no particular importance, but it is preferably not more than 2 μm and, most desirably, it is within the range from 0.2 to 1.5 μm.

The silver halide grains in the photographic emulsion layer may have a regular crystalline form, such as a cubic, tetradecahedral or octahedral form (being a regular crystalline emulsion), or they may have an irregular crystalline form, such as a spherical or plate like form, or they may have a composite form consisting of these crystalline forms. They may also take the form of mixtures of grains of various crystalline forms. Of these, the use of the aforementioned regular crystalline emulsions is preferred.

Emulsions in which tabular silver halide grains of which the diameter is at least 5 times the thickness account for at least 50 mol % of the total projected area can also be used.

The silver halide emulsion which is included in at least one photosensitive layer is preferably a monodisperse emulsion of which the coefficient of variation (the value obtained by dividing the statistical standard deviation by the average grain size expressed as a percentage) is not more than 15% and most preferably not more than 10%.

Mono-disperse emulsions of this type may be independent emulsions which have a coefficient of variation as mentioned above, but they may be emulsions in which two or more mono-disperse emulsions which have been prepared separately and of which the average grain size in each case has a coefficient of variation of not more than 15%, and preferably not more than 10%, are mixed together. The difference in grain size and the mixing ratio can be selected arbitrarily, but the use of emulsions of which the average grain size difference is within the range from at least 0.2 m but not more than 1.0 m is preferred.

The definition of the coefficient of variation referred to above, and methods for its measurement, have been described by T. H. James on page 39 of "The Theory of the Photographic Process", Third Edition, published by the Macmillan Co. (1966).

The silver halide grains may have different phases for the internal part and the surface layer. Furthermore, they may be of the type with which the latent image is formed principally at the surface of the grains or of the type with which the latent image is formed principally within the grains. Grains of the latter type are especially useful for direct positive emulsions.

Cadmium salts, zinc salts, thallium salts, lead salts, iridium salts or complex salts thereof, rhodium salts or complex salts thereof, iron salts or complex salts thereof, etc. may also be present during the formation or physical ripening process of the silver halide grains.

Silver halide emulsions are normally subjected to chemical sensitization. The usual methods of chemical sensitization can be used, and details have been disclosed from line 18 of the lower left hand column of page 12 to line 16 on the lower right hand column on page 12 of the specification of JP-A-62-215272.

Furthermore, the silver halide emulsions are normally subjected to spectral sensitization.

The usual methine dyes can be used for the spectral sensitization, and details have been disclosed between line 3 from the bottom of the upper right hand column on page 22 and page 38 of the specification of Japanese Patent. Application JP-A-62-215272, and on separate page (B) of the Procedural Amendment dated 16th March 1987 attached thereto.

Various compounds can be included in the photographic emulsions which are used in the invention with a view to preventing the occurrence of fogging during the manufacture, storage or photographic processing of the photosensitive material, or with a view to stabilizing photographic performance. Thus many compounds which are known as anti-fogging agents or stabilizers, such as azoles, for example, benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (especially 1-phenyl-5-mercaptotetrazole, etc.), mercaptopyrimidines; mercaptotriazines, etc.; thioketo compounds such as, for example, oxazolinethione; azaindenes, for example, triazaindenes, tetraazaindenes (especially 4-hydroxy substituted (1,3,3a,7)tetraazaindene), pentaazaindenes, etc.; benzenethiosulfonic acid, benzenesulfinic acid, benzenesulfonic acid amide etc., can be added for this purpose.

The photosensitive materials of this invention may contain hydroquinone derivatives, aminophenol derivatives, amines, gallic acid derivatives, catechol derivatives, ascorbic acid derivatives, colorless couplers, sulfonamidophenol derivatives, etc. as anti-color fogging agents or anti-color mixing agents.

Various anti-color fading agents can also be used in the photosensitive materials of this invention. That is to say, typical examples of organic anti-color fading agents which can be used for cyan, magenta and/or yellow images include hydroquinones, 6-hydroxychromans, 5-hydroxycoumarans, spirochromans, p-alkoxyphenols, hindered phenols centered on the bisphenols, gallic acid derivatives, methylenedioxybenzenes, aminophenols, and hindered amines, and ether and ester derivatives in which the phenolic hydroxyl groups of these compounds have been silylated or alkylated. Furthermore, metal complexes typified by the (bissalicylaldoxymato)-nickel complex and the (bis-N,N-dialkyldithiocarbamato)nickel complex can be used for this purpose.

Actual examples of organic anti-color fading agents have been disclosed in the specifications of the following patents.

Hydroquinones have been disclosed in U.S. Pat. Nos. 2,360,290, 2,418,613, 2,700,453, 2,701,197, 2,728,659, 2,732,300, 2,735,765, 3,982,944 and 4,430,425, in British Patent 1,363,921, in U.S. Pat. Nos. 2,710,801 and 2,816,028, etc., 6-hydroxychromans, 5-hydroxycoumarans and spirochromans have been disclosed in U.S. Pat. Nos. 3,432,300, 3,573,050, 3,574,627, 3,698,909 and 3,764,337,in in JP-A-52-152225, etc., spiroindanes have been disclosed in U.S. Pat. No. 4,360,589, p-alkoxyphenols have been disclosed in U.S. Pat. No. 2,735,765, in British Patent 2,066,975, in JP-A-59-10539, JP-B-57-19764, etc., hindered phenols have been disclosed in U.S. Pat. No. 3,700,455, in JP-A-52- 72225, in U.S. Pat. No. 4,228,235, and in JP-B-52-6623, etc., gallic acid derivatives, methylenedioxybenzenes and aminophenols have been disclosed in U.S. Pat. Nos. 3,457,079 and 4,332,886, and in JP-B-56-21144, respectively, hindered amines have been disclosed in U.S. Pat. Nos. 3,336,135 and 4,268,593, in British Patents 1,326,889, 1,354,313 and 1,410,846, in JP-B-51-1420, and in JP-A-58-114036 and JP-A-59-78344, etc., ether and ester derivatives of phenolic hydroxyl groups have been disclosed in U.S. Pat. Nos. 4,155,765, 4,174,220, 4,254,216 and 4,264,720, in JP-A-54-145530, JP-A-55-6321, JP-A-58-105147 and JP-A-59-10539, in JP-B-57-37856, in U.S. Pat. No. 4,279,990, and in JP-B-53-3263, etc., and metal complexes have been disclosed in U.S. Pat. Nos. 4,050,938 and 4,241,155, in British Patent 2,027,731(A), etc. These compounds can be used to achieve the intended purpose by coemulsification with the couplers and addition to the photosensitive layer, normally at a rate of from 5 to 100 wt % with respect to the corresponding coupler. The introduction of ultraviolet absorbers into layers on either side adjacent to the cyan color forming layer is more effective for preventing deterioration of the cyan dye image by heat or, more especially, by light.

The use of the spiroindanes and hindered amines, etc. from among the above mentioned anti-color fading agents is especially desirable.

The spiroindanes and the hindered amines, etc. are especially effective among the above mentioned anti-color fading agents.

The use of compounds such as those indicated below together with the aforementioned couplers and polymers, and especially with the pyrazoloazole couplers, is desirable in this invention.

Thus, the concurrent or independent use of a compound (A) which bonds chemically with the aromatic amine based developing agent which is left behind after color development processing and which forms a compound which is chemically inert and which is essentially colorless, and/or a compound (B) which bonds chemically with the oxidized form of the aromatic amines based color developing agent which is left behind after the color development process and which forms a compound which is chemically inert and which is essentially colorless, is desirable for preventing the occurrence of staining and other side effects due to colored dye formation resulting from reaction between the coupler and the color developing agent or the oxidized form thereof which is left behind in the film during the storage of the material after processing.

The preferred compounds (A) are those which react with p-anisidine in such a way that the second order reaction rate constant $k_2$ (in trioctyl phosphate at 80° C.) is within the range from 1.0 to $1\times10^{-5}$ l/mol·sec. The second order reaction rate constant $k_2$ may be obtained by the method disclosed in the specification of JP-A-63-158545.

When the value of $k_2$ is above this range the compound itself is unstable and it will react with gelatin or water and it is inevitably degraded. On the other hand, if the value of $k_2$ is below this range the reaction with the residual aromatic amine based developing agent is slow and it is impossible to prevent the side effect of the residual aromatic amine developing agent from occurring, which is to say that it is impractical to achieve the aim of the invention.

The compounds which can be represented by the general formula (AI) and (AII) which are indicated below are the preferred compounds(A) of this type.

$$R_1-(A)_n-X \qquad \text{General Formula (AI)}$$

$$R_2-\underset{\underset{B}{|}}{C}=Y \qquad \text{General Formula (AII)}$$

In these formulae, $R_1$ and $R_2$ each represent an aliphatic group, an aromatic group or a heterocyclic group. Moreover, n represents a value of 1 or 0. A represents a group that can react with the aromatic amine developing agent to form a chemical bond; X represents a group that can react with the aromatic amine developing agent to split off; B represents a hydrogen atom, an aliphatic group, an aromatic group, a heterocyclic group, an acyl group or a sulfonyl group; Y represents a group that can facilitate the addition of the aromatic amine developing agent to the compound having formula (AII); and $R_1$ and X together or Y and $R2_2$ or B together may combine to form a ring structure.

Of ways wherein the remaining aromatic amine developing agent and the compound (A) chemically combine, typical ways are substitution reactions and addition reactions.

The preferred examples of the compounds represented by formula (AI) or (AII) include the compounds as described in JP-A-63-158545, JP-A-62-283338, Japanese patent application No. 158342/87, EP-A-277589, etc.

More preferred examples of the compounds (B) that can chemically combine with the oxidation product of the aromatic amine developing agent remaining after the color development processing to form a chemically inactive and substantially colorless compound are those represented by the following formula (BI):

$$R-Z \qquad \text{(BI)}$$

wherein R represents an aliphatic group, an aromatic group, or a heterocyclic group, and Z represents a nucleophilic group or a group that can decompose in the photographic material to release a nucleophilic group. In the compounds represented by the formula (BI), Z preferably represents a group having a Pearson's nucleophilic $^{n}CH_3I$ value [R. G. Pearson et al., J. Am. Chem. Soc., 90, 319 (1968)] of 5 or more, or the group derived therefrom.

The preferred examples of the compounds represented by the formula (BI) include the compounds as described in EP-A-255722, EP-A-277589, JP-A-62-143048, JP-A-62-229145, Japanese patent application Nos. 136724/88, 214681/87 and 158342/87, etc.

The detailed explanation on combination of the aforementioned compound (A) and compound (B) is described in EP 277589.

Ultraviolet absorbers can be included in the hydrophilic colloid layers of the photosensitive materials of this invention. For example, use can be made of the benzotriazole compounds substituted with aryl groups (for example, those disclosed in U.S. Pat. No. 3,533,794), 4-thiazolidone compounds (for example, those disclosed in U.S. Pat. Nos. 3,314,794 and 3,352,601), benzophenone compounds (for example, those disclosed in JP-A-47-2784), cinnamic acid ester compounds (for example, those disclosed in U.S. Pat. Nos. 3,705,805 and 3,707,375), butadiene compounds (for example, those disclosed in U.S. Pat. No. 4,045,229), or benzo-oxidol compounds (for example, those disclosed in U.S. Pat. No. 3,700,455). Ultraviolet absorbing couplers (for example, the α-naphthol based cyan dye forming couplers) or ultraviolet absorbing polymers, etc. can also be used for this purpose. These ultraviolet absorbers may be mordanted into a specified layer.

Water soluble dyes can be included in the hydrophilic colloid layers of the photosensitive materials of this invention as filter dyes or for anti-irradiation and various other purposes. Dyes of this type include oxonol dyes, hemi-oxonol dyes, styryl dyes, merocyanine dyes, cyanine dyes and azo dyes. Of these dyes, the oxonol dyes, hemi-oxonol dyes and merocyanine dyes are useful. Details of useful oxonol dyes have been described from the upper right column on page 158 to page 163 of the specification of JP-A-62-215272.

The use of gelatin is convenient as the binding agent or protective colloid in the emulsion layers of photosensitive materials of this invention, but other hydrophilic colloids can be used either independently or in conjunction with gelatin.

The gelatin used in the invention may be a lime treated gelatin, or a gelatin which has been treated with acid can be used. Details of the manufacture of gelatin have been described by Arthur Wiese in "The Macromolecular Chemistry of Gelatin" (published by Academic Press, 1964).

The cellulose nitrate films, cellulose acetate films, cellulose acetate butyrate films, cellulose acetate propionate films, polystyrene films, polyethyleneterephthalate films, polycaarbonate films, laminates of these films with other materials, thin glass films, paper, etc. normally used in photographic materials can be used for the support which is used in this inyention. Supports such as papers which have been coated or laminated with baryta or an α-olefin polymer, especially a polymer made from an α-olefin which has from 2 to 10 carbon atoms, for example, polyethylene, polypropylene, ethylene/butene copolymer, etc., vinyl chloride resins which contain reflecting substances such as $TiO_2$, and plastic films of which the adhesion with other polymeric materials has been improved by surface roughening as described in JP-B-47-19068 provide good results. Furthermore, ultraviolet curable resins can be used for this purpose.

A transparent support or a non-transparent support can be selected according to the intended purpose of the photosensitive material. Furthermore, the supports can be rendered colored and transparent by the addition of dyes or pigments.

Apart for the original non-transparent supports such as paper, non-transparent supports also include those made by adding dyes or organic pigments such as titanium oxide to a transparent film and plastic films which have been surface treated using methods such as those described in JP-B-47-19068, etc. An underlayer is normally established on the support. Preliminary surface treatments such as coronal discharge treatments, ultraviolet irradiation and flame treatments, etc. can also be used with these supports in order to improve adhesion properties.

The color photosensitive materials which can be used for making color photographs of this invention may be any of the usual types of color photographic materials, for example, color negative films, color papers, reversal color papers, color reversal films, etc., and they are especially suitable for color photosensitive materials intended for printing purposes.

Black and white development baths and/or color development baths can be used for the development processing of the photosensitive materials of this invention. A color development bath preferably consists of an aqueous alkaline solution which contains a primary aromatic amine based color developing agent as the principal component. Aminophenol based compounds are also useful as color developing agents, but the use of p-phenylenediamine based compounds is preferred. Typical examples of these compounds include 3-methyl-4-hydroxyethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline and the sulfate, hydrochloride and p-toluenesulfonate salts of these compounds. Two or more of these compounds can be used conjointly, depending on the intended purpose.

The color development baths generally contain pH buffers such as alkali metal carbonates, borates or phosphates, and development inhibitors or anti-fogging agents such as bromides, iodides, benzimidazoles, benzothiazoles or mercapto compounds, etc. They may also contain, as required, various preservatives such as hydroxylamine, diethylhydroxylamine, sulfites, hydrazines, phenylsemicarbazides, triethanolamine, catechol sulfonic acids, triethylenediamine(1,4-diazabicyclo[2,2,-2]octane) etc., organic solvents such as ethyleneglycol, diethyleneglycol, development accelerators such as benzyl alcohol, poly(ethyleneglycol), quaternary ammonium salts and amines, dye forming couplers, competitive couplers, fogging agents such as sodium borohydride, auxiliary developing agents such as 1-phenyl-3-pyrazolidone, viscosity imparting agents, and various chelating agents as typified by the aminopolycarboxylic acids, aminopolyphosphonic acids, alkylphosphonic acids and phosphonocarboxylic acids, typical examples of which include ethylenediamine tetra-acetic acid, nitrilo triacetic acid, diethylenetriamine pentaacetic acid, cyclohexanediamine tetraacetic acid, hydroxyethylimino diacetic acid, 1-hydroxyethylidene-1,1-diphosphonic acid, nitrilo-N,N,N-trimethylenephosphonic acid, ethylenediamine-N,N,N',N'-tetramethylenephosphonic acid, ethylenediamine di-(o-hydroxyphenylacetic acid), and salts of these compounds.

Color development is carried out after a normal black and white development in the case of reversal processing. The known black and white developing agents, for example, dihydroxybenzenes such as hydroquinone, etc., 3-pyrazolidones such as 1-phenyl-3-pyrazolidone, etc., and aminophenols such as N-methyl-p-aminophenol, etc., can be used individually or in combinations for the black and white development bath.

The pH of these color development and black and white development baths is generally within the range from 9 to 12. Furthermore, the replenishment rate of these development baths depends on the color photographic material which is being processed, but it is generally not more than 3 liters per square meter of photosensitive material and it is possible, by reducing the bromide ion concentration in the replenisher, to use a replenishment rate of not more than 500 ml per square meter of photosensitive material. Prevention of the loss of liquid by evaporation, and aerial oxidation, by minimizing the contact area with the air in the processing tank is desirable in cases where the replenishment rate is low. Furthermore, the replenishment rate can be reduced by using a means of suppressing the accumulation of bromide ion in the developer.

The photographic emulsion layers are subjected to a normal bleaching process after color development. The bleaching process may be carried out at the same time as the fixing process (in a bleach-fix process) or it may be carried out as a separate process. Moreover, a bleach-fix process can be carried out after a bleaching process in order to speed-up processing. Moreover, processing can be carried out in two connected bleach-fix baths, a fixing process can be carried out before carrying out a bleach-fix process, or a bleaching process can be carried out after a bleach-fix process, according to the intended purpose of the processing. Compounds of a poly-valent metal such as iron(III), cobalt(III), chromium (VI), copper(II), etc., paracids, quinones, nitro compounds, etc. can be used as bleaching agents. Typical bleaching agents include ferricyanides; dichromates; organic complex salts of iron(III) or cobalt(III), for example, complex salts with aminopolycarboxylic acids such as ethylenediamine tetraacetic acid, diethylenetriamine pentaacetic acid, cyclohexanediamine tetraacetic acid, methylimino diacetic acid, 1,3-diaminopropane tetraacetic acid, glycol ether diamine tetraacetic acid, etc., or citric acid, tartaric acid, malic acid, etc.; persulfates; bromates; permanganates and nitrobenzenes, etc. Of these materials the use of the aminopolycarboxylic acid iron(III) complex salts, principally ethylenediamine tetraacetic acid iron(III) complex salts, and persulfates, is preferred from the points of view of both rapid processing and the prevention of environmental pollution. Moreover, the amino polycarboxylic acid iron(III) complex salts are especially useful in both bleach baths and bleach-fix baths. The pH of a bleach or bleach-fix bath in which aminopolycarboxylic acid iron(III) complex salts are being used is normally from 5.5 to 8, but processing can be carried out at lower pH values in order to speed-up processing.

Bleach accelerators can be used, as required, in the bleach baths, bleach-fix baths, or bleach or bleachfix pre-baths. Actual examples of useful bleach accelerators have been disclosed in the following specifications: Thus there are the compounds which have a mercapto group or a disulfide group disclosed in U.S. Pat. No. 3,893,858, West German Patent Nos. 1,290,812 and 2,059,988, in JP-A-53-32736, JP-A-53-57831, JP-A-53-37418, JP-A-53-72623, JP-A-95630, JP-A-53-95631, JP-A-104232, JP-A-53-124424, JP-A-=53-141623 and JP-A-53-28426, and in Research Disclosure No. 17,129 (July 1978) etc.; the thiazolidine derivatives disclosed in JP-A-50-140129; the thiourea derivatives disclosed in JP-B-45-8506, in JP-A-52-20832 and JP-A-53-32735, and in U.S. Pat. No. 3,706,561; the iodides disclosed in West German Patent No. 1,127,715 and in JP-A-58-16,235; the polyoxyethylene compounds disclosed in West German Patent Nos. 966,410 and 2,748,430; the polyamine compounds disclosed in JP-B-45-8836; the other compounds disclosed in JP-A-49-42434, JP-A-49-59644, JP-A-53-94927, JP-A-54-35727, JP-A-55-26506 and JP-A-48-163940; and bromide ions, etc. Among these compounds, those which have a mercapto group or a disulfide group are preferred in view of their large accelerating effect, and the use of the compounds disclosed in U.S. Pat. No. 3,893,858, in West German Patent No. 1,290,812, and in JP-A-53-95630 is especially desirable. Moreover, the use of the compounds disclosed in U.S. Pat. No. 4,552,834 is also desirable. These bleach accelerators may be added to the sensitve material and they are especially effective when bleach-fixing camera color photosensitive materials.

Thiosulfates, thiocyanates, thioether based compounds, thioureas and large quantities of iodides, etc. can be used as fixing agents, but thiosulfates are generally used for this purpose, and ammonium thiosulfate in particular can be used in the widest range of applications. Sulfites or bisulfites, or carbonyl - bisulfite addition compounds, are the preferred preservatives for bleach-fix baths.

The silver halide color photographic materials of this invention are generally subjected to a water washing and/or stabilizing process after the desilvering process. The quantity of water used in the water washing process can be established within a wide range according to the nature of the photosensitive material (for example, the materials, such as the couplers, which are being used), the wash water temperature, the number of washing tanks (the number of washing stages), the replenishment system, i.e. whether a counter-flow or a sequential-flow system is used, and various other conditions. The relationship between the quantity of water used and the number of water washing tanks in a multi-stage counter-flow system can be obtained using the method outlined on pages 248–253 of Journal of the Society of Motion Picture and Television Engineers, Volume 64 (May 1955).

The amount of wash water can be greatly reduced by using the multi-stage counter-flow system noted in the aforementioned literature, but bacteria proliferate due to the increased residence time of the water in the tanks and problems arise as a result of the sediments which are formed becoming attached to the photosensitive material. The method in which the calcium ion and manganese ion concentrations are reduced as disclosed in Japanese Patent Application No. 61-131632 can be used very effectively to overcome problems of this sort in the processing of color photosensitive materials of this invention. Furthermore, the isothiazolone compounds and thiabendazoles disclosed in JP-A-57-8542 and the chlorine based disinfectants such as chlorinated sodium isocyanurate, and benzotriazoles, etc., and the disinfectants disclosed in "Chemistry of Biocides and Fungicides" by Horiguchi, "Reduction of Microorganisms, Biocidal and Fungicidal Techniques", published by the Health and Hygiene Technical Society and in "A Dictionary of Biocides and Fungicides" published by the Japanese Biocide and Fungicide Society, can be used for this purpose.

The pH value of the wash water used when processing photosensitive materials of invention is within the range from 4 to 9, and preferably within the range from 5 to 8. The wash water temperature and the washing time can be set variously according to the nature of the photosensitive material and the application, etc. but, in general, washing conditions of from 20 seconds to 10 minutes at a temperature of from 15° to 45° C., and preferably of from 30 seconds to 5 minutes at a temperature of from 25° to 40° C., are selected. Moreover, the photosensitive materials of this invention can be processed directly in a stabilizing bath instead of being subjected to a water wash as described above. The known methods disclosed in JP-A-57-8543, JP-A-58-14834 and JP-A-60-220345 can all be used for this purpose.

Furthermore, there are cases in which a stabilization process is carried out following the aforementioned water washing process, and the stabilizing baths which contain formalin and surfactant which are used as a final bath for camera color photosensitive materials are an example of such a process. Various chelating agents and fungicides, etc. can be added to these stabilizing baths.

The overflow which accompanies replenishment of the above mentioned wash water and/or stabilizer can be re-used in other processes such as the desilvering process, etc.

A color developing agent may also be incorporated into the silver halide color photosensitive materials of this invention in order to simplify and speed-up processing. The incorporation of various color developing agent precursors is preferred. For example, the indoaniline based compounds disclosed in U.S. Pat. No. 3,342,597, the Schiff's base type compounds disclosed in U.S. Pat. No. 3,342,599 and in Research Disclosure Nos. 14,850 and 15,519, the aldol compounds disclosed in Research Disclosure No. 13,924, the metal salt complexes disclosed in U.S. Pat. No. 3,719,492, and the urethane based compounds disclosed in JP-A-53-135628 can be used for this purpose.

Various 1-phenyl-3-pyrazolidones can be incorporated, as required, into the silver halide color photosensitive materials of this invention with a view to accelerating color development. Typical compounds of this type have been disclosed in JP-A-56-64339, JP-57-144547 and JP-A-58-115438, etc.

The various processing baths are used at a temperature of from 10° to 50° C. in this invention. The standard temperature is normally from 33° to 38° C., but processing is accelerated and the processing time is shortened at higher temperatures and, conversely, increased picture quality and improved stability of the processing baths can be achieved at lower temperatures. Furthermore, processes using hydrogen peroxide intensification or cobalt intensification as disclosed in West German Patent No. 2,226,770 or U.S. Pat. No. 3,674,499 can be carried out in order to economize on silver in the photosensitive material.

The present invention is hereinafter described in greater detail with reference to examples, which are not construed as limiting the scope thereof. Unless otherwise indicated, all parts, percents and ratios are by weight.

EXAMPLE 1

The multi-layer silver halide photosensitive material 101 of which the layer structure is indicated below was prepared on a paper support which had been laminated on both sides with polyethylene.

Layer Structure

The composition of each layer is indicated below. The numerical values indicate coated weights (in grams per square meter). In the case of the silver halide emulsions the weight coated is indicated after calculation as silver.

Support

Polyethylene laminated paper (white pigment ($TiO_2$) and ultramarine dye were included in the polyethylene on the first layer side).

| | |
|---|---|
| First Layer (Blue Sensitive Layer) | |
| Mono-disperse silver chlorobromide emulsion (EM1) which had been spectrally sensitized with the sensitizing dye (ExS-1) | 0.16 |
| Mono-disperse silver chlorobromide emulsion (EM2) which had been spectrally sensitized with the sensitizing dye (ExS-1) | 0.10 |
| Gelatin | 1.86 |
| Colored image stabilizer (Cpd-1) | 0.02 |
| Yellow coupler (Y-2) | 0.83 |
| Polymer (P-57) | 0.08 |
| Solvent (Solv-1 and Solv-2, 1:1 by volume) | 0.35 |
| Second Layer (Anti-color Mixing Layer) | |
| Gelatin | 0.99 |
| Anti-color mixing agent (Cpd-3) | 0.03 |
| Solvent (Solv-3) | 0.06 |
| Third Layer (Green Sensitive Layer) | |
| Mono-disperse silver chlorobromide emulsion (EM3) which had been spectrally sensitized with the sensitizing dye (ExS-2,3) | 0.05 |
| Mono-disperse silver chlorobromide emulsion (EM4) which had been spectrally sensitized with the sensitizing dye (ExS-2,3) | 0.11 |
| Gelatin | 1.80 |
| Magenta coupler (M-35) | 0.39 |
| Colored image stabilizer (Cpd-4) | 0.20 |
| Colored image stabilizer (Cpd-5) | 0.05 |
| Colored image stabilizer (Cpd-6) | 0.04 |
| Solvent (Solv-3) | 0.12 |
| Solvent (Solv-4) | 0.25 |
| Fourth Layer (Ultraviolet Absorbing Layer) | |
| Gelatin | 1.60 |
| Ultraviolet absorber (Cpd-7/Cpd-8/Cpd-9 = 3/2/6 by weight) | 0.70 |
| Anti-color mixing agent (Cpd-3) | 0.05 |
| Solvent (Solv-5) | 0.27 |
| Fifth Layer (Red Sensitive Layer) | |
| Mono-disperse silver chlorobromide emulsion (EM5) which had been spectrally sensitized with the sensitizing dye (ExS-4,5) | 0.07 |
| Mono-disperse silver chlorobromide emulsion (EM6) which had been spectrally sensitized with the sensitizing dye (ExS-4,5) | 0.16 |
| Gelatin | 0.92 |
| Cyan coupler (C-3) | 0.17 |
| Cyan coupler (C-11) | 0.15 |
| Colored image stabilizer (Cpd-1) | 0.03 |
| Colored image stabilizer (Cpd-5) | 0.01 |
| Colored image stabilizer (Cpd-5) | 0.01 |
| Ultraviolet absorber (Cpd-7/Cpd-9/Cpd-10 = 3/4/2 by weight) | 0.17 |
| Solvent (Solv-2) | 0.20 |
| Sixth Layer (Ultraviolet Absorbing Layer) | |
| Gelatin | 0.54 |
| Ultraviolet absorber (Cpd-7/Cpd-8/Cpd-9 = 1/5/3 by weight) | 0.21 |
| Anti-color mixing agent (Cpd-3) | 0.02 |
| Solvent (Solv-5) | 0.06 |
| Seventh Layer (Protective Layer) | |
| Gelatin | 0.54 |
| Acrylic modified copolymer of poly(vinyl alcohol) (17% modification) | 0.17 |
| Liquid paraffin | 0.03 |

Furthermore, Cpd-11 and Cpd-12 were used at this time as anti-irradiation compounds. Moreover, "Alcanol XC" (made by DuPont), sodium alkylbenzenesulfonate, succinic acid ester and "Megafac F-120" (made by Dainippon Ink) were used as emulsification and dispersion, and coating, promotors in each layer Cpd-13 and Cpd-14 were used as silver halide stabilizers.

Furthermore, 1-oxy-3,5-dichloro-s-triazine, sodium salt, was used as a gelatin hardening agent in each layer and Cpd-2 was used as a viscosity increasing agent.

Details of the emulsions used are indicated below.

| Emulsion | Form | Average Grain Size (μm) | Br Content (mol %) | Variation Coeff. |
|---|---|---|---|---|
| EM-1 | Cubic | 0.96 | 80 | 0.06 |
| EM-2 | Cubic | 0.64 | 80 | 0.07 |
| EM-3 | Cubic | 0.52 | 70 | 0.08 |
| EM-4 | Cubic | 0.40 | 70 | 0.09 |
| EM-5 | Cubic | 0.44 | 70 | 0.09 |
| EM-6 | Cubic | 0.36 | 70 | 0.08 |

Coeff. of Variation = Standard Deviation/Average Grain Size

ExS-1
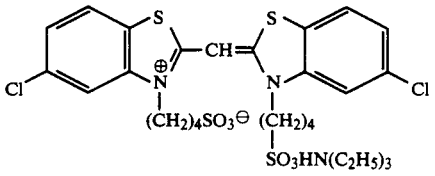
$6 \times 10^{-4}$ mol/mol.Ag
ExS-2
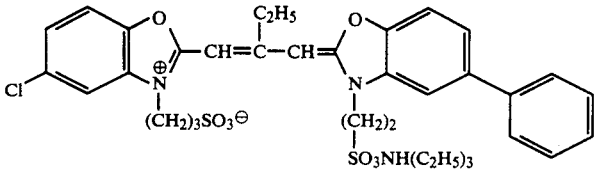
$4 \times 10^{-4}$ mol/mol.Ag
ExS-3
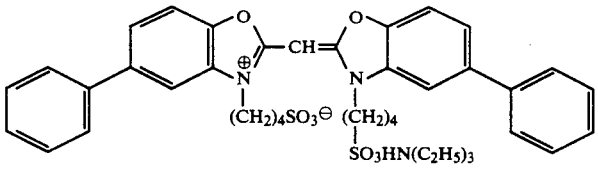
$8 \times 10^{-5}$ mol/mol.Ag
ExS-4
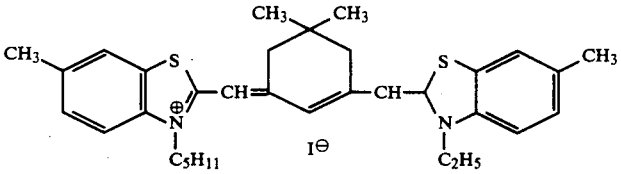
$1.8 \times 10^{-4}$ mol/mol.Ag
ExS-5
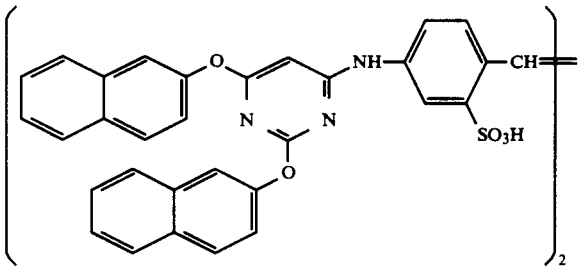
Cpd-1
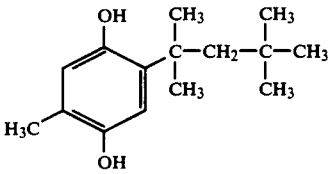
Cpd-2
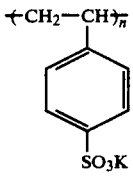

-continued
Cpd-3
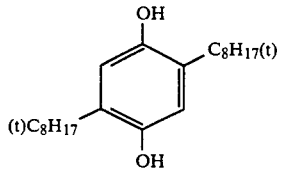
Cpd-4
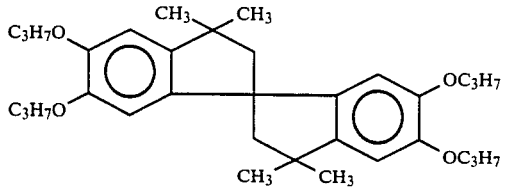
Cpd-5
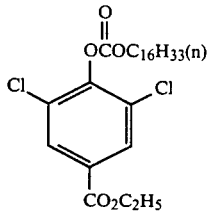
Cpd-6
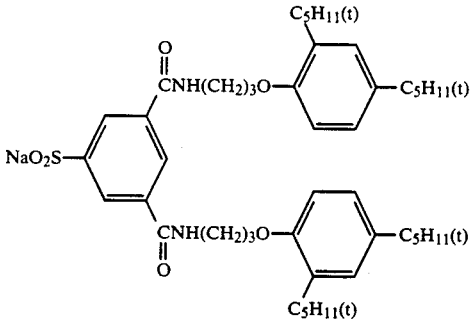
Cpd-7
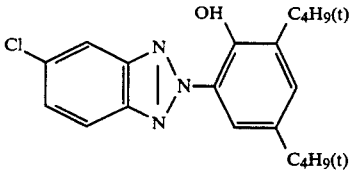
Cpd-8
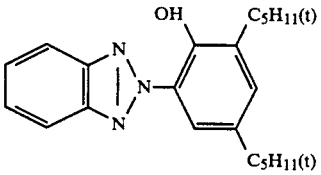
Cpd-9
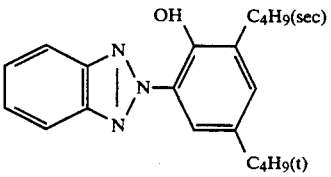
Cpd-10
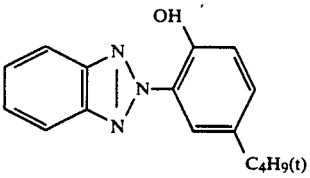

-continued

Cpd-11

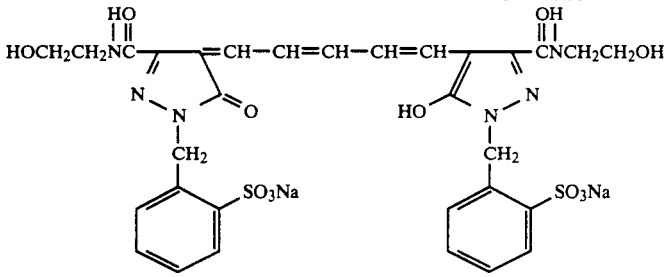

Cpd-12

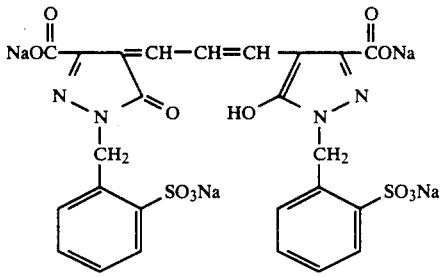

Cpd-13

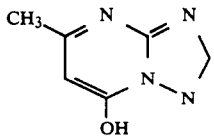

Cpd-14

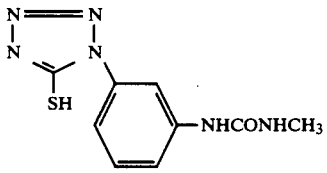

Solv-1

$((iso)C_9H_{19}O)_3P{=}O$

Solv-2

$C_8H_{17}CHCH(CH_2)_7COOC_8H_{17}$ (epoxide)

Solv-3

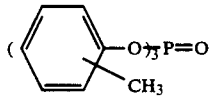

Solv-4

$(C_4H_9CH(C_2H_5)CH_2O)_3P{=}O$

Solv-5

$COOCH_2CH(C_2H_5)C_4H_9$
$(CH_2)_8$
$COOCH_2CH(C_2H_5)C_4H_9$

Preparation of Samples 102 to 120

Samples 102 to 120 were prepared in the same way as Sample 101 except that the couplers and polymers shown in Table 1 were added instead of the cyan couplers (C-3) and (C-11) in the fifth layer of Sample 101. The couplers were replaced on a equimolar basis with respect to (C-3) and (C-11).

The emulsified dispersions of coupler, etc. in Samples 101 to 120 were prepared as follows: The coupler, high-boiling coupler solvent, polymer, image stabilizer, and UV absorbent, were dissolved in ethyl acetate as the auxiliary solvent of an amount of four times weight of the coupler and subsequently mixed with 20% aqueous gelatin solution so as to be satisfy the coating amount of the fifth layer and of Table 1. Sodium dodecilebenzene sulfonate was used in an amount of 18 wt % of the coupler as the auxiliary solvent and was emulsified dispersed in an emulsifying machine of TK. Auto Homo Mixer (manufactured by Tokusho Kika Kogyo Co., Ltd.). In dispersing step, a revolving rate of the mixer vanes was adjusted to control the particle size of the emulsion being 0.12 to 0.14 μm.

The above mentioned photosensitive materials were given an imagewise exposure, after which they were processed continuously in accordance with the processing operation indicated below, using a Fujicolor Paper Processor PP600, until the system had been replenished to the extent of twice the volume of the color development tank, and continuous processing (running tests) were carried out in this way.

| Processing Operation | Temp. (°C.) | Time Min. | Time Sec. | Replenishment Rate* (ml) | Tank Capacity (liters) |
|---|---|---|---|---|---|
| Color development | 38 | 1 | 40 | 290 | 17 |
| Bleach-fix | 33 | | 60 | 150 | 9 |
| Rinse (1) | 30–34 | | 20 | — | 4 |
| Rinse (2) | 30–34 | | 20 | — | 4 |
| Rinse (3) | 30–34 | | 20 | 364 | 4 |
| Drying | 70–80 | | 50 | | |

*Per square meter of photosensitive material.
(Three tank counter-flow system from rinse (3) to rinse (1))

The composition of each processing bath was as indicated below.

| | Tank Soln. | Replenisher |
|---|---|---|
| Color Development Bath | | |
| Water | 800 ml | 800 ml |
| Diethylenetriamine penta-acetic acid | 1.0 g | 1.0 g |
| Nitrilo triacetic acid | 2.0 g | 2.0 g |
| 1-Hydoxyethylidene-1,1-di-phosphonic acid | 2.0 g | 2.0 g |
| Benzyl alcohol | 16 ml | 22 ml |
| Diethyleneglycol | 10 ml | 10 ml |
| Sodium sulfite | 2.0 g | 2.5 g |
| Potassium bromide | 0.5 g | — |
| Potassium carbonate | 30 g | 30 g |
| N-Ethyl-N-(β-methanesulfon-amidoethyl)-3-methyl-4-aminoaniline sulfate | 5.5 g | 7.5 g |
| Hydrolamine sulfate | 2.0 g | 2.5 g |
| Fluorescent whitener (Whitex 4B, made by Sumitomo Chemicals) | 1.5 g | 2.0 g |
| Water to make up to | 1000 ml | 1000 ml |
| pH (25° C.) | 10.20 | 10.60 |

-continued

| | Tank Soln. | Replenisher |
|---|---|---|
| Bleach-fix Bath | | |
| Water | 400 ml | 400 ml |
| Ammonium thiosulfate (70%) | 200 ml | 200 ml |
| Sodium sulfite | 20 g | 20 g |
| Ethylenediamine tetra-acetic acid, Fe(III) ammonium salt | 60 g | 120 g |
| Ethylenediamine tetra-acetic acid, disodium salt | 5 g | 10 g |
| Water to make up to | 1000 ml | 1000 ml |
| pH (25° C.) | 6.70 | 6.30 |
| Rinse Bath | | |
| Ion exchanged water (Calcium and magnesium both less than 3 ppm) | | |

Tests concerning the light fastness, heat fastness and the fastness to moist heat of each of the processed samples were carried out as indicated below. Thus, the extent of fading on storing samples for 5 days in the dark at 100° C., for 12 days in the dark at 80° C., 70% R.H., for 3 months in the dark at 60° C., 70% R.H. and for 5 months in the light in a fluorescent lamp fadometer (30,000 lux) were measured and the results obtained, expressed as the fractional reduction in density at an initial density of 1.5 (except in the case of the light fastness tests where the initial density was 1.0) are shown in Table 1.

TABLE 1

| Sample | Coupler Type (Illustrative compound) | Polymer Type (Illustrative compound) | Polymer Amount (mg/m²) | Dark Fading (%) 5 Days 100° C. | Dark Fading (%) 6 Months 70° C. | Dark Fading (%) 12 Days 80° C., 70% | Dark Fading (%) 3 Months 60° C., 70% | Light Fading (%) Fluorescent lamp 30,000 lux, 5 Months |
|---|---|---|---|---|---|---|---|---|
| Comparative Examples | | | | | | | | |
| 101 | C-3, C-11 | — | — | 42 | 39 | 26 | 24 | 54 |
| 102 | C-3 | — | — | 59 | 48 | 36 | 33 | 50 |
| 103 | C-3 | — | — | 28 | 24 | 13 | 12 | 60 |
| 104 | C-14 | — | — | 6 | 6 | 5 | 7 | 94 |
| 105 | C-58 | — | — | 62 | 53 | 39 | 35 | 57 |
| This Invention | | | | | | | | |
| 106 | C-1 | P-3 | 300 | 28 | 23 | 19 | 17 | 33 |
| 107 | C-1 | P-27 | 300 | 26 | 22 | 17 | 15 | 32 |
| 108 | C-1 | P-57 | 250 | 22 | 18 | 14 | 12 | 23 |
| 109 | C-1 | P-110 | 280 | 26 | 20 | 17 | 16 | 30 |
| 110 | C-1 | P-119 | 200 | 27 | 21 | 20 | 18 | 33 |
| 111 | C-3 | P-33 | 300 | 16 | 12 | 10 | 9 | 36 |
| 112 | C-3, C-11 | P-57 | 270 | 12 | 8 | 8 | 7 | 35 |
| 113 | C-3 | P-122 | 300 | 13 | 9 | 10 | 8 | 36 |
| 114 | C-14 | P-3 | 300 | 4 | 3 | 4 | 4 | 46 |
| 115 | C-14 | P-57 | 250 | 3 | 3 | 3 | 3 | 51 |
| 116 | C-14 | P-119 | 280 | 4 | 3 | 3 | 3 | 50 |
| 117 | C-58 | P-27 | 300 | 32 | 26 | 18 | 17 | 47 |
| 118 | C-58 | P-27 | 230 | 28 | 20 | 17 | 14 | 44 |
| 119 | C-58 | P-74 | 250 | 30 | 25 | 16 | 13 | 45 |
| 120 | C-58 | P-120 | 280 | 31 | 26 | 18 | 15 | 40 |

It is clear from Table 1 that the heat resistance, moisture resistance and the light resistance were all improved by means of this invention.

EXAMPLE 2

The multi-layer silver halide photosensitive material 201 of which the layer structure is indicated below was prepared on a paper support which had been laminated on both sides with polyethylene.

Layer Structure

The composition of each layer is indicated below. The numerical values indicate coated weights (in grams per square meter). In the case of the silver halide emulsions the weight coated is indicated after calculation as silver.

Support

Polyethylene laminated paper (white pigment ($TiO_2$) and ultramarine dye were included in the polyethylene on the first layer side)

| | |
|---|---|
| First Layer (Blue Sensitive Layer) | |
| Mono-disperse silver chlorobromide emulsion (EM7) which had been spectrally sensitized with the sensitizing dye (ExS-7) | 0.27 |
| Gelatin | 1.86 |
| Yellow coupler (Y-2) | 0.82 |
| Polymer (P-57) | 0.08 |
| Solvent (Solv-6) | 0.35 |
| Second Layer (Anti-color Mixing Layer) | |
| Gelatin | 0.99 |
| Anti-color mixing agent (Cpd-3) | 0.06 |
| Solvent (Solv-3) | 0.12 |
| Third Layer (Green Sensitive Layer) | |
| Mono-disperse silver chlorobromide emulsion (EM8) which had been spectrally sensitized with the sensitizing dye (ExS-3,6) | 0.45 |
| Gelatin | 1.24 |
| Magenta coupler (M-1) | 0.35 |
| Colored image stabilizer (Cpd-4) | 0.12 |
| Colored image stabilizer (Cpd-15) | 0.06 |
| Colored image stabilizer (Cpd-16) | 0.10 |
| Colored image stabilizer (Cpd-17) | 0.01 |
| Solvent (Solv-3) | 0.25 |
| Solvent (Solv-4) | 0.25 |
| Fourth Layer (Ultraviolet Absorbing Layer) | |
| Gelatin | 1.60 |
| Ultraviolet absorber (Cpd-7/Cpd-8/Cpd-19 = 3/2/6 by weight) | 0.70 |
| Anti-color mixing agent (Cpd-3) | 0.05 |
| Solvent (Solv-7) | 0.42 |
| Fifth Layer (Red Sensitive Layer) | |
| Mono-disperse silver chlorobromide emulsion (EM9) which had been spectrally sensitized with the sensitizing dye (ExS-4,5) | 0.20 |

-continued

| | |
|---|---|
| Gelatin | 0.92 |
| Cyan coupler (C-1) | 0.15 |
| Cyan coupler (C-14) | 0.18 |
| Colored image stabilizer (Cpd-1) | 0.02 |
| Ultraviolet absorber (Cpd-7/Cpd-9/Cpd-19 = 3/4/2 by weight) | 0.17 |
| Solvent (Solv-6) | 0.20 |
| Sixth Layer (Ultraviolet Absorbing Layer) | |
| Gelatin | 0.54 |
| Ultraviolet absorber (Cpd-7/Cpd-9/Cpd-17 = 1/5/3 by weight) | 0.21 |
| Solvent (Solv-7) | 0.08 |
| Seventh Layer (Protective Layer) | |
| Acid treated gelatin | 1.33 |
| Acrylic modified copolymer of poly(vinyl alcohol) 17% modification) | 0.17 |
| Liquid paraffin | 0.03 |

Furthermore, Cpd-11 and Cpd-12 were used at this time as anti-irradiation compounds. Moreover, "Alcanol XC" (made by DuPont), sodium alkylbenzenesulfonate, succinic acid ester and "Megafac F-120" (made by Dainippon Ink) were used as emulsification and dispersion, and coating, promotors in each layer. Cpd-13 and Cpd-14 were used as silver halide stabilizers.

Furthermore, 1-oxy-3,5-dichloro-s-triazine, sodium salt, was used as a gelatin hardening agent in each layer and Cpd-2 was used as a viscosity increasing agent.

Details of the emulsions used are indicated below.

| Emulsion | Form | Average Grain Size (μm) | Br Content (mol %) | Variation Coeff. |
|---|---|---|---|---|
| EM-7 | Cubic | 0.85 | 0.6 | 0.10 |
| EM-8 | Cubic | 0.45 | 1.0 | 0.09 |
| EM-9 | Cubic | 0.34 | 1.8 | 0.10 |

Variation Coeff. = Standard Deviation/Average Grain Size.

ExS-6

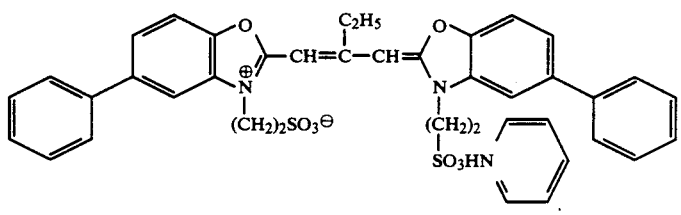

ExS-7

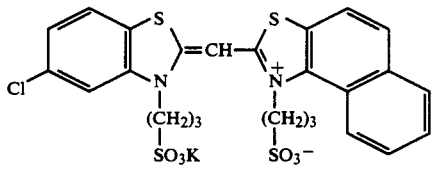

$7 \times 10^{-4}$ mol/mol.Ag

Cpd-15

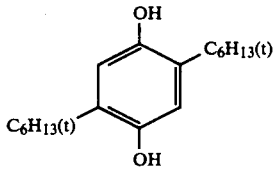

-continued

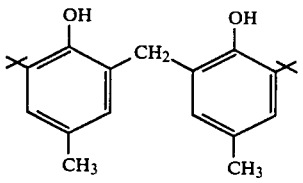

Cpd-16

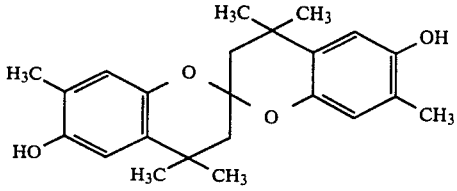

Cpd-17

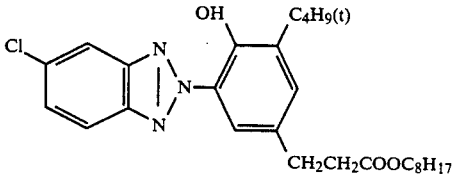

Cpd-18

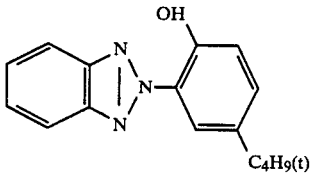

Cpd-19

Dibutyl phthalate — Solv-6

Dioctyl Sebaceate — Solv-7

Preparation of Samples 202 to 220

Samples 202 to 220 were prepared in the same way as Sample 201 except that the couplers, solvents and polymers shown in Table 2 were added instead of the cyan couplers (C-1) and (C-14) and solvent in the fifth layer of Sample 201. The couplers were replaced on an equimolar basis with respect to (C-1) and (C-14), and the solvent was replaced with an equimolar amount.

The emulsified dispersions of coupler, etc. in Samples 201 to 220 were prepared according to the Example 1.

The above mentioned photosensitive materials were exposed through an optical wedge and then they were processed in the way indicated below.

| Processing Operation | Temperature | Time |
|---|---|---|
| Color development | 35° C. | 45 seconds |
| Bleach-fix | 30–36° C. | 45 seconds |
| Stabilizer (1) | 30–37° C. | 20 seconds |
| Stabilizer (2) | 30–37° C. | 20 seconds |
| Stabilizer (3) | 30–37° C. | 20 seconds |
| Stabilizer (4) | 30–37° C. | 30 seconds |
| Drying | 70–85° C. | 60 seconds |

(Four tank counter-flow system from stabilizer (4) to stabilizer (1)

The composition of each of processing bath is indicated below.

| Color Development Bath | |
|---|---|
| Water | 800 ml |
| Diethylenetriamine penta-acetic acid | 2.0 g |

-continued

| | |
|---|---|
| Triethanolamine | 8.0 g |
| Sodium chloride | 1.4 g |
| Potassium carbonate | 25 g |
| N-Ethyl-N-(-methanesulfonamidoethyl)-3-methyl-4-aminoaniline sulfate | 5.0 g |
| N,N-diethylhydroxylamine | 4.2 g |
| 5,6-Dihydroxybenzene-1,2,4-trisulfonic acid | 0.3 g |
| Fluorescent whitener 4,4'diamino-stilbene based) | 2.0 g |
| Water to make up to | 1000 ml |
| pH (25° C.) | 10.10 |
| Bleach-fix Bath | |
| Water | 400 ml |
| Ammonium thiosulfate (70%) | 100 ml |
| Sodium sulfite | 18 g |
| Ethylenediamine tetraacetic acid, FE(III) ammonium salt | 55 g |
| Ethylenediamine tetraacetic acid, disodium salt | 3 g |
| Glacial acetic acid | 8 g |
| Water to make up to | 1000 ml |
| pH (25° C.) | 5.5 |
| Stabilizer Bath | |
| Formalin (37%) | 0.1 g |
| Formalin/sulfurous acid adduct | 0.7 g |
| 5-Chloro-2-methyl-4-isothiazolin-3-one | 0.02 g |
| 2-Methyl-4-isothiazolin-3-one | 0.01 g |
| Copper sulfate | 0.005 g |
| Water to make up to | 1000 ml |
| pH (25° C.) | 4.0 |

After processing, the photographic characteristics were evaluated in the same way as in Example 1. The results obtained are shown in Table 2.

It is clear from Table 2 that the photosensitive materials of this invention have a high degree of image fastness.

TABLE 2

| Sample | Coupler Type | Solvent | Polymer Type (Illustrative compound) | Polymer Amount (mg/m²) | Heat Fading (%) 5 Days 100° C. | Heat Fading (%) 12 Days 80° C., 7% | Light Fading (%) Fluorescent Lamp 30,000 lux, 6 Months |
|---|---|---|---|---|---|---|---|
| Comparative Examples | | | | | | | |
| 201 | C-3, C-11 | Solv-6 | — | — | 33 | 24 | 52 |
| 202 | C-1, C-14 | — | — | — | 25 | 19 | 59 |
| 203 | C-1 | Solv-6 | — | — | 55 | 34 | 50 |
| 204 | C-3 | Solv-2 | — | — | 27 | 20 | 58 |
| 205 | C-3 | — | — | — | 20 | 16 | 63 |
| 206 | C-58 | Solv-2 | — | — | 64 | 40 | 58 |
| This Invention | | | | | | | |
| 207 | C-1 | Solv-6 | P-3 | 300 | 26 | 20 | 33 |
| 208 | C-1 | — | P-3 | 300 | 19 | 13 | 35 |
| 209 | C-1 | Solv-3 | P-27 | 280 | 24 | 19 | 32 |
| 210 | C-1 | Solv-6 | P-110 | 250 | 24 | 20 | 30 |
| 211 | C-1, C-14 | Solv-6 | P-57 | 240 | 18 | 11 | 32 |
| 212 | C-1, C-14 | — | P-57 | 240 | 15 | 9 | 33 |
| 213 | C-3 | Solv-3 | P-4 | 300 | 15 | 9 | 35 |
| 214 | C-3 | Solv-2 | P-122 | 280 | 12 | 7 | 34 |
| 215 | C-3 | Solv-6 | P-57 | 200 | 10 | 6 | 31 |
| 216 | C-3 | — | P-57 | 200 | 8 | 5 | 32 |
| 217 | C-58 | Solv-3 | P-27 | 250 | 28 | 20 | 40 |
| 218 | C-58 | Solv-3 | P-56 | 200 | 20 | 18 | 40 |
| 219 | C-58 | Solv-6 | P-120 | 300 | 22 | 19 | 41 |
| 220 | C-58 | — | P-120 | 280 | 18 | 16 | 43 |

EXAMPLE 3

Color photographic material 301 was prepared by lamination coating the first to the fourteenth layers indicated below onto a triacetate base.

Layer Structure

The composition of each layer is indicated below. The numerical values indicate coated weights (in grams per square meter). In the case of the silver halides the weight coated is indicated after calculation as silver.

| | |
|---|---|
| First Layer (Anti-halation Layer) | |
| Black colloidal silver | 0.30 |
| Gelatin | 2.50 |
| UV-1 | 0.05 |
| UV-2 | 0.10 |
| UV-3 | 0.10 |
| Solv-1 | 0.10 |
| Second Layer (Intermediate Layer) | |
| Gelatin | 0.50 |
| Third Layer (Low Speed Red Sensitive Layer) | |
| Mono-disperse silver iodobromide emulsion (AgI 4 mol %, cubic, average grain size 0.3μ, s/r = 0.15) | 0.50 |
| ExS-1 | $1.40 \times 10^{-3}$ |
| ExS-2 | $6.00 \times 10^{-5}$ |
| Gelatin | 0.80 |
| C-54 | 0.3 |
| Solv-2 | 0.15 |
| Fourth Layer (Intermediate Speed Red Sensitive Layer) | |
| Mono-disperse silver iodobromide emulsion (AgI 2.5 mol %, tetradecahedral, average grain size 0.45μ, s/r = 0.15) | 0.50 |
| ExS-1 | $1.60 \times 10^{-3}$ |
| ExS-2 | $6.00 \times 10^{-5}$ |
| Gelatin | 1.00 |
| C-54 | 0.45 |
| Solv-2 | 0.23 |
| Fifth Layer (High Speed Red Sensitive Layer) | |
| Mono-disperse silver iodobromide emulsion (AgI 2.5 mol %, tetradecahedral, average grain size 0.60μ, s/r = 0.15) | 0.30 |
| ExS-1 | $1.60 \times 10^{-3}$ |
| ExS-2 | $6.00 \times 10^{-5}$ |
| Gelatin | 0.70 |
| C-54 | 0.3 |
| Solv-2 | 0.15 |

-continued

| | |
|---|---|
| Sixth Layer (Intermediate Layer) | |
| Gelatin | 1.0 |
| Cpd-1 | 0.1 |
| Solv-1 | 0.03 |
| Solv-2 | 0.08 |
| Solv-3 | 0.12 |
| Cpd-2 | 0.25 |
| Seventh Layer (Low Speed Green Sensitive Layer) | |
| Silver iodobromide emulsion (AgI 3.0 mol %, regular crystal, twinned crystal mixture, average grain size 0.3μ) | 0.65 |
| ExS-3 | $3.30 \times 10^{-3}$ |
| ExS-4 | $1.50 \times 10^{-3}$ |
| Gelatin | 1.50 |
| M-45 | 0.10 |
| M-46 | 0.25 |
| Solv-2 | 0.30 |
| Eighth Layer (High Speed Green Sensitive Layer) | |
| Tabular Silver Iodobromide emulsion (AgI 2.5 mol %, grains with diameter/thickness greater than 5 accounting for 50% of the total projected area, grain thickness 0.15μ) | 0.70 |
| ExS-3 | $1.30 \times 10^{-3}$ |
| ExS-4 | $5.00 \times 10^{-4}$ |
| Gelatin | 1.00 |
| M-47 | 0.25 |
| Cpd-3 | 0.10 |
| Cpd-4 | 0.05 |
| Solv-2 | 0.05 |
| Ninth Layer (intermediate Layer) | |
| Gelatin | 0.50 |
| Tenth Layer (Yellow Filter Layer) | |
| Yellow colloidal silver | 0.10 |
| Gelatin | 1.00 |
| Cpd-1 | 0.05 |
| Solv-1 | 0.03 |
| Solv-2 | 0.07 |
| Cpd-2 | 0.10 |
| Eleventh Layer (Low Speed Blue Sensitive Layer) | |
| Silver iodobromide emulsion (AgI 2.5 mol %, regular crystal, twinned crystal mixture, average grain size 0.7μ) | 0.55 |
| ExS-4 | $1.00 \times 10^{-3}$ |
| Gelatin | 0.90 |
| γ-9 | 0.50 |
| Silv-2 | 0.10 |
| Twelfth Layer (High Speed Blue Sensitive Layer) | |

-continued

| | |
|---|---|
| Tabular Silver Iodobromide emulsion (AgI 2.5 mol %, grain with diameter/thickness greater than 5 accounting for 50% of the total projected area, average grain thickness 0.13μ) | 1.00 |
| ExS-4 | $1.70 \times 10^{-3}$ |
| Gelatin | 2.00 |
| γ-9 | 1.00 |
| Solv-2 | 0.20 |
| Thirteenth Layer (Ultraviolet Absorbing Layer) | |
| Gelatin | 1.50 |
| UV-1 | 0.02 |
| UV-2 | 0.04 |
| UV-3 | 0.04 |
| Cpd-5 | 0.30 |
| Solv-1 | 0.30 |
| Cpd-6 | 0.10 |
| Fourteenth Layer (Protective Layer) | |
| Fine grain silver iodobromide emulsion (AgI 1 mol %, average grain size 0.05μ) | 0.10 |
| Gelatin | 2.00 |
| H-1 | 0.30 |

ExS-1

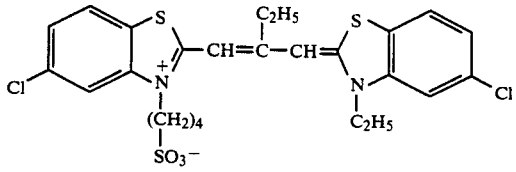

ExS-2

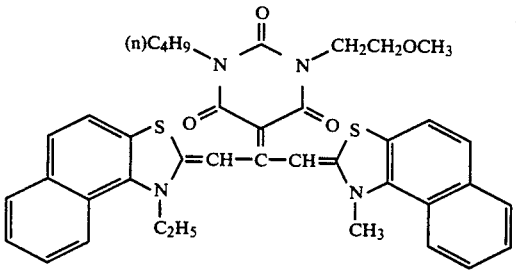

ExS-3

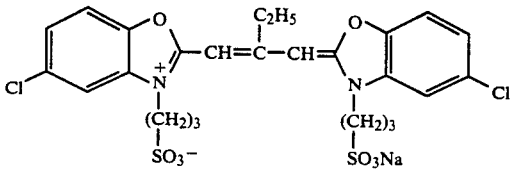

ExS-4

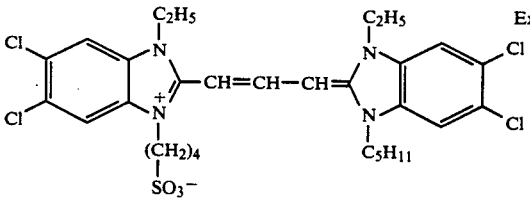

ExS-5

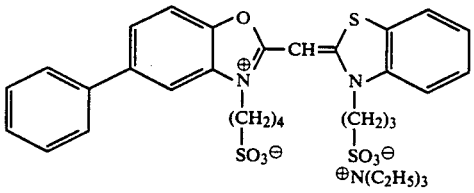

UV-1

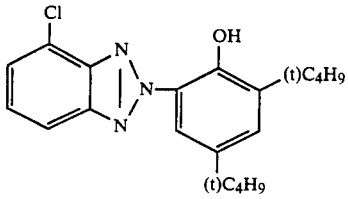

UV-2

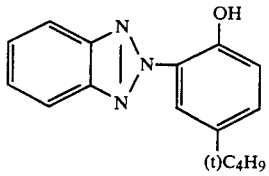

UV-3

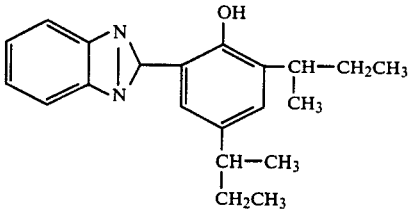

Cpd-1

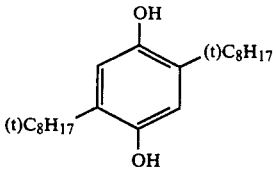

Poly(ethyl acrylate) Cpd-2

Cpd-3

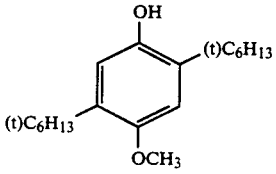

Cpd-4

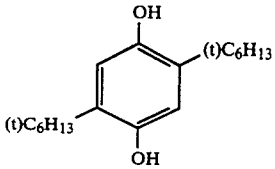

Cpd-5

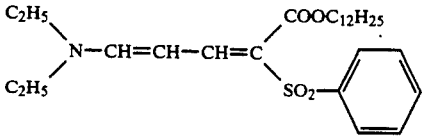

Cpd-6

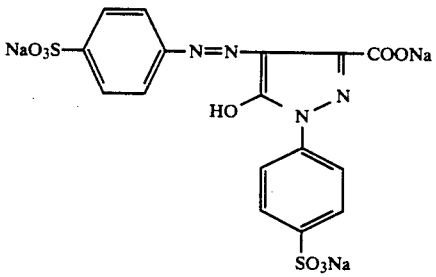

Dibutyl phthalate Solv-1:
Tricresyl phosphate Solv-2:

-continued

| | |
|---|---|
| Trinonyl phosphate | Solv-3: |
| 1,2-bis(Vinylsulfonylacetamido)ethane | H-1: |

Preparation of Samples 302 to 310

Samples 302 to 310 were prepared in the same way as Sample 301 except that the couplers and polymers shown in Table 3 were added instead of the coupler (C-54) added to the third, fourth and fifth layers in Sample 301. The couplers were added in amounts equimolar with the C-54.

The silver halide color photographic materials prepared in this way were processed in the way indicated below.

| Processing Operation | Time | Temperature |
|---|---|---|
| First development | 6 minutes | 38° C. |
| Water wash | 2 minutes | 38° C. |
| Reversal | 2 minutes | 38° C. |
| Color development | 6 minutes | 38° C. |
| Conditioning | 2 minutes | 38° C. |
| Bleach | 6 minutes | 38° C. |
| Fix | 4 minutes | 38° C. |
| Water wash | 4 minutes | 38° C. |
| Stabilization | 1 minute | 25° C. |

the composition of each processing bath was as follows:

| First Development Bath | |
|---|---|
| Nitrilo-N,N,N-trimethylenephosphonic acid, penta-sodium salt | 2.0 g |
| Sodium sulfite | 30 g |
| Hydroquinone monosulfate, potassium salt | 20 g |
| Potassium carbonate | 33 g |
| 1-Phenyl-4-methyl-4-hydroxymethyl 3-pyrazolidone | 2.0 g |
| Potassium bromide | 2.5 g |
| Potassium thiocyanate | 1.2 g |
| Potassium iodide | 2.0 mg |
| Water to make up to | 1000 ml |
| pH | 9.60 |

The pH was adjusted with hydrochloric acid or potassium hydroxide.

| Reversal Bath | |
|---|---|
| Nitrilo-N,N,N-trimethylenephosphonic acid, penta-sodium salt | 3.0 g |
| Stannous chloride, di-hydrate | 1.0 g |
| p-Aminophenol | 0.1 g |
| Sodium hydroxide | 8 g |
| Glacial acetic acid | 15 ml |
| Water to make up to | 1000 ml |
| pH | 6.00 |

The pH was adjusted with hydrochloric acid or sodium hydroxide.

| Color Development Bath | |
|---|---|
| Nitrilo-N,N,N-trimethylenephosphonic acid, penta-sodium salt | 2.0 g |
| Sodium sulfite | 7.0 g |
| Trisodium phosphate.penta-hydrate | 36 g |
| Potassium bromide | 1.0 g |
| Potassium iodide | 90 mg |
| Sodium hydroxide | 3.0 g |
| Citrazinic acid | 1.5 g |
| N-Ethyl-N-(β-methanesulfonamidoethyl)-3-methyl-4-aminoaniline sulfate | 11 g |
| 3,6-Dithiaoctane-1,8-diol | 1.0 g |
| Water to make up to | 1000 ml |
| pH | 11.80 |

The pH was adjusted with hydrochloric acid or potassium hydroxide.

| Conditioner Bath | |
|---|---|
| Ethylenediamine tetra-acetic acid, di-sodium salt, di-hydrate | 8.0 g |
| Sodium sulfite | 12 g |
| 1-thioglycerine | 0.4 ml |
| Water to make up to | 1000 ml |
| pH | 6.20 |

The pH was adjusted with hydrochloric acid or sodium hydroxide.

| Bleach Bath | |
|---|---|
| Ethylenediamine tetra-acetic acid, di-sodium salt, di-hydrate | 2.0 g |
| Ethylenediamine tetra-acetic acid, Fe(III) ammonium salt, di-hydrate | 120 g |
| Potassium bromide | 100 g |
| Ammonium nitrate | 10 g |
| Water to make up to | 1000 ml |
| pH | 5.70 |

The pH was adjusted with hydrochloric acid or sodium hydroxide.

| Fixing Bath | |
|---|---|
| Ammonium thiosulfate | 80 g |
| Sodium sulfite | 5.0 g |
| Sodium bisulfite | 5.0 g |
| Water to make up to | 1000 ml |
| pH | 6.60 |

The pH was adjusted with hydrochloric acid or aqueous ammonia.

| Stabilizing Bath | |
|---|---|
| Formalin (37%) | 5.0 ml |
| Polyoxyethylene-p-monononylphenyl ether (average degree of polymerization 10) | 0.5 ml |
| Water to make up to | 1000 ml |
| pH | Not adjusted |

The heat fastness of the processed samples was tested in the way indicated below. Thus, the fractional reduction in density was noted for an initial density of 1.5 on storing in the dark for 10 days at 100° C., and on storing in the dark for 14 days at 80° C., 70% R.H., and the extents of fading obtained in this way were as shown in Table 3.

TABLE 3

| Sample | Coupler Type | Polymer Type | Polymer/ Coupler Ratio | 10 Days at 100° C. (%) | 14 Days at 80° C., 70% (%) |
|---|---|---|---|---|---|
| Comparative Examples | | | | | |
| 301 | C-54 | — | — | 12 | 10 |
| 302 | C-12 | — | — | 14 | 11 |

TABLE 3-continued

| Sample | Coupler Type | Polymer Type | Polymer/ Coupler Ratio | 10 Days at 100° C. (%) | 14 Days at 80° C., 70% (%) |
|---|---|---|---|---|---|
| 303 | C-1 | — | — | 69 | 48 |
| This Invention | | | | | |
| 304 | C-54 | P-3 | 0.8 | 6 | 4 |
| 305 | C-54 | P-57 | 0.6 | 5 | 4 |
| 306 | C-54 | P-146 | 1 | 5 | 3 |
| 307 | C-12 | P-110 | 0.5 | 7 | 4 |
| 308 | C-12 | P-56 | 0.8 | 6 | 3 |
| 309 | C-1 | P-118 | 1.1 | 25 | 20 |
| 310 | C-1 | P-119 | 0.6 | 30 | 26 |

It is clear from Table 3 that the photosensitive materials of this invention had superior dark heat fastness and damp heat fastness.

EXAMPLE 4

(This example illustrates the difference in particle size of the emulsified dispersion arising from differences in the type of surfactant and the molecular weight of the polymer.)

Ethyl acetate (45 cc) and 7.7 cc (8.0 grams) of high boiling point solvent (Solv-1) were added to 20 grams of yellow coupler (Y-2) and 12 grams of the oil soluble polymer P-57 and a solution was formed. This solution was added to 200 cc of 10% aqueous gelatin solution which contained 8 cc of 10% sodium dodecylbenzenesulfonate, and the mixture was emulsified and dispersed using a homogenizer to provide Sample 401. Samples 402 to 410 were prepared by changing the type of yellow coupler, polymer and surfactant and the particle diameters of the emulsified dispersions were measured using a Coal Tar Sub-micron Nanosizer (made by the Coal Tar Electronics Co.).

The results obtained are shown in Table 4.

The couplers, polymers and surfactants in the samples other than Sample 401 were included in equimolar amounts to those used in Sample 401.

TABLE 4

| Sample | Coupler | Polymer | Surfactant | Particle Size (μ) |
|---|---|---|---|---|
| This Invention | | | | |
| 401 | Y-2 | P-57 | W-4 | 0.22 |
| 402 | Y-2 | P-57 | W-17 | 0.02 |
| 403 | C-3 | P-3 | W-17 | 0.25 |
| Comparative Examples | | | | |
| 404 | Y-2 | P-A | W-4 | 1.02 |
| 405 | Y-2 | P-A | W-17 | 0.98 |
| Reference Examples | | | | |
| 406 | Y-2 | P-57 | W-A | 0.86 |
| 407 | C-3 | P-3 | W-A | 0.95 |
| 408 | Y-2 | P-57 | W-B | 0.78 |
| 409 | Y-2 | P-57 | W-C | 1.12 |
| 410 | C-3 | P-3 | W-C | 1.18 |

It is clear from the values of the particle diameters shown in Table 4 that emulsified dispersions which have a remarkably small particle size can be obtained using a polymer of this invention and a surfactant which can be represented by the aforementioned general formulae (K-1) and (K-2)

The coating properties (the stability of the emulsion) were good in the case of this invention and the coloring properties were also good.

W-A: "PELEX NBL" (made by the Kao Co.)

W-B: "Alcanol XC" (made by the DuPont Co.)

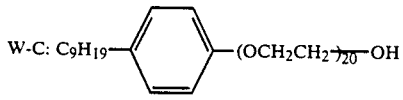

The comparative polymer P-A was prepared in the way indicated below.

Preparation of t-Butylacrylamide Polymer (P-A)

A mixture consisting of 50.0 grams of t-butylacrylamide and 150 ml of toluene was placed in a 300 ml three necked flask and heated to 65° C. with stirring under a blanket of nitrogen.

A toluene solution (10 ml) containing 300 mg of Azobis-iso-butyronitrile was added as a polymerization initiator and polymerization was started.

The reaction mixture was cooled after polymerizing for a period of 5 hours and the solid which precipitated out on pouring the reaction mixture into 1 liter of hexane was recovered by filtration, washed with hexane and then dried by heating under reduced pressure, whereupon 48.3 grams of the polymer P-A was obtained. The results of molecular weight measurements indicated that the component of molecular weight below 40,000 was 1.5%.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support and at least one silver halide photographic emulsion layer which contains a dispersion of fine lipophilic particles which were obtained by emulsifying and dispersing in hydrophilic phase a solution containing at least one type of oil soluble non-color forming polymer having a glass transition temperature of at least 60° C. and an oil soluble coupler which has been rendered fast to diffusion and which can form a dye by coupling with the oxidized form of a primary aromatic amine developing agent, wherein at least 30% but not more than 70% by weight of said oil soluble non-color forming polymer is comprised of units having a molecular weight not more than 40,000.

2. A silver halide color photographic material as in claim 1, wherein the silver halide emulsion layer contains silver chlorobromide having a silver chloride content of at least 90 mol %.

3. A silver halide photographic material as in claim 1, wherein said oil soluble non-color forming polymer has a glass transition temperature of at least 90° C.

4. A silver halide photographic material as in claim 1, wherein said polymers are homopolymers or copolymers comprised of repeating units having a

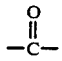

group in the main chain or in a side chain.

5. A silver halide photographic material as in claim 4, wherein said water insoluble, organic solvent soluble homopolymers or copolymers are selected from polymers or copolymers in which the repeating unit has a

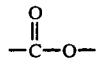

group in the main chain or in a side chain, and homopolymers or copolymers in which the repeating unit has a

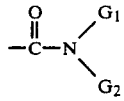

group in the main chain or in a side chain, where $G_1$ and $G_2$ each represents a hydrogen atom, or a substituted or unsubstituted alkyl or aryl group, but no more than one of $G_1$ and $G_2$ represent a hydrogen atom.

6. A silver halide color photographic material as in claim 1, wherein said polymer is a homo or copolymer derived from at least one of monomers selected from acrylic esters, methacrylic esters, vinyl esters, acrylamides, methacrylamides, olefines and vinylethers.

7. A silver halide color photographic material as in claim 6, said polymer is derived from monomers selected from methacrylates, acrylamides and methacrylamides.

8. A silver halide color photographic material as in claim 1, wherein said polymers are formed from monomers selected from the group consisting of polyesters formed from polyhydric alcohols and polybasic acids and polyamides formed from diamines and dibasic acids, and from ω-amino-ω'-carboxylic acids, and polyurethanes which are formed from diisocyanates and dihydric alcohols.

9. A silver halide color photographic material as in claim 2, wherein the silver chloride content of said silver chlorobromide is at least 98 mol %.

10. A silver halide color photographic material as in claim 2, wherein the silver halide emulsion is a monodispersed emulsion, the average grain size of which having a coefficient of variation of not more than 15%.

11. A silver halide color photographic material as in claim 1, wherein said material is produced by a process involving dissolving said coupler and polymer in a high-boiling coupler solvent and an auxiliary organic solvent to form a solution, which solution is emulsified or dispersed in water or an aqueous solution of a hydrophilic colloid to form particles, which particles are dispersed in said at least one silver halide emulsion layer.

12. A silver halide color photographic material as in claim 1, wherein the mixing ratio of the oil soluble coupler which has been rendered fast to diffusion to the oil soluble non-color forming polymer is from 1:5 to 10:1 by weight.

13. A silver halide color photographic material as in claim 1, wherein the mixing ratio of the oil soluble coupler which has been rendered fast to diffusion and the oil soluble non-color forming polymer is from 1:2 to 4:1 by weight.

14. A silver halide color photographic material as in claim 1, wherein the average particle size of the fine lipophilic particles is within the range of from 0.04 μm to 2 μm.

15. A silver halide color photographic material as in claim 1, wherein the average particle size of the fine lipophilic particles is within the range of from 0.06 μm to 0.4 μm.

16. A silver halide color photographic material as in claim 11, wherein said high-boiling coupler solvent is selected from compounds of formulae (I) to (VI):

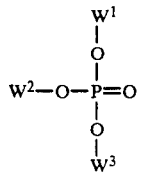

General Formula (I)

$W^1—COOW^2$ General Formula (II)

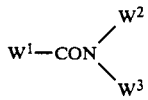

General Formula (III)

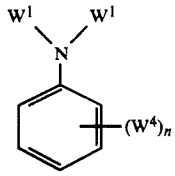

General Formula (IV)

$W^1—O—W^2$ General Formula (V)

$HO—W^6$ General Formula (VI)

wherein $W^1$, $W^2$ and $W^3$ each represent a substituted or unsubstituted alkyl, cycloalkyl, alkenyl, aryl or heterocyclic group, $W^4$ represents $W^1$, O—$W^1$ or S—$W^1$, n represents an integer of value from 1 to 5, and when n is 2 or more the groups represented by $W^4$ may be the same or different, and, in general formula (V), $W^1$ and $W^2$ can be linked together to form a condensed ring, and $W^6$ represents a saturated or unsaturated alkyl or aryl group, and the number of carbon atoms in the structure of $W^6$ is at least 12.

17. A silver halide color photographic material as in claim 1, wherein said emulsifying and dispersing is carried out in the presence of a surfactant of formula (K-1) and/or (K-2):

General Formula (K-1):

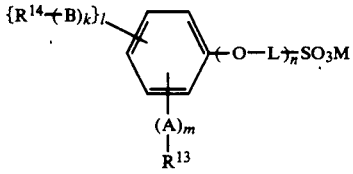

wherein $R_{13}$ and $R_{14}$ each represents an alkyl group having from 4 to 20 carbon atoms; L represents an alkylene group; A and B each represents a —COO— or —CONH— group; M represents a hydrogen atom or an alkali metal atom; k, l and m represent 0 or 1, and n represents an integer of from 0 to 10;

General Formula (K-2):

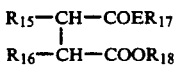

wherein one of $R_{15}$ and $R_{16}$ represents a hydrogen atom and the other represents an $—SO_3M$ group where M has the same significance as in General Formula (K-1); $R_{17}$ and $R_{18}$ each represent an alkyl group having from 4 to 20 carbon atoms; and E represents an oxygen atom or an $—NR^7—$ group where $R^7$ represents an alkyl group having from 1 to 8 carbon atoms.

18. A silver halide color photographic material as in claim 2, wherein the silver halide emulsion is a mixture of several monodispersed emulsion, the average grain size of each emulsion having a coefficient of variation of not more than 15%.

19. A silver halide color photographic material as in claim 11, wherein the auxiliary solvent is selected from a lower alcohol acetate, ethyl propionate, sec-butyl alcohol, methyl ethyl ketone, methyl isobutyl ketone, β-ethoxyethyl acetate, methylcellosolve acetate, and cyclohexanone.

* * * * *